US005882847A

United States Patent [19]

Haijima et al.

[11] Patent Number: 5,882,847

[45] **Date of Patent: *Mar. 16, 1999**

[54] IMAGE FORMATION METHOD USING A SILVER HALIDE COLOR PHOTOGRAPHIC MATERIAL

[75] Inventors: Akimitsu Haijima; Toshihiro Nishikawa, both of Kanagawa, Japan

[73] Assignee: Fuji Photo Film Co., Ltd., Kanagawa, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 815,991

[22] Filed: Mar. 10, 1997

Related U.S. Application Data

[62] Division of Ser. No. 597,152, Feb. 6, 1996, abandoned.

[30] Foreign Application Priority Data

Feb. 7, 1995 [JP] Japan ..... 7-041417
Apr. 25, 1995 [JP] Japan ..... 7-122942

[51] Int. Cl.[6] ..... G03C 7/407

[52] U.S. Cl. ..... 430/383; 430/469; 430/486; 430/487; 430/488; 430/489

[58] Field of Search ..... 430/357, 383, 430/467, 469, 486, 487, 488, 489

[56] References Cited

U.S. PATENT DOCUMENTS

| | | | |
|---|---|---|---|
| H1548 | 6/1996 | Iwagaki | 430/533 |
| H1550 | 6/1996 | Hoshino | 430/567 |
| H1594 | 9/1996 | Sekiya et al. | 430/506 |
| 3,832,174 | 8/1974 | Bello et al. | 430/362 |
| 5,344,750 | 9/1994 | Fujimoto et al. | 430/487 |
| 5,455,146 | 10/1995 | Nishikawa et al. | 430/383 |
| 5,472,822 | 12/1995 | Hayashi | 430/455 |
| 5,529,894 | 6/1996 | Mihayashi et al. | 430/544 |
| 5,534,399 | 7/1996 | Mihayashi | 430/553 |
| 5,538,835 | 7/1996 | Hosokawa | 430/503 |
| 5,538,837 | 7/1996 | Mihayashi et al. | 430/505 |
| 5,538,838 | 7/1996 | Suga et al. | 430/505 |
| 5,541,043 | 7/1996 | Inoie et al. | 430/503 |
| 5,541,050 | 7/1996 | Mihayashi et al. | 430/550 |
| 5,545,513 | 8/1996 | Edwards | 430/506 |
| 5,547,817 | 8/1996 | Okada et al. | 430/393 |
| 5,550,012 | 8/1996 | Suga | 430/567 |
| 5,550,014 | 8/1996 | Maruyama et al. | 430/567 |
| 5,607,819 | 3/1997 | Ishikawa | 430/487 |

FOREIGN PATENT DOCUMENTS

| | | | |
|---|---|---|---|
| 0329016 | 8/1989 | European Pat. Off. . | |
| 0467300 | 1/1992 | European Pat. Off. . | |
| 0569975 | 11/1993 | European Pat. Off. . | |
| 2-2553 | 1/1990 | Japan | G03C 7/407 |

*Primary Examiner*—Hoa Van Le
*Attorney, Agent, or Firm*—Sughrue, Mion, Zinn, Macpeak & Seas, PLLC

[57] ABSTRACT

A color light-sensitive material advantageous in that a ratio of γ in a short time processing using a color developer containing a silver halide solvent to γ in a standard time processing using a color developer containing no silver halide solvent is from 0.8 to 1.2 in any case of yellow, magenta and cyan and an image formation method using the same.

6 Claims, No Drawings

IMAGE FORMATION METHOD USING A SILVER HALIDE COLOR PHOTOGRAPHIC MATERIAL

This is a Divisional of application Ser. No. 08/597,152 filed Feb. 6, 1996, now abandoned.

FIELD OF THE INVENTION

The present invention relates to a silver halide color photographic light-sensitive material (hereinafter sometimes referred to silver halide color photographic material) suitable for rapid processing and to a color image formation method using the same. More specifically, the present invention relates to a silver halide color photographic material improved in the balance of gradation lost due to short processing time allotted to the color development and thereby ensuring an image of the same gradation either in the processing widely popularized at the present time or in the rapid processing, and to a color image formation method using the same.

BACKGROUND OF THE INVENTION

The development processing time of a color negative light-sensitive material is extremely reduced as a result of introduction of C-41 Processing by Kodak Co. in 1972, where the wet processing time exclusive of drying is 17 minutes and 20 seconds. The processing time is further reduced by CN-16FA Processing recently introduced into the minilab market by Fuji Photo Film Co., Ltd., where the wet processing time is 8 minutes and 15 seconds.

However, even in the present time thus directing to rapid processing, when a user orders printing of a photographed negative material, it requires around 30 minutes to finish up the printing by the processing at a shop (so-called minilab) and therefore, a large number of users are actually enforced to attend the photographic shop twice. In order to meet the requirement by users that the order be answered by once attendance to the photographic shop, it is being demanded to achieve further remarkable reduction in the development processing time in the current system of color negative film and color paper.

The development time is conventionally reduced mainly in the desilvering step after the color development step and, stating about the above-described C-41 Processing and CN-16FA Processing, the color development time is 3 minutes and 15 seconds in the former and 3 minutes and 5 seconds in the latter. In CN-16FA Processing, the color development time occupies about 40% of the entire development processing time and accordingly, a large reduction in the development time is in fact very difficult unless the color development time is reduced.

On the other hand, C-41 Processing and development processings (for example, CN-16 FA Processing) having an interchangeability therewith are now popularized widely over the world and therefore, for introducing a rapid processing resulting from reduction in the color development time into the practical market, the rapid processing must have an interchangeability with C-41 Processing.

A color negative light-sensitive material usually comprises several spectral-sensitivity silver halide emulsion layers and is designed to provide optimal balance of gradation among respective emulsion layers upon development, however, when a rapid processing reduced in the color development time is applied thereto, the balance of gradation is lost and thereby the color reproducibility is greatly worsened.

A processing method for achieving the same gradation even when development processings different in the color development time are conducted is disclosed, for example, in JP-A-2-2553 (the term "JP-A" as used herein means an "unexamined published Japanese patent application"). According to this processing method, the same gradation can be obtained by varying the processing temperature, the concentration of color developing agent in the color developer and the color development time. More specifically, the above-described patent publication proves in Example 1 that gradation equal to the gradation (γ value) obtained by the processing where the processing temperature is 38° C., the concentration of color developing agent is 15 mmol/l and the color development time is 3 minutes and 15 seconds (assumed to be the same with C-41 Processing), can be obtained by the processing where the processing temperature is 38° C., the concentration of the color developing agent is 150 mmol/l and the color developing time is 1 minute and 30 seconds.

However, the reduction in the color developing time according to the above-described processing method involves remarkable acceleration of self-coupling reaction of the color developing agent in the solution because the concentration of the color developing agent exceeds 100 mmol/l, whereby the concentration of the color developing agent is lowered after storage to cause large fluctuation in the photographic properties and also the coloration to the light-sensitive material increases due to the products produced by the above-described self-coupling reaction. Further, the color developing agent remaining in the light-sensitive material after the development processing increases and as a result, the density (stain) particularly at the unexposed area is extremely intensified.

When the concentration of the color developing agent is set to 80 mmol/l or less and the color development processing time is reduced to 1 minute and 30 seconds or less by raising the processing temperature to 40° C. or higher so as to overcome the above-described problems, diffusion of the color developing agent plays a rate-determining step and development of the lower layer (an emulsion layer closer to the support) is retarded more than the development of the upper layer (an emulsion layer farther from the support) of the light-sensitive material, so that the balance of gradation between the upper layer and the lower layer is lost and the color reproducibility is markedly deteriorated.

SUMMARY OF THE INVENTION

An object of the present invention is to provide a silver halide color photographic material improved in the balance of gradation lost due to short processing time allotted to the color development and thereby ensuring an image of the same gradation either in the processing widely popularized at the present time or in the rapid processing, and to a color image formation method using the same.

The above-described object of the present invention has been achieved by the following means.

(1) A silver halide color photographic material comprising a support having thereon at least one red-sensitive silver halide emulsion layer, at least one green-sensitive silver halide emulsion layer and at least one blue-sensitive silver halide emulsion layer, wherein, when the following two kinds of developments, namely, Development Processing A and Development Processing B, different in the color development time are conducted, the yellow, magenta and cyan gradients obtained satisfy the following conditional expressions:

$$0.8 \leqq \gamma_B(C)/\gamma_A(C) \leqq 1.2$$

$$0.8 \leqq \gamma_B(M)/\gamma_A(M) \leqq 1.2$$

$$0.8 \leqq \gamma_B(Y)/\gamma_A(Y) \leqq 1.2$$

wherein $\gamma_A$(Y), $\gamma_A$(M) and $\gamma_A$(C) represent the yellow, magenta and cyan gradients, respectively, obtained when Development Processing A is conducted and $\gamma_B$(Y), $\gamma_B$(M) and $\gamma_B$(C) represent the yellow, magenta and cyan gradients, respectively, obtained when Development Processing B is conducted);

(Development Processing A)

the color development time is from 150 to 200 seconds, the temperature of the color developer is from 35° to 40° C. and the color development uses a color developer containing from 10 to 20 mmol/l of a color developing agent and substantially free of silver halide solvent;

(Development Processing B)

the color development time is from 25 to 90 seconds, the temperature of the color developer is from 40° to 60° C. and the color development uses a color developer containing from 25 to 80 mmol/l of a color developing agent and containing at least one silver halide solvent selected from a thiosulfate, a methanethiosulfonate, a thiocyanate and compounds represented by the following formulae (I) to (V):

$$L_1—(A—L_2)_n—B—L_3 \quad (I)$$

wherein $L_1$ and $L_3$, which may be the same or different, each represents an alkyl group, an aryl group, an aralkyl group, an alkenyl group or a heterocyclic group; $L_2$ represents an alkylene group, an arylene group, an aralkylene group, a heterocyclic ring linking group or a linking group comprising a combination of these groups; A and B, which may be the same or different, each represents —S—, —O—, —NR—, —CO—, —CS—, —$SO_2$— or a group comprising any combination of these; n represents an integer of from 1 to 10; provided that at least one of $L_1$ and $L_3$ is substituted by a —COOM group, an —OM group or an —$SO_3$M group; M represents a hydrogen atom or a counter cation; and R represents a hydrogen atom, an alkyl group, an aryl group, an alkyl group or an alkenyl group; provided that at least one of A and B represents —S—;

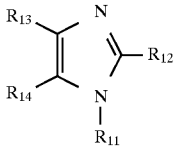

(II)

wherein $R_{11}$, $R_{12}$, $R_{13}$ and $R_{14}$ each represents a hydrogen atom, an alkyl group or an alkenyl group;

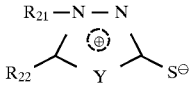

(III)

wherein $R_{21}$ and $R_{22}$ each represents an alkyl group, a cycloalkyl group, an alkenyl group, an alkynyl group, an aralkyl group, an aryl group or a heterocyclic group, provided that $R_{22}$ may represent a hydrogen atom; Y represents —O—, —S—, or —N($R_{23}$)—; $R_{23}$ represents an alkyl group, a cycloalkynyl group, an alkenyl group, an alkynyl group, an aryl group, a heterocyclic group, an amino group, an acylamino group, a sulfonamide group, a ureido group or a sulfamoylamino group; and $R_{21}$ and $R_{22}$, or $R_{22}$ and $R_{23}$ may be combined with each other to form a ring;

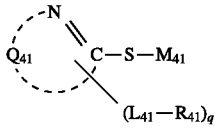

(IV)

wherein $Q_{41}$ represents a nonmetallic atom group necessary for forming a 5- or 6-membered heterocyclic ring, provided that the heterocyclic ring may be condensed with a carboaromatic ring or a heteroaromatic ring; $L_{41}$ represents a single bond, a divalent aliphatic group, a divalent aromatic hydrocarbon group, a divalent heterocyclic group or a linking groups comprising a combination of these; $R_{41}$ represents a carboxylic acid or a salt thereof, a sulfonic acid or a salt thereof, a phosphonic acid or a salt thereof, an amino group or an ammonium salt; q represents an integer of from 1 to 3; and $M_{41}$ represents a hydrogen atom or a cation;

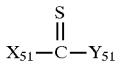

(V)

wherein $X_{51}$ and Y51 each represents an aliphatic group, an aromatic hydrocarbon group, a heterocyclic group, —N($R_{51}$)$R_{52}$, —N($R_{53}$)N($R_{54}$)$R_{55}$, —$OR_{56}$ or —$SR_{57}$; $X_{51}$ and $Y_{52}$ may form a ring exclusive of an enolic form, provided that at least one of $X_{51}$ and $Y_{51}$ is substituted by at least one of a carboxylic acid or a salt thereof, a sulfonic acid or a salt thereof, a phosphonic acid or a salt thereof, an amino group, an ammonium group and a hydroxyl group; $R_{51}$, $R_{52}$, $R_{53}$, $R_{54}$ and $R_{55}$ each represents a hydrogen atom, an aliphatic group, an aromatic hydrocarbon group or a heterocyclic group; and $R_{56}$ and $R_{57}$ each represents a hydrogen atom, a cation, an aliphatic group, an aromatic hydrocarbon group or a heterocyclic group.

In the present specification, the aliphatic group, the aromatic hydrocarbon group and the heterocyclic group each means the following unless otherwise specified.

The aliphatic group includes a substituted or unsubstituted, linear, branched or cyclic alkyl group; a substituted or unsubstituted alkenyl group; and a substituted or unsubstituted alkynyl group. The divalent aliphatic group is a divalent group of these aliphatic groups and includes a substituted or unsubstituted, linear, branched or cyclic alkylene group; a substituted or unsubstituted alkenylene group; and a substituted or unsubstituted alkynylene group. Specific examples of the aliphatic group include a methyl group, an ethyl group, a propyl group, a butyl group, an isopropyl group, a 2-hydroxypropyl group, a hexyl group, an octyl group, a vinyl group, a propenyl group, a butenyl group, a benzyl group and a phenethyl group.

The aromatic hydrocarbon group includes a substituted or unsubstituted aryl group which may be monocyclic or may form a condensed ring further with an aromatic ring or a heterocyclic ring. The divalent aromatic hydrocarbon group includes a substituted or unsubstituted arylene group which may be monocyclic or may form a condensed ring further with an aromatic ring or a heterocyclic ring. Specific examples of the aromatic hydrocarbon group include a phenyl group, a 2-chlorophenyl group, a 3-methoxyphenyl group and a naphthyl group.

The heterocyclic group includes 3- to 10-membered saturated or unsaturated, substituted or unsubstituted heterocyclic group containing at least one of a nitrogen atom, an oxygen atom and a sulfur atom as a hetero atom, which may be monocyclic or may form a condensed ring further with an aromatic ring or a heterocyclic ring. Specific examples of the heterocyclic ring include a pyrrole ring, an imidazole ring, a pyrazole ring, a pyridine ring, a pyrazine ring, a pyrimidine ring, a triazole ring, a thiadiazole ring, an oxadiazole ring, a quinoxaline ring, a tetrazole ring, a thiazole ring and an oxazole ring.

Each group in the present specification may be substituted unless otherwise specified, and examples of the substituent which the groups may have include an alkyl group, an aralkyl group, an alkenyl group, an alkynyl group, an alkoxy group, an aryl group, an amino group, an acylamino group, a sulfonamide group, a ureido group, a urethane group, an aryloxy group, a sulfamoyl group, a carbamoyl group, an alkylthio group, an arylthio group, a sulfonyl group, a sulfinyl group, an acyl group, a hydroxy group, a halogen atom, a cyano group, a sulfo group, a carboxy group, a phosphono group, an aryloxycarbonyl group, an alkoxycarbonyl group, an acyloxy group, a nitro group, a hydroxamic acid group and a heterocyclic group.

(2) A silver halide color photographic material as described in item (1) above, wherein the red-sensitive silver halide emulsion layer contains a silver halide emulsion having an average silver iodide content of from 0.1 to 10 mol %.

(3) A silver halide color photographic material as described in item (1) above, wherein the silver halide emulsion has an average silver iodide content of from 0.5 to 5.0 mol %.

(4) A silver halide color photographic material as described in item (2) above, wherein the silver halide emulsion has an average aspect ratio of from 5 to 10.

(5) A silver halide color photographic material as described in any one of items (2) to (4) above, wherein the red-sensitive silver halide emulsion layer comprises three layers including high-sensitivity, medium-sensitivity and low-sensitivity silver halide emulsion layers and the medium-sensitivity red-sensitive silver halide emulsion layer contains said silver halide emulsion described in items (2) to (4).

(6) A silver halide color photographic material as described in any one of items (1) to (5) above, wherein a transparent magnetic recording layer is provided on said support on the side opposite to the silver halide emulsion layers.

(7) A silver halide color photographic material as described in any one of items (1) to (6) above, wherein Development Processings A and B are the following Development, Processings A' and B', respectively:

(Development Processing A')

the color developing time is from 3 minutes to 3 minutes and 15 seconds, the temperature of the color developer is from 37° to 39° C. and the color development uses a color developer containing from 15 to 20 mmol/l of 2-methyl-4-[N-ethyl-N-(β-hydroxyethyl)amino]aniline as a color developing agent and containing substantially no silver halide solvent;

(Development Processing B')

the color developing time is from 50 to 70 seconds, the temperature of the color developer is from 43° to 47° C. and the color development uses a color developer containing from 35 to 40 mmol/l of 2-methyl-4-[N-ethyl-N-(β-hydroxyethyl)-amino]aniline as a color developing agent and from 0.8 to 3 mmol/l of the following silver halide solvent (III-3):

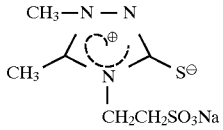

(III-3)

which may be represented by the following limiting structural formula:

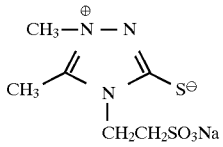

(8) A method for forming a color image comprising processing a silver halide color photographic material described in any one of items (1) to (7) above according to Development Processing A or Development Processing B described in item (1) above to form a color image.

DETAILED DESCRIPTION OF THE INVENTION

The light-sensitive material of the present invention may suffice if it comprises at least one blue-sensitive silver halide emulsion layer, at least one green-sensitive silver halide emulsion layer and at least one red-sensitive silver halide emulsion layer on the support and there is no particular limitation on the number of silver halide emulsion layers and light-insensitive emulsion layers. A typical example is a silver halide photographic light-sensitive material comprising a support having thereon at least two spectral sensitive layers each including a plurality of silver halide emulsion layers having substantially the same spectral sensitivity but having different light sensitivities, the light-sensitive layer being a unit light-sensitive layer having spectral sensitivity to one of blue light, green light and red light. In the case of a multi-layer silver halide color photographic material, the unit light-sensitive layers are arranged such that a red-sensitive unit layer, a green-sensitive unit layer and a blue-sensitive unit layer are provided in this order from the support side. The entire hydrophilic colloid layers including these spectral sensitive emulsion layers are called a "light-sensitive layer".

The maximum spectral sensitivity wavelength of each layer is preferably, for example, from 420 to 480 nm for the blue-sensitive layer, from 520 to 580 nm for the green-sensitive layer and from 520 to 580 nm for the red-sensitive layer.

A light-insensitive layer such as an interlayer of respective layers may be provided between the above-described silver halide light-sensitive layers, at an uppermost layer or at a lowermost layer.

The interlayer may contain a coupler or a DIR compound described in JP-A-61-43748, JP-A-59-113438, JP-A-59-113440, JP-A-61-20037 and JP-A-61-20038 or may contain a color mixing inhibitor as usually used.

A plurality of silver halide emulsion layers constituting each unit light-sensitive layer may preferably have a two-layer structure including a high-sensitivity emulsion layer and a low-sensitivity emulsion layer as described in West German Patent No. 1,121,470 and British Patent 923,045. The layers are usually provided so that the light sensitivity lowers successively towards the support, and a light-insensitive layer may also be provided between respective silver halide emulsion layers. Further, the low-sensitivity emulsion layer and the high-sensitivity emulsion layer may be provided farther from the support and closer to the support, respectively, as described in JP-A-57-112751, JP-A-62-200350, JP-A-62-206541 and JP-A-62-206543.

Specific examples of the layer arrangement include an order, from the farthest side of the support, of a low-sensitivity blue-sensitive layer (BL)/high-sensitivity blue-sensitive layer (BH)/a high-sensitivity green-sensitive layer (GH)/a low-sensitivity green-sensitive layer (GL)/a high-sensitivity red-sensitive layer (RH)/a low-sensitivity red-sensitive layer (RL), an order of BH/BL/GL/GH/RH/RL and an order of BH/BL/GH/GL/RL/RH.

Another preferred example is a structure constituted by three layers different in light sensitivity described in JP-B-49-15495 (the term "JP-B" as used herein means an "examined Japanese patent publication") where a silver halide emulsion layer having the highest light sensitivity is provided as an upper layer, a silver halide emulsion layer having a light sensitivity lower than that of the upper layer as a medium layer and a silver halide emulsion layer having a light sensitivity lower than that of the medium layer as a lower layer so that the light sensitivity is lowered in sequence towards the support. In the structure constituted by three layers different in light sensitivity, an order of a medium-sensitivity emulsion layer/a high-sensitivity emulsion layer/a low-sensitivity emulsion layer from the farthest side of the support may also be used within the same spectral sensitive layer, as described in JP-A-59-202464.

In addition, an order of a high-sensitivity emulsion layer/a low-sensitivity emulsion layer/a medium-sensitivity emulsion layer or an order of a low-sensitivity emulsion layer/a medium-sensitivity emulsion layer/a high-sensitivity emulsion layer may be employed. Also in the case of four or more layer structure, the layer arrangement may be changed as described above.

In order to improve color reproducibility, a donor layer (CL) having an interlayer effect which is different in the spectral sensitivity distribution from the main light-sensitive layers such as BL, GL and RL, is preferably provided adjacent to or in the vicinity of a main light-sensitive layer as described in U.S. Pat. Nos. 4,663,271, 4,705,744 and 4,707,436, JP-A-62-160448 and JP-A-63-89850.

As mentioned above, various layer constitution and arrangement may be selected according to an object of each light-sensitive material.

In the present invention, the gradient is obtained as follows. A test light-sensitive material is wedgewise exposed to a standard white light source (a light source having an energy distribution of 4800° K of black-body radiation) and after subjecting it to a specified development processing, the cyan, magenta and yellow absorption densities are determined through red, green and blue filters, respectively, to obtain a characteristic curve. From the characteristic curve obtained, points where the cyan, magenta and yellow absorption densities to the logarithm of exposure amount (abscissa) each indicates fog+0.2, fog+0.5, fog+1.0, fog+1.5 and fog+2.0 are plotted, the points are approximated to a line by the least square, the tanθ to the angle θ from the abscissa is defined as the gradient γ of the light-sensitive material, and the gradients γ of cyan, magenta and yellow are expressed as γ(C), γ(M) and γ(Y), respectively.

In the light-sensitive material of the present invention, the cyan, magenta and yellow gradients obtained after Development Processing A of the present invention, namely, $\gamma_A(C)$, $\gamma_A(M)$ and $\gamma_A(Y)$, and those obtained after Development Processing B of the present invention, namely, $\gamma_B(C)$, $\gamma_B(M)$ and $\gamma_B(Y)$, satisfy the following conditional expressions:

$$0.8 \leqq \gamma_B(C)/\gamma_A(C) \leqq 1.2$$

$$0.8 \leqq \gamma_B(M)/\gamma_A(M) \leqq 1.2$$

$$0.8 \leqq \gamma_B(Y)/\gamma_A(Y) \leqq 1.2,$$

more preferably, $$0.9 \leqq \gamma_B(C)/\gamma_A(C) \leqq 1.1$$

$$0.9 \leqq \gamma_B(M)/\gamma_A(M) \leqq 1.1$$

$$0.9 \leqq \gamma_B(Y)/\gamma_A(Y) \leqq 1.1.$$

If these conditional expressions are not satisfied, a print obtained from a color negative film developed by at least either Development Processing A or Development Processing B has a failure in tint, and is not worth seeing in color reproduction.

In the present invention, $\gamma_A(C)$, $\gamma_A(M)$, $\gamma_A(Y)$, $\gamma_B(C)$) $\gamma_B(M)$ and $\gamma_B(Y)$ each is preferably from 0.50 to 1.00, more preferably from 0.60 to 0.90, particularly preferably from 0.65 to 0.80.

In the present invention, any commercially available color paper may be used in printing. The gradient of color paper is preferably, in terms of calorimetric density, about 2.7±0.1 (with respect to the calorimetric density, *Shashin Kogaku no Kiso -Gin'en Shashin Hen-* (Primary Study of Photographic Engineering, Chapter "Silver Salt Photography"), Nippon Shashin Gakkai (compiler), p. 387 may be referred to)

A silver halide emulsion for use in the red-sensitive emulsion layer of the present invention is described below in detail.

The silver halide emulsion of the present invention is silver iodobromide or silver iodochlorobromide, preferably silver iodobromide. The average silver iodide content is preferably from 0.1 to 10 mol %, more preferably from 0.5 to 5.0 mol %, most preferably from 1.0 to 3.0 mol %.

If the average silver iodide content is less than 0.1 mol %, satisfactory light sensitivity cannot be obtained, whereas if it exceeds 10 mol %, the development acceleration effect by the silver halide solvent is weak and if it exceeds 30 mol %, almost no effect is provided.

The silver halide grain of the present invention is preferably used in a light-sensitive material comprising a red-sensitive emulsion layer having a three-layer structure containing high-sensitivity, medium-sensitivity and low-sensitivity layers and although the silver halide grain may be used in any red-sensitive emulsion layer, it is preferably used in the medium-sensitivity layer, most preferably in the medium-sensitivity and low-sensitivity layers.

In view of development acceleration by a silver halide solvent, the silver halide grain of the present invention is preferably in the tabular form.

The aspect ratio of the tabular silver halide emulsion for use in the present invention means a ratio of diameter to thickness of a silver halide grain. The diameter indicates a diameter of a circle having the same area with the projected area of a grain when the silver halide emulsion is observed through a microscope or an electron microscope. Accordingly, an aspect ratio of 2 or more means that the diameter of the circle is 2 or more times the thickness of the grain.

The tabular silver halide grain for use in the silver halide emulsion of the present invention has a grain size of 2 or more times, preferably from 3 to 20 times, more preferably from 4 to 15 times, particularly preferably from 5 to 10 times, the grain thickness. The population of tabular silver halide grains in the projected area of all silver halide grains is 50% or more, preferably 70% or more, particularly preferably 85% or more.

The tabular silver halide grain size is from 0.02 to 20 μm, preferably from 0.3 to 10.0 μm, particularly preferably from 0.4 to 5.0 μm. The grain thickness is preferably 0.5 μm or less. The tabular silver halide grain size as used herein means a diameter of a circle having the same area with the projected area of a grain. The grain thickness is expressed by a distance between two parallel planes constituting a tabular silver halide grain.

The tabular silver halide grain in a preferred embodiment of the present invention has a grain diameter of from 0.3 to 10.0 μm, a grain thickness of 0.3 μm or less and an average (diameter/thickness) ratio of from 5 to 10. If each factor exceeds the above-described range, the light-sensitive material may be bent or tightly wound up or the photographic properties may change upon contact with a sharp-edged article. In a more preferred embodiment of silver halide emulsion, 85% or more of the entire projected area of all silver halide grains are occupied by grains having a grain diameter of from 0.4 to 5.0 μm and an average (diameter/thickness) ratio of 5 or more.

The tabular silver halide emulsion for use in the present invention is described in the report by Cugnac and Chatean; Duffin, *Photographic Emulsion Chemistry*, pp. 66–72, The Focal Press, New York (1966); and A. P. H. Trivelli and W. F. Smith (compiler), *Phot. Journal*, 80, p. 285 (1940); and it can be easily prepared by referring to the methods described in JP-A-58-113927, JP-A-58-113928 and JP-A-58-127921.

The tabular silver halide grain of the present invention may be subjected to chemical sensitization, if desired. The chemical sensitization may be conducted according to the method described, for example, in H. Frieser (compiler), *Die Grundlagen der Photographischen Prozesse mit Silberhalogeniden*, pp. 675–735, Akademische Verlagsgesellshaft (1968).

More specifically, chalcogen sensitization using a compound containing a chalcogen capable of reaction with an active gelatin or silver (e.g., thiosulfate, thioureas, mercapto compounds, rhodanines, selenoureas, phosphine selenides, phosphine tellurides); reduction sensitization using a reducing material (e.g., stannous salt, amines, hydrazine derivative, formamidinesulfinic acid, silane compound); and noble metal sensitization using a noble metal compound (e.g., gold complex salt, a complex salt of metals belonging to Group VIII of the Periodic Table; such as Pt, Ir and Pd) may be used individually or in combination.

Specific examples of the chalcogen sensitization are described in U.S. Pat. Nos. 1,574,944, 2,278,947, 2,410,689, 2,728,668 and 3,656,955; specific examples of the reduction sensitization are described in U.S. Pat. Nos. 2,419,974, 2,983,609 and 4,054,458; and specific examples of the noble metal sensitization are described in U.S. Pat. Nos. 2,399,083 and 2,448,060 and British Patent 618,061.

Particularly, in view of silver saving, the tabular silver halide grain of the present invention is preferably subjected to gold sensitization, chalcogen sensitization or a combination of these.

The tabular silver halide grain of the present invention may be subjected to spectral sensitization by a methine dye or the like, if desired. The tabular silver halide grain of the present invention is characterized by high spectral sensitivity in addition to improved sharpness described above. The dye which can be used includes a cyanine dye, a merocyanine dye, a composite cyanine dye, a composite merocyanine dye, a holopolar cyanine dye, a hemicyanine dye, a styryl dye and a hemioxonol dye. Particularly useful dyes are those belonging to a cyanine dye, a merocyanine dye and a composite merocyanine dye.

Examples of the useful sensitizing dye include those described in German Patent 929,080, U.S. Pat. Nos. 2,493,748, 2,503,776, 2,519,001, 2,912,329, 3,656,959, 3,672,897 and 4,025,349, British Patent 1,242,588 and JP-B-44-14030.

These sensitizing dyes may be used either individually or in combination and the combination of sensitizing-dyes is often used for the purpose of super-sensitization. Representative examples of the combination of sensitizing dyes are described in U.S. Pat. Nos. 2,688,545, 2,977,229, 3,397,060, 3,522,052, 3,527,641, 3,617,293, 3,628,964, 3,666,480, 3,672,898, 3,679,428, 3,814,609 and 4,026,707, British Patent 1,344,281, JP-B-43-4936, JP-B-53-12375, JP-A-52-109925 and JP-A-52-110618.

The photographic emulsion for use in the present invention may contain various compounds so as to prevent fogging or to stabilize photographic capability, during preparation, storage or photographic processing of a light-sensitive material. Specifically, a large number of compounds known as an antifoggant or a stabilizer may be added and examples thereof include azoles such as benzothiazolium salts, nitroindazoles, triazoles, benzotriazoles and benzimidazoles (in particular, nitro- or halogen-substitution product); heterocyclic mercapto compounds such as mercaptothiazoles, mercaptobenzothiazoles, mercaptobenzimidazoles, mercaptothiadiazoles, mercaptotetrazoles (in particular, 1-phenyl-5-mercaptotetrazole) and mercaptopyrimidines; the above-described heterocyclic mercapto compounds having a water-soluble group such as a carboxyl group or a sulfone group; thioketo compounds such as oxazolinethione; azaindenes such as triazaindenes and tetrazaindenes (in particular, 4-hydroxy-substituted (1,3,3a,7)tetrazaindenes); benzenethiosulfonic acids; and benzenesulfinic acids. More specific examples of these and the use method therefor are described, for example, in U.S. Pat. Nos. 3,954,474, 3,982,947 and 4,021,248 and JP-B-52-28660.

The above-described emulsion of the present invention is preferably a monodisperse emulsion.

The monodisperse emulsion as used in the present invention means an emulsion having a grain size distribution where the coefficient of variation with respect to the grain size of silver halide grains is 0.25 or less. The coefficient of variation means a value obtained by dividing a standard deviation of the grain size by an average grin size. More specifically, assuming that the grain size of individual emulsion grain is ri and the number of emulsion grains is ni, the average grain size is defined as that:

average grain size$=\Sigma rini/\Sigma ni$ and the standard deviation of the grain size is defined as that:

standard derivation$=\Sigma(ri-F)^2/\Sigma ni$ r: average grain size

The grain size of individual grains as used in the present invention means a diameter of a projected area corresponding to the area projected upon microphotographing according to a method well known in the art (usually, photographing through an electron microscope) as described in T. H. James et al, *The Theory of the Photographic Process*), 3rd ed., pp. 36–43, Macmillan (1966). The projected area-corresponding diameter of a silver halide grain is defined as the diameter of a circle having the same area with the projected area of a silver halide grain as described in the publication cited above. Accordingly, the average grain size r and the deviation thereof S of a silver halide grain having the form other than a sphere (e.g., cubic, octahedral, tetradecahedral, tabular or potato-like form) may also be obtained as described above.

The coefficient of variation with respect to the grain size of silver halide grains is 0.25 or less, preferably 0.20 or less, more preferably 0.15 or less.

The tabular silver halide emulsion of the present invention is particularly preferably a monodisperse hexagonal tabular silver halide emulsion described in JP-A-63-151628.

The hexagonal tabular silver halide grain as used herein means a grain having such a characteristic feature that the {1,1,1} face is in the hexagonal shape and the ratio of adjacent sides is 2 or less. The ratio of adjacent sides as used herein means a ratio of the length of a side having the maximum length to the length of a side having the minimum length among sides constituting the hexagon. The hexagonal tabular silver halide grain of the present invention may be somewhat rounded in its corners as long as the ratio of adjacent sides is 2 or less. When the corners are somewhat rounded, the length of a side is expressed by a distance between intersection points of a line drawn by extending the linear part of a side and a line drawn by extending the linear part of a side adjacent thereto. In respective sides constituting the hexagon of the hexagonal tabular grain of the present invention, preferably ½ or more, more preferably ⅘ or more, portion of a side is substantially linear. In the present invention, the ratio of adjacent sides is preferably from 1 to 1.5.

The hexagonal tabular silver halide emulsion of the present invention comprises a dispersion medium and silver halide grains and 50% or more, preferably 70% or more, more preferably 90% or more of the entire projected area of silver halide grains are occupied by the above-described hexagonal tabular silver halide grains.

The distribution of silver iodide in the grain may be uniform throughout the grain, the silver iodide content may be different between the inside and the surface layer of the grain, or the grain may have a so-called multiple structure where multiple layers different in the silver iodide content are present inside the grain.

The hexagonal tabular silver halide emulsion may be produced by referring to U.S. Pat. No. 4,797,354.

In preparing a monodisperse hexagonal tabular silver halide emulsion, the production process is divided into a nucleation step, an Ostwald ripening step and a grain growth step. At the time of nucleation, the pBr is kept at from 1.0 to 2.5 and the nucleation is effected under supersaturation conditions (temperature, gelatin concentration, addition rates of an aqueous silver salt solution and an aqueous alkali halide solution, pBr, iodide ion content, stirring revolution number, pH, amount of silver halide solvent, salt concentration) so that nuclei (tabular grain nuclei) having parallel twin plains can be formed as much as possible. At the time of Ostwald ripening, the temperature, the pBr, the pH, the gelatin concentration and the amount of silver halide solvent are adjusted so that grains other than tabular grain. nuclei formed at the nucleation vanish and only tabular grain nuclei are grown and converted into nuclei having good monodispersibility. At the time of grain growth, the pBr, the amount of silver ions added and the amount of halogen ions are controlled to obtain hexagonal tabular silver halide grains having a desired aspect ratio and grain size. At the time of grain growth, the addition rate of silver ions and halogen ions are preferably set to from 30 to 100% of the crystal critical growth rate.

In the above-described emulsion of the present invention, 50% by number of silver halide grains have preferably 10 or more dislocations per a grain.

An average dislocation of a grain can be observed, for example, by a direct method using a transmission type electron microscope at a low temperature described in J. F. Hamilton, *Phot. Sci. Eng.*, 11, 57 (1967) and T. Shiozawa, *J. Soc. Phot. Sci., Japan*, 35, 213 (1972). More specifically, a silver halide grain taken out from an emulsion carefully so as not to apply such a pressure as to cause generation of dislocations on the grain is placed on a mesh for observation by an electron microscope and observed according to a transmission method while laying the sample in a cool state so as to prevent any damage (e.g., print out) by the electron beams. At this time, as the thickness of the grain is thicker, the electron beams become hard to be transmitted and therefore, a high-voltage type (200 kV to the grain having a thickness of 0.25 $\mu$m) electron microscope is preferably used to effect the observation more clearly. The site and the number of dislocations on each grain can be determined by observing the grain from the direction perpendicular to the main plane on the photograph of the grain obtained as above.

In the tabular grain of the present invention, the dislocations are generated in the area extending from the side to the position at x % length of the distance between the center in the long axis direction of the tabular grain and the side thereof. The x value is preferably $10 \leqq x < 100$, more preferably $30 \leqq x < 98$, still more preferably $50 \leqq x < 95$. The shape formed by connecting the sites from which the dislocations start is nearly a similar figure of the grain form but not a complete similar figure and it is sometimes distorted. The dislocation lines are directed from the approximate center toward the side but frequently weave.

With respect to the number of dislocations of the tabular grain of the present invention, preferably, 50% by number of grains have 10 or more dislocations, more preferably, 80% by number of grains have 10 or more dislocations and, particularly preferably, 80% by number of grains have 20 or more dislocations.

Further, in the silver halide grains preferably used for the tabular silver halide grain of the present invention where 50% by number of silver halide grains have 10 or more dislocations per one grain, the relative standard deviation of silver iodide content of individual silver halide grains is preferably 30% or less, more preferably 20% or less.

The silver iodide content of individual emulsion grains can be determined, for example, by analyzing the grain composition one by one using an X-ray microanalyzer. The term "relative standard deviation of silver iodide content of individual grains" as used herein means a value obtained by dividing a standard deviation of silver iodide content resulting from measuring the silver iodide content of at least 100 emulsion grains, for example, using an X-ray analyzer by an average silver iodide content and multiplying the result by 100. Specific examples of the determination method of silver iodide content of individual emulsion grains is described in European Patent 147,868A.

If the relative standard deviation of silver iodide content of individual grains is large, the optimal point for chemical sensitization varies among individual grains and as a result, it becomes impossible to extract capabilities of all emulsion grains and also, the difference in relative standard deviation of the dislocation number among grains is liable to increase.

The correlation between the silver iodide content Yi (mol %) of individual grains and the sphere-corresponding diameter Xi (micron) of each grain may be present or absent and it is preferred that no correlation is present therebetween.

The structure regarding the halogen composition of a tabular grain may be verified by using in combination an X-ray diffraction method, an EPMA (sometimes called XMA) method (a method for detecting the silver halide composition by scanning a silver halide grain by electron beams) or an ESCA (sometimes called XPS) method (a method for separating photo-electrons coming from the grain surface upon irradiation of an X ray).

In the present invention, the term "grain surface" means the region from the surface down to the depth of about 50 A. The halogen composition in this region can be usually measured by an ESCA method. The term "inside of a grain" means the region other than the above-described surface region.

The above-described emulsion comprising tabular grains having dislocation lines can be prepared according to the method described in JP-A-63-220238 and JP-A-4-181939. The silver halide emulsion of the present invention is preferably narrow in the grain size distribution and to this effect, the method described in Japanese Patent Application No. 63-151618 where the emulsion is prepared through the nucleation-Ostwald ripening and grain growth steps may be preferably used.

However, the silver iodide content of individual grains in the emulsion is prone to be non-uniform unless it is particularly precisely controlled.

In order to render the silver iodide content of individual grains in the emulsion uniform, it is important that the grains after Ostwald ripening can be uniform in the size and form as much as possible. Further, in the growth step where an aqueous silver nitrate solution and an aqueous alkali halide solution are added by a double jet method while keeping the pAg constant in the range of from 6.0 to 10.0, the supersaturation degree of solutions which are being added is preferably higher so as to accomplish particularly uniform covering. For example, the solutions are preferably added according to the method as described, for example, in U.S. Pat. No. 4,242,445 at a relatively high supersaturation degree such that the growing rate of crystals reaches from 30 to 100% of the crystal critical growth speed.

The dislocation of a tabular grain of the present invention can controlled by providing a specific high iodide phase inside the grain. More specifically, a base grain is prepared, a high iodide phase is provided thereon and the outer periphery is covered with a phase having an iodide content lower than that of the high iodide phase. In this case, in order to render the silver iodide content of individual grains uniform, it is important to optimally select the conditions for forming the above-described high iodide phase.

The inside high iodide phase is not uniformly deposited on the plain surface of a tabular grain as a base but it is important to let the phase be present locally. The localization may be generated at any site, such as on the main plane, on the side plane, on the side or at the corner of the tabular grain. Further, the internal high iodide phase may be epitaxially coordinated selectively to such a site.

For the above-described localization, a method of adding iodide salt solely, so-called conversion method, or an epitaxial conjunction method as described, for example, in JP-A-59-133540, JP-A-58-108526 and JP-A-59-162540 may be used. In using such a method, the following conditions are effectively selected so that the silver iodide content of individual grains can be uniform. More specifically, the pAg at the time of adding iodide salts is preferably from 8.5 to 10.5, more preferably from 9.0 to 10.5, and the temperature is preferably kept at from 30° to 50° C. The addition of iodide salts are preferably made under the conditions such that the stirring is sufficient and silver salts are added in an amount of 1 mol % or more based on the total silver amount over from 30 seconds to 5 minutes.

By letting various compounds be present during the formation of silver halide precipitate, the properties of a silver halide grain can be controlled. The compound may be present initially in a reaction vessel. Or, according to a usual method, the compound may be added simultaneously with the addition of one or more salts. The properties of silver halide can be controlled by letting a compound such as copper, iridium, lead, bismuth, cadmium, zinc (for example, a chalcogen compound such as sulfur, selenium or tellurium), gold or a compound of noble metals belonging to Group VII, be present during the production of silver halide precipitate as described in U.S. Pat. Nos. 2,448,060, 2,628,167, 3,737,313 and 3,772,031, and *Research Disclosure*, Vol. 134, 13452 (June, 1975). The silver halide emulsion may undergo reduction sensitization of the inside of a grain during the precipitate formation as described in JP-B-58-1410 and Moisar et al, *Journal of Photographic Science*, Vol. 25, 1977, pp. 19–27.

In the tabular grain for use in the present invention, silver halides different in the composition may be jointed by an epitaxial conjunction or may be joined to a compound other than silver halide, such as silver rhodanide or lead oxide. These emulsion grains are disclosed, for example, in U.S. Pat. Nos. 4,094,684, 4,142,900 and 4,459,353, British Patent 2,038,792, U.S. Pat. Nos. 4,349,622, 4,395,478, 4,433,501, 4,463,087, 3,656,962 and 3,852,067, and JP-A-59-162540.

The tabular silver halide emulsion of the present invention is usually subjected to chemical sensitization.

The chemical sensitization is effected after the above-described formation of silver halide emulsion and the emulsion may be washed with water between after the formation of silver halide emulsion and before chemical sensitization.

The chemical sensitization is described in *Research Disclosure* No. 17643, page 23 (December, 1978) and ibid., page 648, right column (November, 1979) and it can be conducted at a pAg of from 5 to 10, a pH of 5 to 8 and a temperature of from 30° to 80° C. using sulfur, selenium tellurium, gold, platinum, palladium iridium or a combination of these sensitizers in plurality.

The tabular silver halide emulsion of the present invention is preferably subjected to chemical sensitization in the presence of a spectral sensitizing dye. The method of conducting chemical sensitization in the presence of a spectral sensitizing dye is described, for example, in U.S. Pat. Nos. 4,425,426 and 4,442,201, JP-A-59-9658, JP-A-61-103149 and JP-A-61-133941. The spectral sensitizing dye used to this effect may be any spectral sensitizing dye usually used in a silver halide photographic light-sensitive material. The spectral sensitizing dye is described in *Research Disclosure*, No. 17643, pp. 23–24 and ibid., No. 18716, from page 648, right column to page 649, right column. The spectral sensitizing dyes may be used individually or in combination of several kinds thereof.

The time for adding the spectral sensitizing dye may be any of before starting of chemical sensitization (e.g., during grain formation, after completion of grain formation, after water washing), during chemical sensitization or after completion of chemical sensitization, but preferably added between after the completion of grain formation and before starting of chemical sensitization, or after the completion of chemical sensitization.

The addition amount of the spectral sensitizing dye may be freely selected but preferably from 30 to 100%, more preferably from 50 to 90%, of the saturation adsorption amount.

The tabular silver halide emulsion of the present invention is usually subjected to spectral sensitization. The spectral sensitizing dye for use in the spectral sensitization is described in the above-described two *Research Disclosures*. For effecting spectral sensitization of an emulsion which is chemically sensitized in the presence of a spectral sensitizing dye as described above, the same or different dyes may or may not be further added.

The emulsion of the present invention may be used alone in the light-sensitive emulsion layer or a combination of two or more emulsions different in the average grain size may also be used. When two or more emulsions are used, they may be used in different layers but preferably used in the same light-sensitive layer as a mixture. Also, when two ore more emulsion are used, an emulsion having an average aspect ratio prescribed in the present invention and an otherwise emulsion may be used. As described above, the use of a combination of emulsions is preferred in view of gradation control, control of granularity throughout all regions of from low exposure amount region to high exposure amount region and control of color developer dependency (e.g., dependency on time and composition in developer such as color developing agent and sodium sulfite) and of pH (dependency).

The emulsion of the present invention has a relative standard deviation of silver iodide content among grains described in JP-A-60-143332 and JP-A-60-254032, of particularly preferably 20% or less.

The silver halide for use in the present invention is preferably silver iodobromide, silver iodochloride or silver iodochlorobromide having a silver iodide content of about 30 mol % or less, more preferably silver iodobromide or silver iodochlorobromide having a silver iodide content of from about 2 to about 10 mol %.

The silver halide grain in the photographic emulsion may have a regular crystal from such as cubic, octahedral or tetradecahedral, an irregular crystal form such as spherical or platy, a crystal defect such as twin plane, or a composite form of these.

The silver halide may be a fine grain having a grain size of about 0.2 $\mu$m or less or a large-sized grain having a grain size in terms of a projected area diameter up to about 10 $\mu$m, and either a polydisperse emulsion or a monodisperse emulsion may be used.

The silver halide photographic emulsion which can be used in the present invention can be prepared according to the methods described, for example, in *Research Disclosure* (hereinafter simply referred to as "RD") No. 17643, pp. 22–23 "I. Emulsion Preparation and Types" (December, 1978), ibid., No. 18716, p. 648 (November, 1979), ibid., No. 307105, pp. 863–865 (November, 1989), P. Glafkides, *Chemie et Phisique Photographique*, Paul Montel (1967), G. F. Duffin, *Photographic Emulsion Chemistry*, Focal Press (1966), and V. L. Zelikman et al., *Making and Coating Photographic Emulsion*, Focal Press (1964).

The monodisperse emulsions described in U.S. Pat. Nos. 3,574,628 and 3,655,394 and British Patent 1,413,748 are also preferably used.

The crystal structure may be homogeneous, may comprise a halogen composition different between the interior and the exterior or may be stratified. A silver halide having a different composition may be conjugated thereto by an epitaxial junction or the silver halide may be conjugated with a compound other than silver halide, such as silver rhodanate or lead oxide. Also, a mixture of grains having various crystal forms may be used.

The above-described emulsion may be a surface latent image-type emulsion forming a latent image mainly on the surface, an internal latent image-type emulsion forming a latent image inside the grain, or a type forming a latent image both on the surface of and inside the grain, however, it needs to be a negative emulsion. As one of internal latent image-type emulsions, a core/shell internal latent image-type emulsion described in JP-A-63-264740 may also be used and the preparation method of this emulsion is described in JP-A-59-133542. In this emulsion, the thickness of the shell varies depending upon the development process and the like, but it is preferably from 3 to 40 nm, more preferably from 5 to 20 nm.

The silver halide emulsion is usually subjected to physical ripening, chemical ripening and spectral sensitization before use. The additives used in these steps are described in *RD* No. 17643, *RD* No. 18716 and *RD* No. 307105 and the pertinent portions thereof are summarized in the table set forth later.

The light-sensitive material of the present invention may use a mixture of two or more kinds of emulsions different at least in one property of the light-sensitive silver halide emulsion, such as the grain size, the grain size distribution, the halogen composition, the grain shape or the sensitivity, in the same layer.

It is preferred to apply a silver halide grain of which surface is fogged described in U.S. Pat. No. 4,082,553, a silver halide grain of which inside is fogged described in U.S. Pat. No. 4,626,498 and JP-A-59-214852 or a colloidal silver to a light-sensitive silver halide emulsion layer and/or a substantially light-insensitive hydrophilic colloid layer. The term "silver halide grain of which inside or surface is fogged" as used herein means a silver halide grain which can achieve uniform (non-imagewise) development of a light-sensitive material irrespective of an unexposed area or an exposed area. The preparation method of such a grain is described in U.S. Pat. No. 4,626,498 and JP-A-59-214852.

The silver halide forming the inside nucleus of a core/shell type silver halide grain of which inside is fogged may have a different halogen composition. The silver halide for the grain of which inside or surface is fogged may be any of silver chloride, silver bromide, silver iodobromide and silver chloroiodobromide. The fogged silver halide grain has an average grain size of preferably from 0.01 to 0.75 $\mu$m, more preferably from 0.05 to 0.6 $\mu$m. The grain may have a regular form or may be a polydisperse emulsion, but it is preferably monodisperse (namely, at least 95% by weight or by number of silver halide grains having a grain size within an average grain size ±40%).

In the present invention, a light-insensitive fine grain silver halide is preferably used. The term "light-insensitive fine grain silver halide" as used herein means a silver halide fine grain which is not sensitive to light at the imagewise exposure for obtaining a dye image and substantially not developed at the development process. The light-insensitive fine grain silver halide is preferably not fogged previously.

The fine grain silver halide has a silver bromide content of from 0 to 100 mol % and may contain, if desired, silver chloride and/or silver iodide. It preferably contains from 0.5 to 10 mol % of silver iodide.

The fine grain silver halide has an average grain size (an average of circle-corresponding diameters of the projected area) of preferably from 0.01 to 0.5 $\mu$m, more preferably from 0.02 to 0.2 $\mu$m.

The fine grain silver halide can be prepared by the same method as that for the normal light-sensitive silver halide. The surface of the silver halide grain needs not be optically sensitized nor be spectrally sensitized. However, it is preferred to add a known stabilizer such as a triazole-based compound, an azaindene-based compound, a benzothiazolium-based compound, a mercapto-based compound or a zinc compound, to the fine grain silver halide in advance of the addition to a coating solution. A layer containing the fine grain silver halide grain may contain colloidal silver.

The light-sensitive material of the present invention has a coated silver amount of preferably 8.0 g/m$^2$ or less, most preferably 6.0 g/m$^2$ or less.

The photographic additives which can be used in the present invention are also described in *RDs* and the portions having description thereon are shown in the table below.

| Kinds of Additives | RD17643 (Dec. 1978) | RD18716 (Nov. 1979) | RD307105 (Nov. 1989) |
|---|---|---|---|
| 1. Chemical sensitizer | p. 23 | p. 648, right col. | p. 866 |
| 2. Sensitivity increasing agent | | p. 648, right col. | |
| 3. Spectral sensitizer, supersensitizer | pp. 23–24 | p. 648, right col.–p. 649, right col. | pp. 866–868 |
| 4. Whitening agent | p. 24 | p. 647, right col. | p. 868 |
| 5. Antifoggant, stabilizer | pp. 24–25 | p. 649, right col. | pp. 866–870 |
| 6. Light absorbent, filter dye, UV absorbent | pp. 25–26 | p. 649, right col.–p. 650, left col. | p. 873 |
| 7. Stain inhibitor | p. 25, right col. | p. 650, left to right cols. | p. 872 |
| 8. Dye image stabilizer | p. 25 | p. 650, left col. | p. 872 |
| 9. Hardening agent | p. 26 | p. 651, left col. | p. 874–875 |
| 10. Binder | p. 26 | p. 651, right col. | pp. 873–874 |
| 11. Plasticizer, lubricant | p. 27 | p. 650, right col. | p. 876 |
| 12. Coating aid, surface active agent | pp. 26–27 | p. 650, right col. | pp. 875–876 |
| 13. Antistatic agent | p. 27 | p. 650, right col. | pp. 876–877 |
| 14. Matting agent | | | pp. 878–879 |

In order to prevent the deterioration in the photographic properties due to the formaldehyde gas, a compound capable reaction with formaldehyde to fix it described in U.S. Pat. Nos. 4,411,987 and 4,435,503 is preferably added to the photographic light-sensitive material.

The light-sensitive material of the present invention preferably contains a mercapto compound described in U.S. Pat. Nos. 4,740,454 and 4,788,132, JP-A-62-18539 and JP-A-1-283551.

The light-sensitive material of the present invention preferably contains a fogging agent, a development accelerator, a silver halide solvent or a precursor thereof described in JP-A-1-106052, irrespective of the developed silver amount produced by the development processing.

The light-sensitive material of the present invention preferably contains a dye dispersed by the method described in International Patent WO88/04794 and the unexamined published Japanese patent application No. Hei. 1-502912 based on a PCT application or a dye described in EP 317308A, U.S. Pat. No. 4,420,555 and JP-A-1-259358.

Various color couplers can be used in the present invention and specific examples thereof are described in patents cited in the above-described *Research Disclosure*, No. 17643, VII-C to G and ibid., No. 307105, VII-C to G.

As the yellow coupler, those described, for example, in U.S. Pat. Nos. 3,933,501, 4,022,620, 4,326,024, 4,401,752 and 4,248,961, JP-B-58-10739, British Patents 1,425,020 and 1,476,760, U.S. Pat. Nos. 3,973,968, 4,314,023 and 4,511,649 and EP-A-249473 are preferred.

Preferred magenta couplers are 5-pyrazolone and pyrazoloazole compounds and those described in U.S. Pat. Nos. 4,310,619 and 4,351,897, European Patent 73636, U.S. Pat. Nos. 3,061,432 and 3,725,067, *Research Disclosure* No. 24220 (June, 1984), JP-A-60-33552, *Research Disclosure* No. 24230 (June, 1984), JP-A-60-43659, JP-A-61-72238, JP-A-60-35730, JP-A-55-118034, JP-A-60-185951, U.S. Pat. Nos. 4,500,630, 4,540,654 and 4,556,630 and International Patent Application WO88/04795 are particularly preferred.

The cyan coupler includes phenol and naphthol couplers and those described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011 and 4,327,173, West German Patent Application (OLS) No. 3,329,729, EP-A-121365, EP-A-249453, U.S. Pat. Nos. 3,446,622, 4,333,999, 4,775,616, 4,451,559, 4,427,767, 4,690,889, 4,254,212 and 4,296,199 and JP-A-61-42658 are preferred. In addition, pyrazoloazole couplers described in JP-A-64-553, JP-A-63-554, JP-A-64-555 and JP-A-64-556 and imidazole couplers described in U.S. Pat. No. 4,818,672 may be used.

Typical examples of the polymerized dye forming coupler are described in U.S. Pat. Nos. 3,451,820, 4,080,211, 4,367,282, 4,409,320 and 4,576,910, British Patent 2,102,137 and EP-A-341188.

As the coupler which provides a colored dye having an appropriate diffusibility, those described in U.S. Pat. No. 4,366,237, British Patent 2,125,570, European Patent 96570 and West German Patent Application (OLS) No. 3,234,533 are preferred.

As the colored coupler which corrects unnecessary absorption of the colored dye, those described in *Research Disclosure*, No. 17643, Item VII-G, ibid., No. 307105, Item VII-G, U.S. Pat. No. 4,163,670, JP-B-57-39413, U.S. Pat. Nos. 4,004,929 and 4,138,258 and British Patent 1,146,368 are preferred. Also, a coupler which releases a fluorescent dye upon coupling and corrects unnecessary absorption of the colored dye by the fluorescent dye released described in U.S. Pat. No. 4,774,181 and a coupler having as a splitting off group a dye precursor group capable of forming a dye upon reaction with a developing agent described in U.S. Pat. No. 4,777,120 are also preferably used.

Compounds which release a photographically useful residue on coupling are also preferably used in the present invention. Preferred DIR couplers which release a development inhibitor are described in patents cited in the above-described *RD* 17643, Item VII-F and ibid., No. 307105, Item VII-F, JP-A-57-151944, JP-A-57-154234, JP-A-60-184248, JP-A-63-37346, JP-A-63-37350 and U.S. Pat. Nos. 4,248,962 and 4,782,012.

As the coupler which imagewise releases a nucleating agent or a development accelerator at the development, those described in British Patents 2,097,140 and 2,131,188, JP-A-59-157638 and JP-A-59-170840 are preferred. Also, compounds which release a fogging agent, a development accelerator or a silver halide solvent upon redox reaction with an oxidation product of a developing agent described in JP-A-60-107029, JP-A-60-252340, JP-A-1-44940 and JP-A-1-45687 are preferred.

Other compounds which can be used in the photographic light-sensitive material of the present invention include competing couplers described in U.S. Pat. No. 4,130,427, polyequivalent couplers described in U.S. Pat. Nos. 4,283,472, 4,338,393 and 4,310,618, DIR redox compoundreleasing couplers, DIR coupler-releasing couplers, DIR coupler-releasing redox compounds or DIR redox-releasing redox compounds described in JP-A-60-185950 and JP-A-62-24252, couplers which release a dye capable of recovering the color after being released described in EP-A-173302 and EP-A-313308, ligand-releasing couplers described in U.S. Pat. No. 4,555,477, couplers which release a leuco dye described in JP-A-63-75747 and couplers which release a fluorescent dye described in U.S. Pat. No. 4,774,181.

The coupler for use in the present invention can be incorporated into the photographic light-sensitive material by various known dispersion methods.

Examples of the high boiling point solvent used in an oil-in-water dispersion method are described, for example, in U.S. Pat. No. 2,322,027. Specific examples of the high boiling point organic solvent having a boiling point of 175° C. or higher under normal pressure which is used in an oil-in-water dispersion method include phthalic esters (e.g., dibutyl phthalate, dicyclohexyl phthalate, di-2-ethylhexylphthalate, decyl phthalate, bis(2,4-di-tert-amylphenyl) phthalate, bis(2,4-di-tert-amylphenyl) isophthalate, bis(1,1-diethylpropyl) phthalate); phosphoric or phosphonic esters (e.g., triphenylphosphate, tricresyl phosphate, 2-ethylhexyldiphenyl phosphate, tricyclohexyl phosphate, tri-2-ethylhexylphosphate, tridodecyl phosphate, tributoxyethyl phosphate, trichloropropyl phosphate, di-2-ethylhexylphenyl phosphonate); benzoic esters (e.g., 2-ethylhexylbenzoate, dodecylbenzoate, 2-ethylhexyl-p-hydroxybenzoate); amides (e.g., N,N-diethyldodecanamido, N,N-diethyllaurylamide, N-tetradecylpyrrolidone); alcohols or phenols (e.g., isostearyl alcohol, 2,4-di-tert-amylphenol); aliphatic carboxylic esters (e.g., bis(2-ethylhexyl)sebacate, dioctyl azelate, glycerol tributyrate, isostearyl lactate, trioctyl citrate); aniline derivatives (e.g., N,N-dibutyl-2-butoxy-5-tert-octylaniline); and hydrocarbons (e.g., paraffin, dodecylbenzene, diisopropylnaphthalene). As the auxiliary solvent, for example, an organic solvent having a boiling point of about 30° C. or higher, preferably from 50° C. to about 160° C., can be used and typical examples thereof include ethyl acetate, butyl acetate, ethyl propionate, methyl ethyl ketone, cyclohexanone, 2-ethoxyethylacetate and dimethylformamido.

The process and effects of the latex dispersion method and specific examples of the latex for impregnation are described, for example, in U.S. Pat. No. 4,199,363 and West German Patent Application (OLS) Nos. 2,541,274 and 2,541,230.

The color photographic material of the present invention preferably contains various antiseptics and antimolds such as phenethyl alcohol; and 1,2-benzisothiazolin-3-one, n-butyl-p-hydroxybenzoate, phenol, 4-chloro-3,5-dimethylphenol, 2-phenoxyethanol and 2-(4-thiazolyl) benzimidazole described in JP-A-63-257474, JP-A-62-272248 and JP-A-1-80941.

Suitable supports which can be used in the present invention are described, for example, in the above-described *RD*, No. 17643, p. 28, ibid., No. 18716, from p. 647, right column to p. 648, left column, ibid., No. 307105, p. 879 and *JIII Journal of Technical Disclosure* No. 94-6023. Preferred examples of the support include a triacetate support (TAC), a polyester support and a polyethylene naphthalate support.

The swelling speed of all hydrophilic colloid layers on the side having emulsion layers of the light-sensitive material $T_{1/2}$ is preferably 30 seconds or less, more preferably 20 seconds or less. The layer thickness means a layer thickness determined under humidity conditioning (for 2 days) at 25° C. and 55% RH (relative humidity) and it is preferably from 10 to 25 $\mu$m, more preferably from 12 to 22 $\mu$m, particularly preferably from 15 to 20 $\mu$m. The swelling speed $T_{1/2}$ can be determined according to the method known in the art. For example, it can be measured using a swellometer of the type described in A. Green et al., *Photographic Science and Engineering*, Vol. 19, No. 2, pp. 124–129. $T_{1/2}$ is defined as the time required to reach a half of the saturated film thickness which corresponds to 90% of the maximum swelled layer thickness achieved in the processing with a color developer at 30° C. for 3 minutes and 15 seconds.

The swelling ratio of color photographic material of the present invention in the developer is preferably 2.3 or more, more preferably from 2.4 to 4, particularly preferably from 2.4 to 3, in view of expedited diffusion of developing agent. If it is too large, the diffusion distance becomes long and thereby the development may be retarded.

The swelling ratio in the developer as used in the present invention means a value obtained by dividing the layer thickness (layer thickness on the side having light-sensitive layers of the support) after swelling in the developer by the dry layer thickness.

The swollen layer thickness in the developer can be measured according to the method described in A. Green and G. I. P. Levenso, *J. Phot. Sci.*, 20, 205 (1972). More specifically, it can be determined from the equilibrium value of the swollen layer thickness in the developer kept at 38° C. For the developer therefor, for example, the formulation described in Examples may be used.

In the determination of the swelling ratio defined in the present invention, Developer A (the Color Developer used in Development Processing A-1 of Example 1 of the present specification) is used.

The layer swelling speed $T_{1/2}$ and the swelling ratio can be controlled by adding a hardening agent to gelatin as a binder or by changing the aging condition after coating.

In the light-sensitive material of the present invention, a hydrophilic colloid layer (called backing layer) having a total dry thickness of from 2 to 20 $\mu$m is preferably provided on the side opposite to the side having emulsion layers. The backing layer preferably contains, for example, the above-described light absorbents, filter dyes, ultraviolet absorbents, antistatic agents, hardening agents, binders, plasticizers, lubricants, coating aids or surface active agents. This backing layer has a swelling ratio of preferably from 2.5 to 6.0.

The silver halide color photographic light-sensitive material of the present invention is more ready to exert effects and is effective when it is applied to a film unit with lens described in JP-B-2-32615 and JP-U-B-3-39784 (the term "JP-U-B" as used herein means an "examined Japanese utility model publication").

The present invention can be applied to a silver halide photographic material having a transparent magnetic recording layer in the back layer thereof. Conventionally, the silver halide photographic light-sensitive material offers only the image information at the time of photographing or printing, however, as disclosed in JP-A-4-68336 and JP-A-4-73737, by providing a transparent magnetic recording layer over the entire surface of a light-sensitive material, it becomes possible to input to the light-sensitive layer date of photographing, weather, photographing conditions such as reduction/enlargement ratio, number of reprinted sheets, spot to be zoomed, message, or developing/printing conditions other than the image, and also input into a display device such as television/video becomes possible. In this case, elimination of influence by dust due to electrostatic charge, improvement in sliding property of film or erasure of bad effect of curl including the support is demanded.

The transparent magnetic recording layer for use in the present invention is descried below.

The magnetic particle for used in the present invention includes a ferromagnetic iron oxide such as $\gamma Fe_2O_3$, Co-doped $\gamma Fe_2O_3$, Co-doped magnetite, Co-containing magnetite, ferromagnetic chromium dioxide, ferromagnetic metal, ferromagnetic alloy, hexagonal Ba ferrite, Sr ferrite, Pb ferrite and Ca ferrite. Among these, Co-doped ferromagnetic iron oxide such as Co-doped $\gamma Fe_2O_3$ is preferred. The form of the magnetic particle may be any of aciculate, rice grain-like, spherical, cubic and platy forms. The specific surface area as $S_{BET}$ is preferably 20 $m^2/g$ or more, more preferably 30 $m^2/g$ or more. The saturation magnetization ($\sigma s$) of the ferromagnetic material is preferably from 400 to 3,000 Oe, more preferably from 600 to 3,000 Oe. The ferromagnetic particle may be subjected to surface treatment with silica and/or alumina or an organic material. Further, the ferromagnetic particle may be subjected to surface treatment with a silane coupling agent or a titanium coupling agent as described in JP-A-6-161032. Also, a magnetic material having coated on the surface thereof an inorganic or organic material described in JP-A-4-259911 and JP-A-5-81652 may be used.

The binder for use in the magnetic particle includes a thermoplastic resin, a thermosetting resin, a radiation-curable resin, a reactive resin, an acid, alkali or biodegradable polymer, a natural polymer (e.g., cellulose derivative, saccharide derivative) and a mixture of these described in JP-A-4-219569. The above-described resin has a Tg of from −40° C. to 300° C. and a weight average molecular weight of from 2,000 to 1,000,000. Examples of the resin include a vinyl copolymer, a cellulose derivative such as cellulose diacetate, cellulose triacetate, cellulose acetate propionate, cellulose acetate butyrate and cellulose tripropionate, an acrylic resin and a polyvinyl acetal resin, and gelatin is also preferably used. Among these, cellulose di(tri)acetate is preferred. The binder may be subjected to curing treatment by adding thereto an epoxy-based, aziridine-based or isocyanate-based crosslinking agent. Examples of the isocyanate-based crosslinking agent includes isocyanates such as tolylenediisocyanate, 4,4'-diphenylmethanediisocyanate, hexamethylenediisocyanate and xylylenediisocyanate, a reaction products of these isocyanates with polyalcohol (e.g., a reaction product of 3 mol of tolylenediisocyanate with 1 mol of trimethylol propane) and a polyisocyanate produced by the condensation of these isocyanates, which is described, for example, in JP-A-6-59357.

The ferromagnetic material is dispersed into the binder by the method preferably using a kneader, a pin-type mill or an annular-type mill as described in JP-A-6-35092 and these may also be preferably used in combination. The dispersant described in JP-A-5-088283 and other known dipersants may be used. The thickness of the magnetic recording layer is from 0.1 to 10$\mu$, preferably from 0.2 to 5$\mu$, more preferably from 0.3 to 3$\mu$. The weight ratio of the magnetic particle to the binder is preferably from 0.5:100 to 60:100, more preferably from 1:100 to 30:100. The coating amount in terms of magnetic substance is from 0.005 to 3 $g/m^2$, preferably from 0.01 to 2 $g/m^2$, more preferably from 0.02 to 0.5 $g/m^2$. The magnetic recording layer for use in the present invention may be provided throughout the entire surface or stripe-like on the back surface of the photographic support by coating or printing. The coating of the magnetic recording layer can use air doctor, blade, air knife, squeeze, soak, reverse roller, transfer roller, gravure, kiss, cast, spray, dip, bar or extrusion, and the coating solution described in JP-A-5-341436 is preferred.

The magnetic recording layer may be caused to have additionally such a function as improvement of lubricity, control of curl, electrostatic charge prevention, prevention of adhesion or head abrasion, or other functional layers may be provided to undertake such a function. At least one or more of particles is preferably an abrasive as an aspheric inorganic particle having a Mhos' hardness of 5 or more. The composition of the aspheric inorganic particle is preferably an oxide such as aluminum oxide, chromium oxide, silicon dioxide, titanium dioxide or silicone carbide, a carbide such as silicon carbide or titanium carbide, or fine particle such as diamond. The abrasive may be subjected to surface treatment with a silane coupling agent or a titanium coupling agent. The particle may be added to a magnetic recording layer or may be overcoated on the magnetic recording layer (for example, as protective layer or a lubricant layer). The binder used here may be those described above for the binder of a magnetic recording layer and it is preferably the same as the binder in the magnetic recording layer. The light-sensitive material having a magnetic recording layer is described in U.S. Pat. Nos. 5,336,589, 3,250,404, 5,229,259 and 5,215,874 and EP466,130.

The polyester support for use in the present invention is described below. The details thereon including the light-sensitive material, the processing, the cartridge and the experimental examples are described in *JIII Journal of Technical Disclosure* No. 94-6023 (Mar. 15, 1994). The polyester for use in the present invention is formed using diol and an aromatic dicarboxylic acid as essential components. Examples of the aromatic dicarboxylic acid include 2,6-naphthalene dicarboxylic acid, a terephthalic acid, isophthalic acid, orthophthalic acid and examples of the diol include (poly)ethylene glycol, cyclohexanedimethanol, bisphenol A and biphenol. The polymer includes a homopolymer such as polyethylene terephthalate, polyethylene naphthalate and polycyclohexanedimethanol terephthalate. Among these, preferred is a polyester containing from 10 to 100 mol % of 2,6-naphthalenedicarboxylic acid. Particularly preferred is polyethylene 2,6-naphthalene. The average molecular weight of the polyester is approximately from 5,000 to 200,000. The polyester of the present invention has a Tg of 50° C. or higher, more preferably 90° C. or higher.

The polyester support is subjected to heat treatment to have an aversion to curling habit at a heat treatment temperature of from 40° C. to less than Tg, more preferably from (Tg−20° C.) to less than Tg. The heat treatment may be conducted either at a constant temperature within the above-described range or while cooling. The heat treatment temperature is from 0.1 to 1,500 hours, more preferably from 0.5 to 200 hours. The support may be subjected to heat treatment either in a state of roll or as a web on the way of conveyance. The surface may be made uneven (for example, by coating electrically conductive inorganic fine particles such as $SnO_2$ or $Sb_2O_5$)) to improve the surface state. Also, it is preferred to make some designs such that the edge is knurled to slightly increase the height only of the edge, thereby preventing the cut copy at the core portion. The heat treatment may be conducted at any stage, such as after formation of support film, after surface treatment, after coating of a back layer (e.g., antistatic agent, slipping agent), or after coating of undercoat layer. The preferred stage is after coating of an antistatic agent.

Into the polyester, an ultraviolet absorbent may be kneaded in. Or, for preventing light piping, a commercially available dye for polyester, such as Diaresin produced by Mitsubishi Chemicals Industries, Ltd. or Kayaset produced by Nippon Kayaku K.K., may be mixed so as to attain the object.

In the present invention, the surface treatment is preferred so that the support can be bonded to the light-sensitive constituent layer. Examples of the surface treatment include chemical treatment, mechanical treatment, corona discharge treatment, flame treatment, ultraviolet light treatment and high frequency treatment. Among these surface treatments, preferred are ultraviolet irradiation treatment, flame treatment, corona treatment and glow treatment.

The undercoating method is described below. The undercoating may be mono layer coating or superposed layer coating of two or more layers. The binder for the undercoat layer includes a copolymer starting from a monomer selected from vinyl chloride, vinylidene chloride, butadiene, methacrylic acid, acrylic acid, itaconic acid and maleic anhydride, and in addition, polyethyleneimine, epoxy resin, grafted gelatin, nitrocellulose and gelatin. The compound which expands the support include resorcin and p-chlorophenol. The undercoat layer may contain a gelatin hardening agent and examples thereof include chromic salts (e.g., chrome alum), aldehydes (e.g., formaldehyde, glutaraldehyde), isocyanates, active halogen compounds (e.g., 2,4-dichloro-6-hydroxy-S-triazine), epichlorohydrin resins and active vinyl sulfone compounds. Further, the undercoat layer may contain an inorganic fine particle such as $SiO_2$, $TiO_2$ or a matting agent or a polymethyl methacrylate copolymer fine particle (0.01 to 10 $\mu$m) as a matting agent.

Further, in the present invention, an antistatic agent is preferably used. Examples of the antistatic agent include a high polymer containing a carboxylic acid, a carboxylate or a sulfonate, a cationic high polymer and an ionic surface active agent compound.

Most preferred antistatic agents are a fine particle of at least one crystalline metal oxide having a volume resistivity of $10^7$ Ω-cm or less, more preferably $10^5$ Ω-cm or less and a particle size of from 0.001 to 1.0 $\mu$m, selected from ZnO, $TiO_2$, $SnO_2$, $Al_2O_3$, $In_2O_3$, $SiO_2$, MgO, BaO, $MoO_3$ and $V_2O_5$ or of a composite oxide of these (e.g., Sb, P, B, In, S, Si, C) and a fine particle of a sol-like metal oxide or of a composite oxide of these.

The content of the antistatic agent in the light-sensitive material is preferably from 5 to 500 mg/m$^2$, more preferably from 10 to 350 mg/m$^2$. The weight ratio of the electrically conductive crystalline oxide or a composite oxide thereof to the binder is preferably from 1/300 to 100/1, more preferably from 1/100 to 100/5.

The light-sensitive material of the present invention preferably has a slipperiness. The slipperiness is preferably present on both of the light-sensitive layer surface and the back surface. The preferred slipperiness is in terms of a coefficient of dynamic friction, from 0.01 to 0.25. The value is determined using a stainless steel ball having a diameter of 5 mm by transporting the light-sensitive material at a speed of 60 cm/min (25° C., 60% RH). In this evaluation, even when the other party is changed to the light-sensitive layer surface, the value almost on the same level is obtained.

The slipping agent which can be used in the present invention includes polyorganosiloxane, a higher fatty acid amide, a higher fatty acid metal salt and an ester of a higher fatty acid with a higher alcohol. Examples of the polyoxysiloxane include generally known polydimethylsiloxane, polydimethylsiloxane, polystyrylmethylsiloxane and polymethylphenylsiloxane. The layer to be added is preferably an outermost layer of the emulsion layer or a back layer. In particular, polydimethylsiloxane and an ester having a long chain alkyl group are preferred.

The light-sensitive material of the present invention preferably contains a matting agent. The matting agent may be used either on the emulsion surface or back surface, but it is particularly preferred to add the outermost layer on the emulsion layer side. The matting agent may be either a compound capable of dissolving by the processing or a processing-soluble matting agent, and preferably, both of these are used at the same time. For example, polymethyl methacrylate, poly(methyl methacrylate/methacrylic acid=9/1 or 5/5 (by mole)) and polystyrene particles are preferred. The particle size is preferably from 0.8 to 10 $\mu$m, the particle size distribution is preferably narrower, and 90% by number or more of all particles has a size between 0.9 and 1.1 times the average particle size. In order to increase the matting property, fine particles of 0.8 $\mu$m or less are preferably added at the same time and examples thereof include polymethyl methacrylate (0.2 $\mu$m), poly(methyl methacrylate/methacrylic acid=9/1 (by mol), 0.3 $\mu$m), polystyrene particles (0.25 $\mu$m) and colloidal silica (0.03 $\mu$m).

The film patrone for use in the present invention is described. The patrone for use in the present invention may be made of a metal or uses a synthetic plastic as a main material.

Preferred plastic materials are polystyrene, polyethylene, polypropylene and polyphenyl ether. The patrone of the present invention may further contain various antistatic agents and preferred examples thereof include carbon black, a metal oxide particle, a nonionic, anionic, cationic or betaine surface active agent and a polymer. The patrone imparted with the antistatic property using these is described in JP-A-1-312537 and JP-A-1-312538. In particular, the resistance at 25° C. and 25% RH is preferably $10^{12}$ Ω or less. Usually, the patrone is produced using a plastic having kneaded therein carbon black or a pigment so as to give light-shielding property. The patrone may have a currently used size but if the cartridge size is reduced from 25 m/m currently populated to 22 m/m or less, it is effective to achieve down-sizing. the volume of the patrone case is preferably 30 cm$^3$ or less, more preferably 25 cm$^3$ or less. The weight of plastics used in the patrone and the patrone case is preferably from 5 to 15 g.

The patrone for use in the present invention may be a patrone which sends forth the film by the rotation of a spool. Also, the patrone may have such a structure that a film leading end is housed in the patrone body and the film leading end is sent forth from the port part of the patrone towards the outside by rotating the spool shaft in the film delivery direction. These are disclosed in U.S. Pat. No. 4,834,306 (corresponding to JP-A-1-306845) and JP-A-4-115251 (corresponding to U.S. Pat. No. 5,226,613). The photographic film for use in the present invention may be a so-called green film before development or a developed photographic film. Also, a green film and a developed photographic film may be housed in the same new patrone or in different patroness.

The silver halide solvent for use in Development Processing B of the present invention is described below in detail.

The silver halide solvent of the present invention includes a thiosulfate such as sodium thiosulfate, potassium thiosulfate and ammonium thiosulfate, methanesulfonate such as sodium methanethiosulfonate, potassium methanethiosulfonate and ammonium methanethiosulfonate, a thiocyanate (rhodanate) such as sodium thiocyanate, potassium thiocyanate and ammonium thiocyanate and compounds represented by formulae (I) to (V).

Formula (I) is described below in detail. $L_1$ and $L_3$ each represents a substituted or unsubstituted alkyl group having from 1 to 10 carbon atoms (e.g., methyl, ethyl, propyl, hexyl, isopropyl, carboxyethyl), a substituted or unsubstituted aryl group having from 6 to 12 carbon atoms (e.g., phenyl, 4-methylphenyl, 3-methoxyphenyl), a substituted or unsubstituted aralkyl group having from 7 to 12 carbon atoms (e.g., benzyl, phenethyl), a substituted or unsubstituted alkenyl group having from 2 to 10 carbon atoms (e.g., vinyl, propenyl, 1-methylvinyl) or a substituted or unsubstituted heterocyclic group having from 1 to 10 carbon atoms (e.g., pyridyl, furyl, thienyl, imidazolyl); $L_2$ represents a substituted or unsubstituted alkylene group having from 1 to 10 carbon atoms (e.g., methylene, ethylene, trimethylene, tetramethylene, pentamethylene, hexamethylene, 1-methylethylene, 1-hydroxytrimethylene), a substituted or unsubstituted arylene group having from 6 to 12 carbon atoms (e.g., phenylene, naphthylene), a substituted or unsubstituted aralkylene group having from 7 to 12 carbon atoms (e.g., 1,2-xylylene), a substituted or unsubstituted heterocyclic linking group having from 1 to 10 carbon atoms (e.g.,

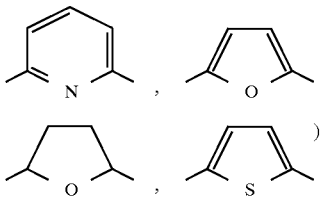

or a linking group comprising a combination of these (e.g.,

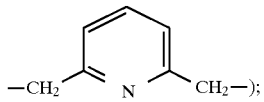

A and B each represents —S—, —O—, —NR—, —CO—, —CS—, $—SO_2—$ or a group comprising any combination of these and examples of the group comprising the combination includes $—CONR_1—$, $—NR(R_2)CO—$, $—N(R_3)CON(R_4)—$, —COO—, —OCO—, $—SO_2NR_5—$, $—N(R_6)SO_2—$, $—CSNR_7—$, $—N(R_3)CS—$ and $—N(R_9)CSN(R_{10})—$; and n represents an integer of from 1 to 10, provided that at least one of $L_1$ and $L_3$ is substituted by a —COOM group, an —OM group or an $—SO_3M$ group, wherein M represents a hydrogen atom or a counter cation (e.g., an alkali metal atom such as sodium and potassium, an alkaline earth metal such as magnesium and calcium, an ammonium group such as ammonium and triethylammonium).

R, $R_1$, $R_2$, $R_3$, $R_4$, $R_5$, $R_6$, $R_7$, $R_8$, $R_9$ and $R_{10}$ each represents a hydrogen atom, a substituted or unsubstituted alkyl group having from 1 to 10 carbon atoms (e.g., methyl, ethyl, propyl, hexyl, isopropyl), a substituted or unsubstituted aryl group having from 6 to 1 2 carbon atoms (e.g., phenyl, 4-methylphenyl, 3-methoxyphenyl), a substituted or unsubstituted aralkyl group having from 7 to 12 carbon atoms (e.g., benzyl, phenethyl) or a substituted or unsubstituted alkenyl group having from 2 to 10 carbon atoms (e.g., vinyl, propenyl, 1-methylvinyl). When $L_1$, $L_2$, $L_3$, R, $R_1$, $R_2$, $R_3$, $R_4$, $R_5$, $R_6$, $R_7$, $R_8$, $R_9$ and $R_{10}$ each has a substituent, examples of the substituent include a lower alkyl group having from 1 to 4 carbon atoms (e.g., methyl, ethyl), an aryl group having from 6 to 10 carbon atoms (e.g., phenyl, 4-methylphenyl), an aralkyl group having from 7 to 10 carbon atoms (e.g., benzyl), an alkenyl group having from 2 to 4 carbon atoms (e.g., propenyl), an alkoxy group having from 1 to 4 carbon toms (e.g., methoxy, ethoxy), a halogen atom (e.g., chlorine, bromine), a cyano group, a nitro group, a carboxylic acid group (or a salt thereof), a hydroxy group, a sulfonic acid group, an amino group (e.g., unsubstituted amino, dimethylamino) and an ammonium group (e.g., trimethylammonium). When n is 2 or more, A and $L_2$ each may be any combination of the above-described groups. At least one of A and B represents —S—.

In a preferred embodiment of formula (I), $L_1$ and $L_3$ each represents an alkyl group having from 1 to 6 carbon atoms substituted by a —COOM group, an —OM group, an $—SO_3M$ group; $L_2$ represents an alkylene group having from 1 to 6 carbon atoms; A and B each represents —S—, —O— or —NR—, wherein R represents a hydrogen atom or an alkyl group having from 1 to 6 carbon atoms; and n represents an integer of from 1 to 6. In a more preferred embodiment of formula (I), A and B each represents —S— and n represents an integer of from 1 to 3. Specific examples of the compound represented by formula (I) are described below, but the compound of the present invention is by no means limited thereto.

$HOOC(CH_2)_2S(CH_2)_2S(CH_2)_2COOH$ I-1

$HOOC(CH_2)_2(SCH_2CH_2)_2S(CH_2)_2COOH$ I-2

$HOOC(CH_2)_2(SCH_2CH_2)_3S(CH_2)_2COOH$ I-3

$HOOC(CH_2)_3S(CH_2)_2S(CH_2)_3COOH$ I-4

$HOOC(CH_2)_3(SCH_2CH_2)_2S(CH_2)_3COOH$ I-5

$HOOC(CH_2)_3(SCH_2CH_2)_3S(CH_2)_3COOH$ I-6

$HOOCCH_2S(CH_2)_2SCH_2COOH$ I-7

$HOOCCH_2(SCH_2CH_2)_2SCH_2COOH$ I-8

$HOOCCH_2(SCH_2CH_2)_3SCH_2SO_3Na$ I-9

$HOOC(CH_2)_2S(CH_2)_3S(CH_2)_2COOH$ I-10

$HOOCCH_2SCH_2CH_2S(CH_2)_2SO_3Na$ I-11

$NaOOC(CH_2)_2S(CH_2)_2S(CH_2)_2COONa$ I-12

$HO(CH_2)_2S(CH_2)_2S(CH_2)_2OH$ I-13

$HOOCCH_2S(CH_2)_2O(CH_2)_2SCH_2COOH$ I-14

$HOOC(CH_2)_2S(CH_2)_2N(CH_3)(CH_2)_2S(CH_2)_2COOH$ I-15

$HOOCCH_2S(CH_2)_2N(CH_2COOH)(CH_2)_2SCH_2COOH$ I-16

$NaO_3S(CH_2)_2S(CH_2)_2S(CH_2)_2SO_3Na$ I-17

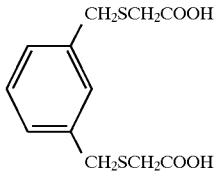

I-18

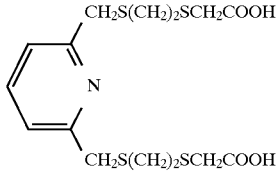

I-19

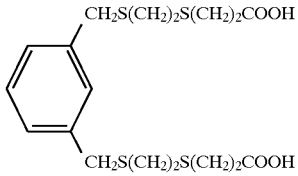

I-20

-continued

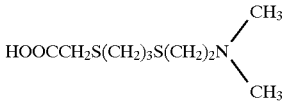

I-21

$HOOCCH_2S(CH_2)_2CONH(CH_2)_2NHCO(CH_2)_2SCH_3COOH$ I-22

$HOOC(CH_2)_5\text{-}(SCH_2CH_2)_2\text{-}S(CH_2)_5COOH$ I-23

$HOOC(CH_2)_2S(CH_2)_2NHC(=S)NH(CH_2)_2S(CH_2)_2COOH$ I-24

Among the above-described compounds, preferred are Compounds (I-1), (I-2), (I-7), (I-11), (I-13) and (I-17) and more preferred are Compounds (I-1) and (I-17).

The compound represented by formula (I) of the present invention can be easily synthesized by referring to *J. Org. Chem.*, 30, 2867 (1965), ibid., 27, 2846 (1962), and *J. Am. Chem. Soc.*, 69, 2330 (1947).

Formula (II) is described below in detail.

In formula (II), $R_{11}$, $R_{12}$, $R_{13}$ and $R_{14}$ each represents a hydrogen atom, an alkyl group or an alkenyl group.

The alkyl group includes an alkyl group having a substituent such as a hydroxyl group, a carboxyl group, a sulfo group, an amino group or a nitro group and has preferably from 1 to 5 carbon atoms, more preferably 1 or 2 carbon atoms.

The alkenyl group includes an alkenyl group having the above-described substituent and has preferably from 2 to 5 carbon atoms, more preferably 2 or 3 carbon atoms.

In a preferred embodiment of the present invention, $R_{11}$, $R_{12}$, $R_{13}$ and $R_{14}$ each is a substituted or unsubstituted alkyl group having 1 or 2 carbon atoms, in a more preferred embodiment, $R_{11}$ is a substituted alkyl group. Examples of the substituent includes a hydroxyl group, a carboxyl group and a sulfo group, and among these, preferred are a carboxyl group and a sulfo group.

Specific examples of the compound represented by formula (II) are described below, but the compound of formula (II) is by no means limited thereto.

(II-1) Imidazole
(II-2) 1-Methylimidazole
(II-3) 2-Methylimidazole
(II-4) 4-Methylimidazole
(II-5) 4-Hydroxymethylimidazole
(II-6) 1-Ethylimidazole
(II-7) 1-Vinylimidazole
(II-8) 4-Aminomethylimidazole
(II-9) 2,4-Dimethylimidazole
(II-10) 2,4,5-Trimethylimidazole
(II-11) 2-Aminoethylimidazole
(II-12) 2-Nitroethylimidazole
(II-13) 1-Carboxymethyl-2-methylimidazole
(II-14) 1-Carboxymethyl-2,4-dimethylimidazole
(II-15) 1-Carboxyethyl-2-methyl-4-β-hydroxyethylimidazole
(II-16) 1-Sulfoethyl-2-methylimidazole
(II-17) 1-Sulfoethyl-2,4-dimethylimidazole
(II-18) 1-Sulfomethyl-4,5-dimethylimidazole
(II-19) 1-Sulfomethyl-2,5-dimethylimidazole
(II-20) 1-Sulfoethylimidazole Among the above-described compounds, preferred are Compounds (II-1), (II-13) to (II-20) and more preferred are Compounds (II-13), (II-14), (II-16), (II-17) and (II-20).

Formula (III) is described below in detail.

In formula (III), $R_{21}$ and $R_{22}$ each represents a substituted or unsubstituted alkyl group (e.g., methyl, ethyl, n-propyl, t-butyl, methoxyethyl, methylthioethyl, dimethylaminoethyl, morpholinoethyl, dimethylaminoethylthioethyl, diethylaminoethyl, aminoethyl, methylthiomethyl, trimethylammonioethyl, carboxymethyl, carboxyethyl, carboxypropyl, sulfoethyl, sulfomethyl, phosphonomethyl, phosphonoethyl), a substituted or unsubstituted cycloalkyl group (e.g., cyclohexyl, cyclopentyl, 2-methylcyclohexyl), a substituted or unsubstituted alkenyl group (e.g., allyl, 2-methylallyl), a substituted or unsubstituted alkenyl group (e.g., propargyl), a substituted or unsubstituted aralkyl group (e.g., benzyl, phenethyl, 4-methoxybenzyl), an aryl group (e.g., phenyl, naphthyl, 4-methylphenyl, 4-methoxyphenyl, 4-carboxyphenyl, 4-sulfophenyl) or a substituted or unsubstituted heterocyclic group (e.g., 2-pyridyl, 3-pyridyl, 4-pyridyl, 2-thienyl, 1-pyrazolyl, 1-imidazolyl, 2-tetrahydrofuryl), provided that $R_{22}$ may be a hydrogen atom;

Y represents —O—, —S— or —N($R_{23}$)—, wherein $R_{23}$ represents a substituted or unsubstituted alkyl group (e.g., methyl, ethyl, n-propyl, t-butyl, methoxyethyl, methylthioethyl, dimethylaminoethyl, morpholinoethyl, dimethylaminoethylthioethyl, diethylaminoethyl, aminoethyl, methylthiomethyl, trimethylammonioethyl, carboxymethyl, carboxyethyl, carboxypropyl, sulfoethyl, sulfomethyl, phosphonomethyl, phosphonoethyl), a substituted or unsubstituted cycloalkyl group (e.g., cyclohexyl, cyclopentyl, 2-methylcyclohexyl), a substituted or unsubstituted alkenyl group (e.g., allyl, 2-methylallyl), a substituted or unsubstituted alkynyl group (e.g.,. propargyl), a substituted or unsubstituted aralkyl group (e.g., benzyl, phenethyl, 4-methoxybenzyl), an aryl group (e.g., phenyl, naphthyl, 4-methylphenyl, 4-methoxyphenyl, 4-carboxyphenyl, 4-sulfophenyl), a substituted or unsubstituted heterocyclic group (e.g., 2-pyridyl, 3-pyridyl, 4-pyridyl, 2-thienyl, 1-pyrazolyl, 1-imidazolyl, 2-tetrahydrofuryl), a substituted or unsubstituted amino group (e.g., unsubstituted amino, dimethylamino, methylamino), an acylamino group (e.g., acetylamino, benzoylamino, methoxypropylamino), a sulfonamido group (e.g., methanesulfonamido, benzenesulfonamido, 4-toluenesulfonamido), a ureido group (e.g., unsubstituted ureido, 3-methylureido) or a sulfamoylamino group (e.g., unsubstituted sulfamoylamino, 3-methylsulfamoylamino).

Y preferably represents —N($R_{23}$)—. $R_{21}$ and $R_{23}$ each preferably represents a substituted or unsubstituted alkyl group having 1 to 6 carbon atoms, a substituted or unsubstituted alkenyl group having 1 to 6 carbon atoms, or a substituted or unsubstituted alkynyl group having 1 to 6 carbon atoms. More preferably, $R_{21}$ and $R_{23}$ each represents a substituted or unsubstituted alkyl group having 1 to 3 carbon atoms. $R_{22}$ preferably represents a hydrogen atom, a substituted or unsubstituted alkyl group having 1 to 6 carbon atoms, a substituted or unsubstituted alkenyl group having 1 to 6 carbon atoms, or a substituted or unsubstituted alkynyl group having 1 to 6 carbon atoms. More preferably, $R_{22}$ represents a hydrogen atom, or a substituted or unsubstituted alkyl group having 1 to 3 carbon atoms.

In a more preferred embodiment, at least one of $R_{21}$, $R_{22}$ and $R_{23}$ represents an alkyl group having 1 to 3 carbon atoms, substituted by a carboxyl group or a sulfo group.

Specific examples of the compound represented by formula (III) are described below, but the compound of formula (III) is by no means limited thereto.

(III-1)
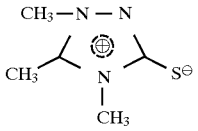
(III-2)
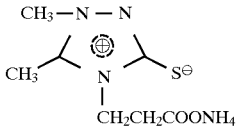
(III-3)
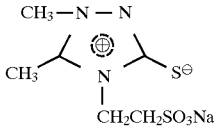
(III-4)
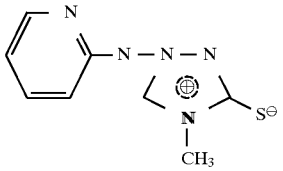
(III-5)
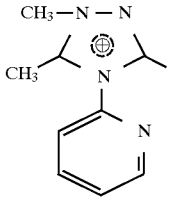
(III-6)
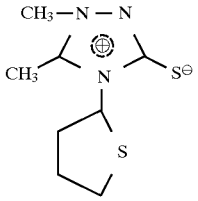
(III-7)
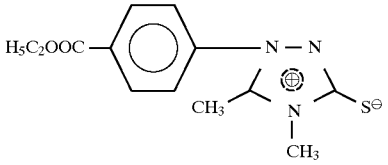
(III-8)
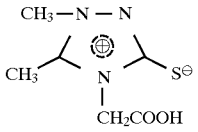
(III-9)
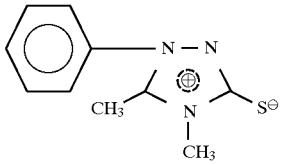
(III-10)
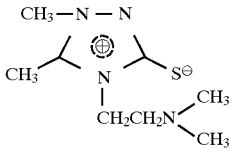
-continued
(III-11)
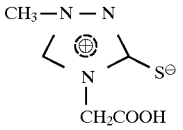
(III-12)
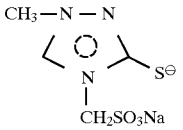
(III-13)
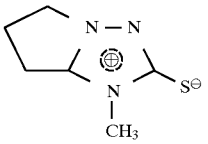
(III-14)
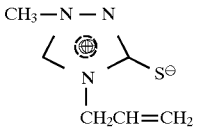
(III-15)
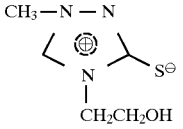
(III-16)
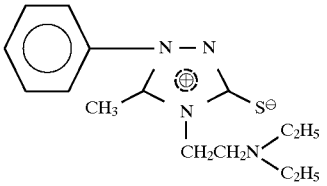
(III-17)
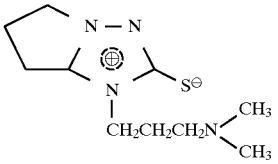
(III-18)
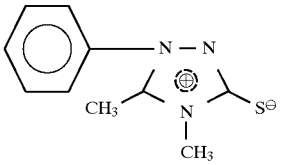
(III-19)
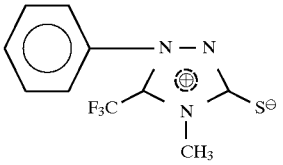
(III-20)
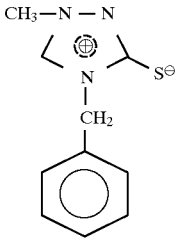

-continued
(III-21)
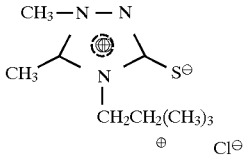
(III-22)
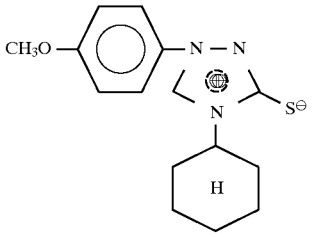
(III-23)
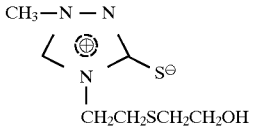
(III-24)
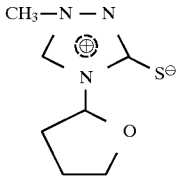
(III-25)
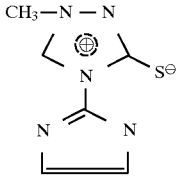
(III-26)
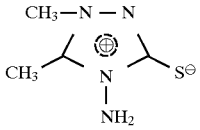
(III-27)
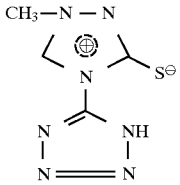
(III-28)
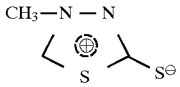
(III-29)
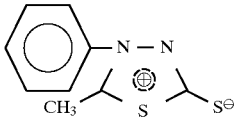
(III-30)
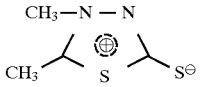
-continued
(III-31)
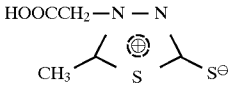
(III-32)
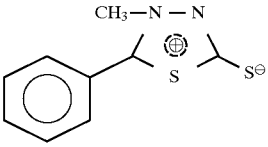
(III-33)
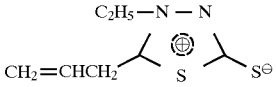
(III-34)
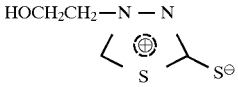
(III-35)
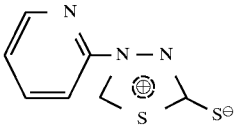
(III-36)
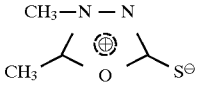
(III-37)
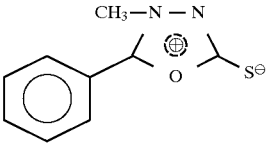
(III-38)
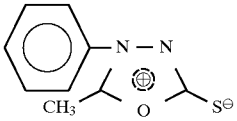
(III-39)
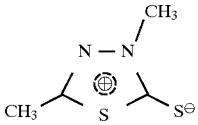
(III-40)
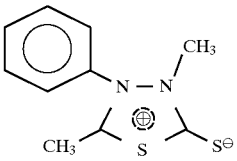
(III-41)
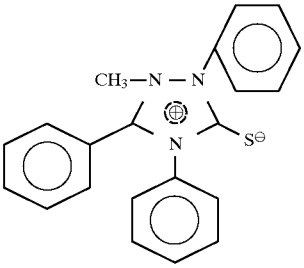

-continued

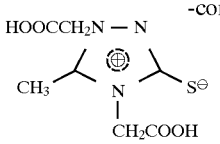
(III-42)

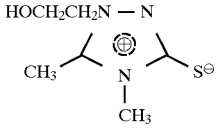
(III-43)

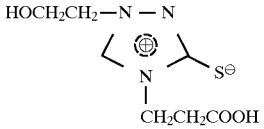
(III-44)

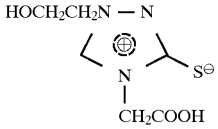
(III-45)

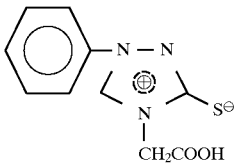
(III-46)

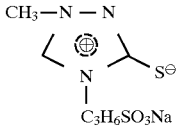
(III-47)

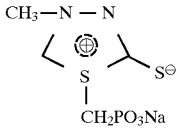
(III-48)

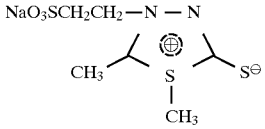
(III-49)

Among the above-described compounds, preferred are Compounds (III-3), (III-8), (III-11), (III-15), (III-59), (III-60) and (III-62), and more preferred are Compounds (III-3) and (III-8).

The compound represented by formula (III) can be synthesized according to the methods described in *J. Heterocyclic Chem.*, 2, 105 (1965), *J. Org. Chem.*, 32, 2245 (1967), *J. Chem. Soc.*, 3799 (1969), *J. Am. Chem. Soc.*, 80, 1895 (1958), *Chem. Commun.*, 1222 (1971), *Tetrahedron Lett.*, 2939 (1972), JP-A-60-87322, *Berichte der Deutschen Chemischen Gesellschaft*, 38, 4049 (1905), *J. Chem. Soc. Chem. Commun.*, 1224 (1971), JP-A-60-122936, JP-A-60-117240, *Advances in Heterocyclic Chemistry*, 19, 1 (1976), *Tetrahedron Letters*, 5881 (1968), *J. Heterocyclic Chem.*, 5, 277 (1968), *J. Chem. Soc. Perkin Trans. I*, 627 (1974), *Tetrahedron Letters*, 1809 (1967), ibid., 1578 (1971), *J. Chem. Soc.*, 899 (1935), ibid., 2865 (1959), and *J. Org. Chem.*, 30, 567 (1965).

The compound represented by formula (IV) is described below in detail.

In formula (IV), $Q_{41}$ preferably represents a nonmetallic atom group necessary for forming a 5- or 6-membered heterocyclic ring constituted by at least one atom selected from a carbon atom, a nitrogen atom, an oxygen atom, a sulfur atom and a selenium atom. The heterocyclic ring may be condensed with a carboaromatic ring or a heteroaromatic ring.

Examples of the heterocyclic ring include a tetrazole ring, a triazole ring, an imidazole ring, a thiadiazole ring, an oxadiazole ring, a selenadiazole ring, an oxazole ring, a thiazole ring, a benzoxazole ring, a benzthiazole ring, a benzimidazole ring, a pyrimidine ring, a triazaindene ring, a tetrazaindene ring and a pentazaindene ring.

$R_{41}$ represents a carboxylic acid or a salt thereof (e.g., sodium salt, potassium salt, ammonium salt, calcium salt), a sulfonic acid or a salt thereof (e.g., sodium salt, potassium salt, ammonium salt, magnesium salt, calcium salt), a phosphonic acid or a salt thereof (e.g., sodium salt, potassium salt, ammonium salt), a substituted or unsubstituted amino group (e.g., unsubstituted amino, dimethylamino, diethylamino, methylamino, bismethoxyethylamino) or a substituted or unsubstituted ammonium group (e.g., trimethylammonium, triethylammonium, dimethylbenzylammonium). $L_{41}$ represents a single bond, a divalent aliphatic group, a divalent aromatic hydrocarbon group, a divalent heterocyclic group or a linking group comprising a combination of these. $L_{41}$ preferably represents a divalent alkylene group having from 1 to 10 carbon atoms (e.g., methylene, ethylene, propylene, butylene, isopropylene, 2-hydroxypropylene, hexylene, octylene), a divalent alkenylene group having from 2 to 10 carbon atoms (e.g., vinylene, propenylene, butenylene), a divalent aralkylene group having from 7 to 12 carbon atoms (e.g., phenethylene), a divalent arylene group having from 6 to 12 carbon atoms (e.g., phenylene, 2-chlorophenylene, 3-methoxyphenylene, naphthylene), a divalent heterocyclic group having from 1 to 10 carbon atoms (e.g., pyridyl, thienyl, furyl, triazolyl, imidazolyl), a single bond, a group comprising any combination of these groups or a group comprising any combination of —CO—, —$SO_2$—, —$NR_{202}$—, —O— and —S—, wherein $R_{202}$ represents a hydrogen atom, an alkyl group having from 1 to 6 carbon atoms (e.g., methyl, ethyl, butyl, hexyl), an aralkyl group having from 7 to 10 carbon atoms (e.g., benzyl, phenethyl) or an aryl group having from 6 to 10 carbon atoms (e.g., phenyl, 4-methylphenyl).

$M_{41}$ represents a hydrogen atom or a cation (e.g., an alkali metal atom such as sodium and potassium, an alkaline earth metal atom such as magnesium and calcium, an ammonium such as an ammonium and triethylammonium).

The heterocyclic ring represented by formula (IV) and $R_{41}$ each may be substituted by a nitro group, a halogen atom (e.g., chlorine, bromine), a mercapto group, a cyano group, a substituted or unsubstituted alkyl group (e.g., methyl, ethyl, propyl, t-butyl, cyanoethyl), a substituted or unsubstituted aryl group (e.g., phenyl, 4-methanesulfonamidophenyl, 4-methylphenyl, 3,4-dichlorophenyl, naphthyl), a substituted or unsubstituted alkenyl group (e.g., allyl), a substituted or unsubstituted aralkyl group (e.g., benzyl, 4-methylbenzyl, phenethyl), a substituted or unsubstituted sulfonyl group (e.g., methanesulfonyl, ethanesulfonyl, p-toluenesulfonyl), a substituted or unsubstituted carbamoyl group (e.g., unsubstituted carbamoyl, methylcarbamoyl, phenylcarbamoyl), a substituted or unsubstituted sulfamoyl group (e.g., unsubstituted sulfamoyl, methylsulfamoyl, phenylsulfamoyl), a substituted or unsubstituted carbonamido group (e.g., acetamido, benzamido), a substituted or unsubstituted sulfonamide group (e.g., methanesulfonamido, benzenesulfonamido, p-toluenesulfonamido), a substituted or unsubstituted acyloxy group (e.g., acetyloxy, benzoyloxy), a substituted or unsubstituted sulfonyloxy group (e.g., methanesulfonyloxy), a substituted or unsubstituted ureido group (e.g., unsubstituted ureido, methylureido, ethylureido, phenylureido), a substituted or unsubstituted acyl group (e.g., acetyl, benzoyl), a substituted or unsubstituted oxycarbonyl group (e.g., methoxycarbonyl, phenoxycarbonyl), a substituted or unsubstituted oxycarbonylamino group (e.g., methoxycarbonylamino, phenoxycarbonylamino, 2-ethylhexyloxycarbonylamino) or a substituted or unsubstituted hydroxyl group.

q represents an integer of from 1 to 3 and when q represents 2 or 3, the $R_{41}$ groups may be the same or different.

In a preferred embodiment of formula (IV), $Q_{41}$ represents a tetrazole ring, a triazole ring, an imidazole ring, an oxadiazole ring, a triazaindene ring, a tetrazaindene ring or a pentazaindene ring, $R_{41}$ represents an alkyl group having from 1 to 6 carbon atoms substituted by one or two groups selected from a carboxylic acid or a salt thereof and a sulfonic acid or a salt thereof, and q represents 1 or 2.

Among the compounds represented by formula (IV), more preferred are compounds represented by formula (IV-a).

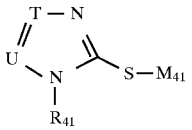

(IV-a)

wherein $M_{41}$ and $R_{41}$ have the same meaning as those defined in formula (IV), respectively, and T and U each represents C-$R_{42}$ or N, wherein $R_{42}$ represents a hydrogen atom, a halogen atom, a hydroxy group, a nitro group, an alkyl group, an alkenyl group, an aralkyl group, an aryl group, a carbonamido group, a sulfonamide group, a ureido group or $R_{41}$, provided that when $R_{42}$ represents $R_{41}$, it may be the same with or different from $R_{41}$ in formula (IV).

Formula (IV-a) is described below in detail.

T and U each represents C-$R_{42}$ or N, wherein $R_{42}$ represents a hydrogen atom, a halogen atom (e.g., chlorine, bromine), a hydroxy group, a nitro group, an alkyl group (e.g., methyl, ethyl, methoxyethyl, n-butyl, 2-ethylhexyl), an alkenyl group (e.g., allyl), an aralkyl group (e.g., benzyl, 4-methylbenzyl, phenethyl, 4-methoxybenzyl), an aryl group (e.g., phenyl, naphthyl, 4-methanesulfonamidophenyl, 4-methylphenyl), a carbonamido group (e.g., acetylamino, benzoylamino, methoxypropionylamino), a sulfonamido group (e.g., methanesulfonamido, benzenesulfonamido, p-toluenesulfonamido), a ureido group (e.g., unsubstituted ureido, methylureido, phenylureido) or $R_{41}$, provided that when $R_{42}$ represents $R_{41}$, it may be the same with or different from $R_{41}$ in formula (IV).

In a preferred embodiment of formula (IV-a), T and U both represents N or C-$R_{42}$, wherein $R_{42}$ represents a hydrogen atom or an alkyl group having from 1 to 4 carbon atoms and $R_{41}$ represents an alkyl group having from 1 to 4 carbon atoms substituted by one or two groups selected from a carboxylic acid or a salt thereof and a sulfonic acid or a salt thereof.

Specific examples of the compound represented by formula (IV) of the present invention are described below, but the present invention is by no means limited thereto.

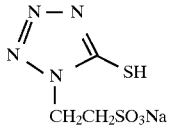

IV-1.

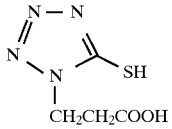

IV-2.

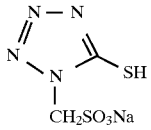

IV-3.

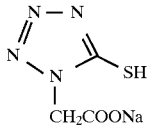

IV-4.

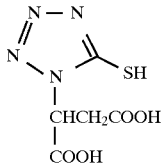

IV-5.

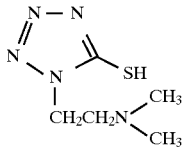

IV-6.

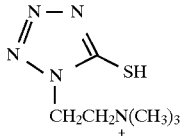

IV-7.

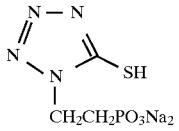

IV-8.

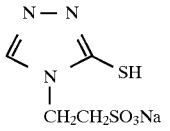

IV-9.

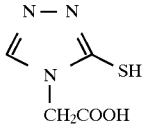

IV-10.

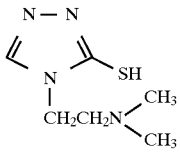

IV-11.

-continued

IV-12.

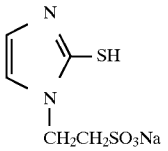

IV-13.

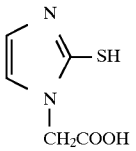

IV-14.

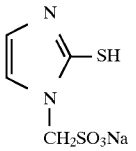

IV-15.

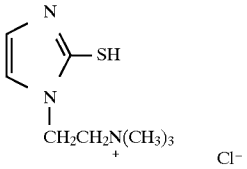

IV-16.

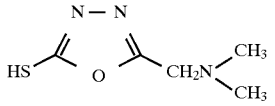

IV-17.

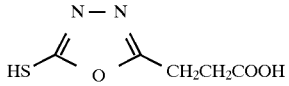

IV-18.

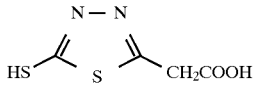

IV-19.

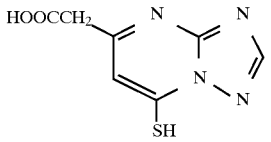

IV-20.

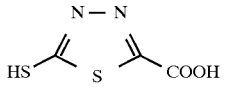

Among the above-described compounds, preferred are Compounds (IV-1), (IV-2), (IV-3), (IV-4), (IV-9), (IV-10) and (IV-12) and more preferred are Compounds (IV-1), (IV-2), (IV-3) and (IV-4).

The compound represented by formula (IV) for use in the present invention can be synthesized according to the methods described in *Berichte der Deutschen chemischen Gesellschaft*, 28, 77 (1895), JP-A-60-61749, JP-A-60-147735, *Berichte der Deutschen Chemischen Gesellschaft*, 22, 568 (1889), ibid., 29, 2483 (1896), *J. Chem. Soc.*, 1932, 1806, *J. Am. Chem. Soc.*, 71, 4000 (1949), *Advances in Heterocyclic Chemistry*, 9, 165 (1968), *Organic Synthesis*, IV, 569 (1963), *J. Am. Chem. Soc.*, 45, 2390 (1923), and *Chemische Berichte*, 9, 465 (1876).

Formula (V) is described below in detail.

Examples of the aliphatic group, the aromatic group and the heterocyclic group represented by $X_{51}$, $Y_{51}$, $R_{51}$, $R_{52}$, $R_{53}$, $R_{54}$, $R_{55}$, $R_{56}$ or $R_{57}$ in formula (V) include a substituted or unsubstituted alkyl group having from 1 to 10 carbon atoms (e.g., methyl, ethyl, propyl, hexyl, isopropyl, carboxyethyl, sulfoethyl, aminoethyl, dimethylaminoethyl, phosphonopropyl, carboxymethyl, hydroxyethyl), a substituted or unsubstituted alkenyl group having from 2 to 10 carbon atoms (e.g., vinyl, propenyl, 1-methylvinyl), a substituted or unsubstituted aralkyl group having from 7 to 12 carbon atoms (e.g., benzyl, phenethyl, 3-carboxyphenylmethyl, 4-sulfophenylethyl), a substituted or unsubstituted aryl group having from 6 to 12 carbon atoms (e.g., phenyl, naphthyl, 4-carboxyphenyl, 3-sulfophenyl) and a substituted or unsubstituted heterocyclic group having from 1 to 10 carbon atoms (preferably a 5- or 6-membered ring such as pyridyl, furyl, thienyl, imidazolyl, pyrrolyl, pyrazolyl, pyrimidinyl, quinolyl, piperidyl and pyrrolidyl).

The alkyl group, the alkenyl group, the aralkyl group, the aryl group and the heterocyclic group each may be substituted. Examples of the substituent include an alkyl group, an aralkyl group, an alkenyl group, an alkynyl group, an aryl group, an alkoxy group, an aryloxy group, an acylamino group, a ureido group, a urethane group, a sulfonylamino group, a sulfamoyl group, a carbamoyl group, a sulfonyl group, a sulfinyl group, an alkyloxycarbonyl group, an aryloxycarbonyl group, an acyl group, an acyloxy group, a halogen atom, a cyano group and a nitro group. These groups each may be further substituted. When two or more substituents are present, they may be the same or different.

In formula (V), $X_{51}$ and $Y_{51}$ may form a ring exclusive of an enolic form. Examples of the ring formed by $X_{51}$, and $Y_{51}$ include a 4-imidazoline-2-thione ring, an imidazolidine-2-thione ring, a thiazoline-2-thione ring, a 4-thiazolidine-2-thione ring, a 4-oxazoline-2-thione ring, an oxazolidine-2-thione ring, a pyrrolidine-2-thione ring and a benzo ring-condensed product of these rings.

In formula (V), at least one of $X_{51}$ and $Y_{51}$ is substituted by at least one of a carboxylic acid or a salt thereof (e.g., alkali metal salt, ammonium salt), a sulfonic acid or a salt thereof (e.g., alkali metal salt, ammonium salt), a phosphonic acid or a salt thereof (e.g., alkali metal salt, ammonium salt), an amino group (e.g., unsubstituted amino, dimethylamino, methylamino, hydrochloride of dimethylamino) or ammonium (e.g., trimethylammonium dimethylbenzylammonium), and a hydroxyl group.

The cation represented by $R_{56}$ or $R_{57}$ in formula (V) includes a hydrogen atom, an alkali metal and an ammonium.

In formula (V), $X_{51}$ and $Y_{51}$ preferably represents an alkyl group having from 1 to 10 carbon atoms, a heterocyclic group having from 1 to 10 carbon atoms, —$N(R_{51})R_{52}$ having from 0 to 10 carbon atoms, —$N(R_{53})N(R_{54})R_{55}$ having from 0 to 10 carbon atoms or —$OR_{56}$ having from 0 to 10 carbon atoms, each group being substituted by one or two groups selected from a carboxylic acid or a salt thereof, a sulfonic acid or a salt thereof, a phosphonic acid or a salt thereof, an amino group or ammonium group, and a hydroxyl group. $R_{51}$, $R_{52}$, $R_{53}$, $R_{54}$, $R_{55}$ and $R_{56}$ each represents a hydrogen atom or an alkyl group.

In formula (V), $X_{51}$ and $Y_{51}$ more preferably represent an alkly group having from 1 to 6 carbon atoms, —$N(R_{51})R_{52}$ having from 0 to 6 carbon atoms, —$N(R_{53})N(R_{54})R_{55}$ having from 0 to 6 carbon atoms or —$OR_{56}$ having from 0 to 6 carbon atoms, each group being substituted by one or two groups selected from a carboxylic acid or a salt and a sulfonic acid or a salt. $R_{51}$, $R_{52}$, $R_{53}$, $R_{54}$, $R_{55}$ and $R_{56}$ each represents a hydrogen atom or an alkyl group.

Specific examples of the compound represented by formula (V) of the present invention are described below, but the present inventions is by no means limited thereto.

V-1.
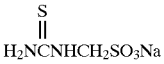
V-2.
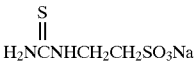
V-3.
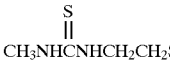
V-4.
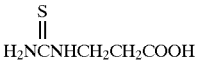
V-5.
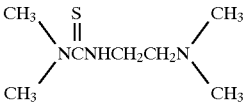
V-6.
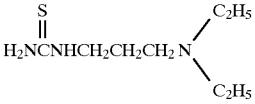
V-7.
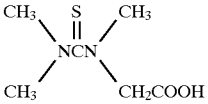
V-8.
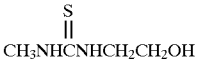
V-9.
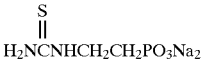
V-10.
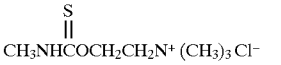
V-11.
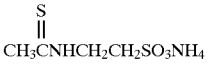
V-12.
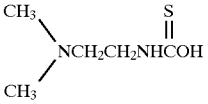
V-13.
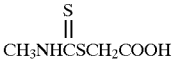
V-14.
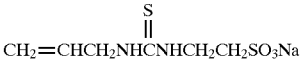
V-15.
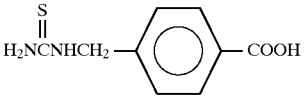
V-16.
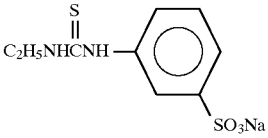
V-17.
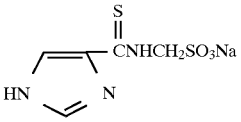
-continued
V-18.
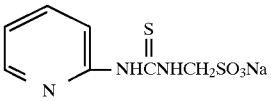
V-19.
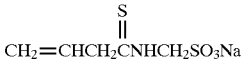
V-20.
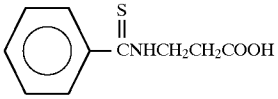
V-21.
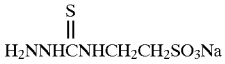
V-22.
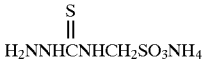
V-23.
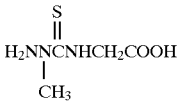
V-24.
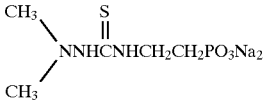
V-25.
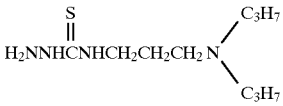
V-26.
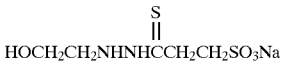
V-27.
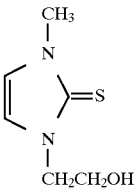
V-28.
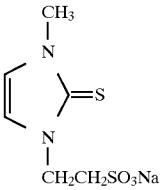
V-29.
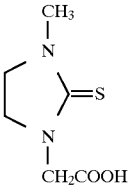
V-30.
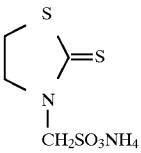

-continued

V-31.

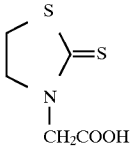

V-32.

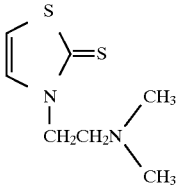

V-33.

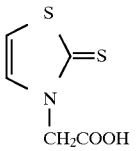

V-34.

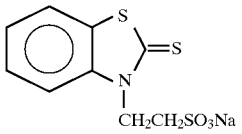

V-35.

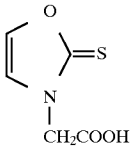

V-36.

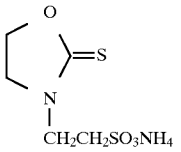

V-37.

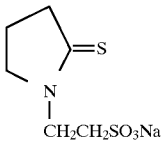

Among the above-described compounds, preferred are Compounds (V-2) and (V-3) and more preferred is Compound (V-3).

The compound represented by formula (V) of the present invention can be synthesized by referring, for example, to *J. Org. Chem.*, 24, 470–473 (1959), *J. Heterocycl. Chem.*, 4, 605–609 (1967), *Yaku-shi* (Journal of Drug), 82, 36–45 (1962), JP-B-39-26203, JP-A-63-229449 and OLS 2,043, 944.

Among the silver halide solvents of the present invention, preferred are a thiosulfate such as sodium thiosulfate and potassium thiosulfate, a methanethiosulfonate) such as sodium methanethiosulfonate and potassium methanethiosulfonate and Compounds (I-1), (I-17), (II-13), (II-14), (II-16), (II-17), (II-20), (III-3), (III-8), (III-11), (III-15), (III-59), (III-60), (III-62), (IV-1), (IV-2), (IV-3), (IV-4), (IV-9), (IV-10), (IV-12), (V-2) and (V-3), more preferred are a thiosulfate, a methanethiosulfonate and Compounds (III-3), (III-8), (IV-1), (IV-2), (IV-3), (IV-4) and (V-3), and most preferred are Compounds (III-3), (III-8) and (IV-1).

The addition amount of the silver halide solvent of the present invention used in Color Development Processing B is preferably from 0.1 to 10 mmol, more preferably from 0.3 to 5.0 mmol, most preferably from 0.8 to 3.0 mmol, per l of the processing solution.

If the addition amount of the silver halide solvent is less than 0.1 mmol, the effect of the present invention is reduced and development of a red-sensitive emulsion layer is retarded, whereas if it exceeds 10 mmol, the blue-sensitive and green-sensitive emulsion layers are greatly affected and silver development on an unexposed area increases.

The silver halide solvents of the present invention may be used in combination of two or more thereof according to the purpose.

Although the silver halide solvent in developer is well known to accelerate the speed of development (dissolution physical development) (as described in T. H. James, *The Theory of the Photographic Process*, 4th ed., pp. 421–422), it is very unexpected that it accelerates only the development of lower layers as in the present invention. This is assumed that the speed of chemical development to be caused by redox reaction of a color developing agent is faster as the layer is present at an upper position and the upper layer is insusceptible to dissolution physical development due to the fast chemical development speed.

Color Development Processing A of the present invention is described below.

In Color Development Processing A of the present invention, the color development time is from 150 to 200 seconds, preferably from 165 to 195 seconds.

The color development time can be changed by the kind, and concentration of the developing agent in developer, the concentration of halogen ions (in particular, $Br^-$), the temperature of the processing solution or the pH.

The developing agent in Color Development Processing A of the present invention is selected from 2-methyl-4-[N-ethyl-N-(β-hydroxyethyl)amino]aniline, 2-methyl-4-[N-ethyl-N-(3-hydroxypropyl)amino]aniline and 2-methyl-4-[N-ethyl-N-(4-hydroxybutyl)amino]aniline and it is preferably 2-methyl-4-[N-ethyl-N-(β-hydroxyethyl)amino]aniline. The concentration of the developing agent is from 10 to 20 mmol, preferably from 14 to 18 mmol, per l of the processing solution.

The bromide ion concentration is determined by the amount of $Br^-$ eluted from the silver halide color photographic light-sensitive material and the amount of $Br^-$ replenished to the color developer, however, in order to stably maintain the photographic properties in continuous processing, the bromide ion concentration is from 9 to 14 mmol, preferably from 10 to 13 mmol, per l of the processing solution.

In view of reduction of the replenishing amount, the replenisher of the color developer preferably has a bromide ion concentration reduced to 0.004 mol/l or less, more preferably to 0.002 mol/l or less. The replenishing amount is 700 ml or less, preferably from 200 to 600 ml, per $m^2$ of the light-sensitive material.

The temperature of the processing solution is from 35+ to 40° C., preferably from 36° to 39° C.

The pH of the processing solution is from 9.9 to 10.3, preferably from 10.0 to 10.2.

Color Development Processing A contains substantialltn no silver halide solvent of the present invention. The term "substantially contains no silver halide solvent" as used herein means that the concentration of silver halide solvent of the present invention is lower than a concentration where it provides no effect and allows the presence in a slight amount caused by mixing from the subsequent steps. More specifically, the concentration of silver halide solvent is from 0.05 mmol/l or less, preferably from 0 to 0.01 mmol/l, most preferably completely zero.

The color developer in Color Development Processing A may contain hydroxylamine having a substituent described in JP-A-3-158849 and JP-A-3-174152 as a preservative and preferably contains hydroxylamine having a sulfoalkyl group as a substituent. Further, the color developer preferably contains diethylenetriaminepentacetic acid, 1-hydroxyethylidene-1,1-diphosphonic acid or 4,5-dihydroxybenzene-1,3-disulfonic acid as a chelating agent.

Preferred examples of the color developer which can be used include a color developer and a replenisher for color developer each using Processing Agent CN-16, CN-16X, CN-16Q or CN-16FA for color negative film produced by Fuji Photo Film Co., Ltd. and a color developer using Processing Agent C-41, C-41B or C-41RA for color negative film produced by Eastman Kodak Co.

Color Development Processing B of the present invention is described below.

In Color Development Processing B of the present invention, the color development time is from 25 to 90 seconds, preferably 35 to 75 seconds, most preferably 45 to 65 seconds.

The color development time of the present invention includes a cross-over time (a time period between the exit from color developer and the entrance into the subsequent processing solution) and the cross-over time is preferably short as much as possible, however, in view of capabilities of the processing instrument, it is preferably from 2 to 10 seconds, more preferably from 3 to 7 seconds.

The color development time can be, similarly to Color Development Processing A, changed by the kind and concentration of the developing agent in the processing solution, the concentration of halogen ions (in particular, Br), the temperature of the processing solution or the pH.

The developing agent in Color Development Processing B of the-present invention is a p-phenylenediamine derivative and representative preferred examples thereof are described below.

(D-1) 2-Methyl-4-[N-ethyl-N-(β-hydroxyethyl)amino] aniline (D-2) 2-Methyl-4-[N-ethyl-N-(3-hydroxypropyl)amino] aniline (D-3) 3-Methyl-4-[N-ethyl-N-(4-hydroxybutyl)amino] aniline (D-4) 2-Methyl-N,N-diethyl-p-phenylenediamine (D-5) 2-Methyl-4-[N-ethyl-N-(β-methanesulfonamidoethyl)amino]aniline (D-6) 2-Methoxy-4-[N-ethyl-N-(β-hydroxyethyl)amino] aniline (D-7) 4-Amino-3-methoxy-N,N-bis(3-hydroxypropyl) aniline (D-8) 4-Amino-3-isopropoxy-N,N-bis(β-hydroxyethyl) aniline (D-9) 1-(β-Hydroxyethyl)-5-amino-6-methylindoline (D-10) 1,2,3,4-Tetrahydro-1-(3,4-dihydroxybutyl)-2,2,4,7-tetramethyl-6-aminoquinoline (D-11) 1,2,3,4-Tetrahydro-1-(β-hydroxyethyl)-4-hydroxymethyl-6-amino-7-methylquinoline In Color Development Processing B of the present invention, Compounds D-1, D-2, D-3, D-6, D-7, D-8, D-10 and D-11 are preferred, Compounds D-1, D-2 and D-3 are more preferred, and Compound D-1 is most preferred.

The concentration of the developing agent is from 25 to 80 mmol, preferably 25 to 60 mmol, more preferably from 27 to 50 mmol, particularly preferably from 30 to 45 mmol, per l of the processing solution.

Within the above-described concentration range of the developing agent, the developing agents can be used in combination of two or more thereof.

In Color Development Processing B, the bromide ion ($Br^-$) is particularly important as an antifoggant. The $Br^-$ concentration is from 15 to 60 mmol, preferably from 16 to 42 mmol, particularly preferably from 16 to 35 mmol, per l of the processing solution.

As a halogen ion other than $Br^-$, $I^-$ or $Cl^-$ may be added, if desired.

In view of reduction of the replenishing amount, the replenisher for the color developer preferably has a bromide ion concentration reduced to 0.004 mol/l or less, more preferably to 0.002 mol/l or less. The replenishing amount is 600 ml or less, preferably from 100 to 500 ml, more preferably from 130 to 400 ml, per $m^2$ of the light-sensitive material.

The temperature of the processing solution is from 40° to 60° C., preferably from 42° to 55° C., more preferably from 43° to 50° C.

The pH of the processing solution is from 9.9 to 11.0, preferably from 10.0 to 10.5.

As described above, Color Development Processing B of the present invention contains at least one silver halide solvent of the present invention.

The color developer of the present invention may contain, as a compound capable of direct preservation of the above-described aromatic primary amine color developing agent, various hydroxylamines described in JP-A-63-5341, JP-A-63-106655 and JP-A-4-144446, hydroxamic acids described in JP-A-63-43138, hydrazines or hydrazides described in JP-A-63-146041, phenols described in JP-A-63-44657 and JP-A-63-58443, α-hydroxyketones or α-aminoketones described in JP-A-63-44656, or various saccharides described in JP-A-63-36244. Further, in combination with the above-described compound, monoamines described in JP-A-63-4235, JP-A-63-24254, JP-A-63-21647, JP-A-63-146040, JP-A-63-27841 and JP-A-63-25654, diamines described in JP-A-63-30845, JP-A-63-14640 and JP-A-63-43139, polyamines described in JP-A-63-21647, JP-A-63-26655 and JP-A-63-44655, nitroxy radicals described in JP-A-63-53551, alcohols described in JP-A-63-43140 and JP-A-63-53549, oximes described in JP-A-63-56654, or tertiary amines described in JP-A-63-239447 may be used.

Other preservatives which can be used, if desired, include various metals described in JP-A-57-44148 and JP-A-57-53749, salicylic acids described in JP-A-59-180588, alkanolamines described in JP-A-54-3582, polyethyleneimines described in JP-A-56-94349 and aromatic polyhydroxy compounds described in U.S. Pat. No. 3,746,544.

Particularly preferred preservatives are hydroxylamines represented by formula (I) of JP-A-3-144446 and compounds having a sulfo group or a carboxy group are preferred out of the hydroxylamines.

In addition, the color developer of the present invention may use various additives described in JP-A-3-144446: for example, the buffer for keeping the pH includes carbonic acids, phosphoric acids, boric acids and hydroxybenzoic acids described at page (9), from right upper column, line 6 to left lower column line 1; the chelating agent includes various aminopolycarboxylic acids, phosphonic acids and sulfonic acids described at page (9), from left lower column, line 2 to right lower column, line 18, and ethylenediaminetetraacetic acid, triethyleneteraminehexaacetic acid, 1,3-diaminopropanoltetraacetic acid, diethylenetriaminepentaacetic acid, ethylenediamine-N,N,N',N'-tetrakis (methylenephosphonic acid), catechol-3,5-disulfonic acid are preferred; the development accelerator includes various additives described in page (9), from left lower column, line 19 to page (10), right upper column, line 7; the antifoggant includes a halide ion and an organic antifoggant described in page (10), from right upper column, line 8 to left lower column, line 5; and if desired, various surface active agents such as alkylsulfonic acid, arylsulfonic acid, aliphatic carboxylic acid and aromatic carboxylic acid may be added.

In carrying out the processing in an automatic developing machine using the color developer of the present invention, the area (open area) where the color developer is put into contact with an air is preferably rendered small as much as possible. For example, assuming that the value obtained by dividing the open area ($cm^2$) by the volume of developer ($cm^3$) is an open ratio, the open ratio is preferably 0.01 $cm^{-1}$, more preferably 0.005 $cm^{-1}$.

The color developer can be regenerated and used again. The regeneration of color developer is to re-use a used developer as a color developer by subjecting the used developer to anion exchange resin or electrodialysis or by adding processing chemicals called a regenerating agent, thereby elevating the activity of the color developer. In this case, the regeneration ratio (the ratio of overflow in replenisher) is preferably 50% or more, more preferably 70% or more. In the processing using regeneration of the color developer, the overflow of the color developer is regenerated and used as a replenisher.

The color developer is regenerated preferably using an anion exchange resin. Particularly preferred examples of the composition for the anion exchange resin and the regeneration method by the resin include those described in *Diaion Manual* (*I*), 14th ed. (1986) issued by Mitsubishi Chemical Industry KK. Among the anion exchange resins, resins having a composition described in JP-A-2-952 and JP-A-1-281152 are preferred.

Development Processing A and Development Processing B of the present invention each comprises a color development step, a desilvering step and a drying step. Preferred specific examples of the constitution are described below, but the present invention is by no means limited thereto.

(1) color development-bleaching-fixing-water washing-stabilization-drying
(2) color development-bleaching-bleach-fixing-fixing-water washing-stabilization-drying
(3) color development-bleach-fixing-water washing-stabilization-drying
(4) color development-bleaching-bleach-fixing-water washing-stabilization-drying
(5) color development-bleach-fixing-fixing-water washing-stabilization-drying
(6) color development-bleaching-water washing-fixing-water washing-stabilization-drying In the above-described processing steps, the water washing before stabilization may be omitted. Further, the final stabilization may also be omitted. In Development Processing A and Development Processing B of the present invention, the desilvering process subsequent to the color development may be the same or different.

The desilvering process of the present invention is described below in detail.

As the bleaching agent used in the processing solution having bleaching ability, aminopolycarboxylic acid iron(III) complex, persulfate, bromate, hydrogen peroxide and red prussiate may be used and aminopolycarboxylic acid iron (III) complex is most preferred.

The ferric complex salt for use in the present invention may be added and dissolved as an iron complex salt previously subjected to complex formation or may be subjected to formation of a complex salt in a solution having bleaching ability by letting a complex-forming compound and a ferric salt (e.g., ferric sulfate, ferric chloride, ferric bromide, iron(III) nitrate, ammonium iron(III) sulfate) be present together.

The complex-forming compound may be present slightly in excess of the amount necessary for forming a complex with the ferric ion and when it is added in excess, usually, the excess is preferably from 0.01 to 10%.

Examples of the compound which forms a ferric complex salt in the solution having bleaching ability for use in the present invention include ethylenediaminetetraacetic acid (EDTA), 1,3-propanediaminetetraacetic acid (1,3-PDTA), diethylenetriaminepentaacetic acid, 1,2-cyclohexanediaminetetraacetic acid, iminodiacetaic acid, methyliminodiacetaic acid, N-(2-acetamido)iminodiacetic acid, nitrilotriacetic acid, N-(2-carboxyethyl)iminodiacetic acid, N-(2-carboxymethyl)iminodipropionic acid, β-alaninediacetic acid, 1,4-diaminobutanetetraacetic acid, glycol ether diaminetetraacetic acid, N-(2-carboxyphenyl) imidodiacetic acid, ethylenediamine-N-(2-carboxyphenyl)-N,N',N'-triacetic acid, ethylenediamine-N,N'-disuccinic acid, 1,3-diaminopropane-N,N'-disuccinic acid, ethylenediamine-N,N'-dimalonic acid and 1,3-diaminopropane-N,N'-dimalonic acid, however, the ferric complex salt-forming compound is by no means limited to these.

The concentration of the ferric complex salt in the processing solution having bleaching ability of the present invention is suitably from 0.005 to 1.0 mol/l, preferably from 0.01 to 0.50 mol/l, more preferably from 0.02 to 0.30 mol/l.

The concentration of the ferric complex salt in the replenisher of the processing solution having bleaching ability is preferably from 0.005 to 2 mol/l, more preferably from 0.01 to 1.0 mol/l.

The bath having bleaching ability or a prebath thereof may contain various compounds as a bleaching accelerator. For example, compounds having a mercapto group or a disulfide bond described in U.S. Pat. No. 3,893,858, German Patent 1,290,812, JP-A-53-95630 and *Research Disclosure*, No. 17129 (July, 1978), thiourea compounds described in JP-B-45-8506, JP-A-52-20832, JP-A-53-32735 and U.S. Pat. No. 3,706,561, and halides such as iodide and bromide ions are preferred because of their excellent bleaching ability.

In addition, the bath having bleaching ability which can be used in the present invention may contain a rehalogenating agent such as bromide (e.g., potassium bromide, sodium bromide, ammonium bromide), chloride (e.g., potassium chloride, sodium chloride, ammonium chloride) and iodide (e.g., ammonium iodide). Further, if desired, at least one or more of an inorganic or organic acid having pH buffering ability and an alkali metal or ammonium salt of these, such as borax, sodium metaborate, acetic acid, sodium acetate, sodium carbonate, potassium carbonate, phosphorous acid, phosphoric acid, sodium phosphate, citric acid, sodium citrate, tartaric acid, malonic acid, succinic acid and glutaric acid, or an antiseptic such as ammonium nitrate and guanidine may be added.

Further, the bath having bleaching ability may contain other various fluorescent brightening agents, defoaming agents, surface active agents or organic solvents such as polyvinyl pyrrolidone and methanol.

In the present invention, the light-sensitive material processed with the processing solution having bleaching ability is then subjected to fixing or bleach-fixing process. Preferred examples of the fixing or bleach-fixing solution include those described in JP-A-3-33847, from page 6, right lower column, line 16 to page 8, left upper column, line 15.

Specific examples of the desilvering process including bleaching, bleach-fixing and fixing include the following:

bleaching-fixing bleaching-water washing-fixing bleaching-bleach-fixing bleaching-water washing-bleach-fixing bleaching-bleach-fixing-fixing bleach-fixing Examples of the fixing agent contained in the fixing and bleach-fixing solutions include a thiosulfate such as sodium thiosulfate, ammonium thiosulfate, ammonium sodium thiosulfate and potassium thiosulfate, a thiocyanate (rhodanate) such as sodium thiocyanate, ammonium thiocyanate and potassium thiocyanate, a thiourea and a thioether.

When a thiosulfate is used alone as a fixing agent, it is used in an amount of from 0.3 to 3 mol, preferably approximately from 0.5 to 2 mol, per l of the fixing or bleach-fixing solution and when a thiocyanate is used alone, it is used in an amount of approximately from 1 to 4 mol per l of the fixing or bleach-fixing solution. The amount of the fixing agent is, including the case of combination use, generally from 0.3 to 5 mol, preferably from 0.5 to 3.5 mol, per l of the fixing or bleach-fixing solution. In case of combination use, the total amount of fixing agents may be set to fall within the above-described range.

Examples of the compound which can be used in combination with thiosulfate, other than thiocyanate, include thiourea and thioether (e.g., 3,6-dithia-1,8-octanediol).

Similarly, ammonium thiosulfate which is commonly used as a fixing agent in the bleach-fixing solution may be replaced by other known fixing agents such as a meso-ionic compound, a thioether compound, a thiourea, a large amount of iodide, or hypo.

The fixing solution or the bleach-fixing solution may contain a sulfite (e.g., sodium sulfite, potassium sulfite, ammonium sulfite) or a bisulfite adduct of a hydroxylamine, hydrazine or acetaldehyde compound (e.g., sodium acetaldehyde bisulfite) as a preservative. Further, the fixing or bleach-fixing solution may contain various fluorescent brightening agent, a defoaming agent, a surface active agent or an organic solvent such as polyvinylpyrrolidone and methanol. In particular, a sulfinic acid compound described in JP-A-60-283881 is preferably used as a preservative.

Further, the fixing solution and/or bleach-fixing solution preferably contains a chelating agent such as various aminopolycarboxylic acids and organic phosphonic acids, for the purpose of stabilization of the processing solution. Preferred examples of the chelating agent include 1-hydroxyethylidene-1,1-diphosphonic acid, ethylenediamine-N,N,N',N'-tetrakis(methylenephosphonic acid), nitrilotrimethylenephosphonic acid, ethylenediaminetetraacetic acid, diethylenetriaminepentaacetic acid, cyclohexanediaminetetraacetic acid and 1,2-propylenediaminetetraacetic acid and among these, particularly preferred are 1-hydroxyethylidene-1,1-diphosphonic acid and ethylenediaminetetraacetic acid.

The pH of the fixing or bleach-fixing solution is preferably from 5 to 9, more preferably from 5.5 to 8.

In order to adjust the pH, the fixing and/or bleach-fixing solution preferably contains a compound having a pKa of from 6.0 to 9.0 as a pH buffering agent. The compound is preferably an imidazole compound.

The imidazole compound include an imidazole and a derivative thereof and preferred examples of the substituent for the imidazole include an alkyl group, an alkenyl group, an alkynyl group, an amino group, a nitro group and a halogen atom. The alkyl group, the alkenyl group or the alkynyl group may further be substituted by an amino group, a nitro group or halogen atom. The substituent of the imidazole has a total carbon number of from 1 to 6 and the most preferred substituent is a methyl group.

Specific examples of the imidazole compound include imidazole, 1-methylimidazole, 2-methylimidazole, 4-methylimidazole, 4-(2-hydroxyethyl)-imidazole, 2-ethylimidazole, 2-vinylimidazole, 4-propylimidazole, 4-(2-aminoethyl)imidazole, 2,4-dimethylimidazole and 2-chloroimidazole. Among these preferred are imidazole, 2-methylimidazole and 4-methylimidazole and most preferred is imidazole.

The imidazole compound is contained in an amount of preferably 0.01 mol/l or more, more preferably from 0.1 to 10 mol/l, particularly preferably from 0.2 to 3 mol/l.

In the processing of the present invention, when a replenishing system is used, the replenishing amount of the fixing or bleach-fixing solution is preferably from 30 to 3,000 ml, more preferably from 40 to 1,800 ml, per $m^2$ of the light-sensitive material. The bleach-fixing solution may be replenished by a bleach-fixing replenisher or by an overflow solution of the bleaching solution and the fixing solution as described in JP-A-61-143755 and JP-A-3-213853.

In the present invention, the processing solution having bleaching ability is preferably aerated at the time of processing. The aeration may be conducted using a means known in the art and for example, blowing of air into the bleaching solution or absorption of air using an ejector may be conducted.

In blowing air, the air is preferably released into the solution through a diffusion tube having micropores. The tube diffuser is widely used, for example, in the aeration tank for processing activated sludge. With respect to the aeration, the matters described in *Z-121, Using Process·C*-41, 3rd ed., pages BL-1 to BL-2, issued by Eastman Kodak Co. (1982) may be used.

In the fixing step, the stirring is preferably intensified at the same time with bleaching or bleach-fixing and specifically, a jet stirring system is most preferably used.

In the present invention, the silver recovery from the fixing and/or bleach-fixing solution may be made according to a known method and the regenerated solution after silver recovery may be used. As the method of silver recovery, an electrolysis method (described in French Patent 2,299,667), a precipitation method (described in JP-A-52-73037 and German Patent 2,331,220), an ion exchange method (described in JP-A-51-17114 and German Patent 2,548,237) and a metal substitution method (described in British Patent 1,353,805) are effective. The silver recovery by the above-described method is preferably in-lined to the tank solution, so that the aptitude for rapid processing is further elevated.

In the processing with a bleaching and/or bleach-fixing solution of the present invention, the stirring is preferably intensified and the disclosure in JP-A-3-33847, at page 8, from right upper column, line 6 to left lower column, line 2 can be applied to the intensification of stirring as it is. In particular, a jet stirring system where the bleaching solution is jetted against the emulsion surface of the light-sensitive material is preferred.

In the present invention, the total of all processing times in the desilvering process comprising a combination of bleaching, bleach-fixing and fixing is preferably from 20 seconds to 3 minutes, more preferably from 30 seconds to 2 minutes, and the processing temperature is from 30° to 60° C., preferably from 35° to 55° C.

The processing step with a fixing and/or bleach-fixing solution is usually followed by the water-washing step. A simple processing where the processing with a processing solution having fixing ability is followed by stabilization using a stabilizing solution through substantially no water washing may also be used.

The washing water for use in the water washing step and the stabilizing solution for use in the stabilization step may contain various surface active agents so as to prevent generation of water marks upon drying of the light-sensitive material after the processing. In particular, a nonionic surface active agent is preferred and an alkylphenol ethylene oxide adduct is more preferred. The alkylphenol is preferably octyl, nonyl, dodecyl or dinonylphenol, and the addition molar number of the ethylene oxide is preferably from 8 to 14. Further, a silicon-based surface active agent capable of providing a high defoaming effect is also preferably used.

The washing water or the stabilizing solution may contain various bactericides or antimolds so as to prevent generation of fur or to prevent mold from occurring on the light-sensitive material after processing. Further, the washing water or the stabilization water preferably contains various chelating agent. Preferred examples of the chelating agent include an aminopolycaroxylic acid such as ethylenediaminetetraacetic acid and diethylenetriaminepentaacetic acid, an organic phosphonic acid such as 1-hydroxyethylidene-1,1-diphosphonic acid, diethylenetriamine-N,N,N',N'-tetramethylenephosphonic acid, and a hydrolysate of a maleic anhydride polymer described in European Patent 345172A1. Also, the washing water or the stabilizing solution preferably contains a preservative which can be added to the above-described fixing solution or bleach-fixing solution.

The stabilization solution for use in the stabilization step is a processing solution which stabilizes a dye image, such as a solution containing an organic acid and having a buffering ability to pH of from 3 to 6 and a solution containing an aldehyde (e.g., formalin or glutaraldehyde). All compounds which can be added to the washing water may be added to the stabilizing solution and in addition, the stabilizing solution may use, if desired, an ammonium compound such as ammonium chloride and ammonium sulfite, a metal compound such as Bi and Al, a fluorescent brightening agent, a hardening agent or an alkanolamine described in U.S. Pat. No. 4,786,583.

In the present invention, the stabilization solution preferably contains substantially no formaldehyde as the above-described stabilizer of an dye image. The term "contain substantially no formaldehyde" as used herein means that the total amount of free formaldehyde and a hydrate thereof is 0.003 mol or less per l of the stabilizing solution.

By using such a stabilizing solution, diffusion of formaldehyde vapor can be controlled during the processing. In this case, it is preferred for the purpose of stabilizing the magenta dye to let a formaldehyde alternative compound be present in the stabilizing solution, the bleaching solution or a prebath thereof (e.g., adjusting bath).

Preferred examples of the formaldehyde alternative compound include hexamethylenetetramine and a derivative thereof, a formaldehyde bisulfite adduct, an N-methylol compound and an azolylmethylamine compound. These compounds not only stabilize the magenta dye but also prevent the generation of yellow stain due to aging.

As the hexamethylenetetramine or a derivative thereof, the compounds described in *Beilsteins Handbuch der Organishen Chemie*, Enlarged Edition II, Vol. 26, pp. 200–212 may be used, but hexamethylenetetramine is particularly preferred.

As the formaldehyde bisulfite adduct, sodium formaldehyde bisulfite is preferred.

As the N-methylol compound, an N-methylol compound of pyrazole and a derivative thereof, an N-methylol compound of triazole and a derivative thereof and an N-methylol compound of urazole and a derivative thereof are particularly preferred.

Specific examples of the N-methylol compound include 1-hydroxymethylpyrazole, 1-hydroxymethyl-2-methylpyrazole, 1-hydroxymethyl-2,4-dimethylpyrazole, 1-hydroxymethyl-1,2,4-triazole and 1-hydroxymethylurazole. Among these, particularly preferred are 1-hydroxymethylpyrazole and 1-hydroxymethyl-1,2,4-triazole.

The above-described N-methylol compounds can be easily synthesized by reaction an amine compound having no methylol group with formaldehyde or para-formaldehyde.

In using the N-methylol compound, it is preferred to let an amine compound having no methylol group be present together in the processing solution at a molar concentration of preferably from 0.2 to 10 times the N-methylol compound.

The azolylmethylamine compound includes 1,4-bis(1,2,4-triazol-1-ylmethyl)piperazine and 1,4-bis(pyrazol-1-ylmethyl)piperazine and it is particularly preferably used in combination with an azole such as 1,2,4-triazole or pyrazole (as described in JP-A-4-359249) because the image stability is high and the formaldehyde vapor pressure is low.

The addition amount of the above-described formaldehyde alternative compound is preferably from 0.003 to 0.2 mol, more preferably from 0.005 to 0.05 mol, per l of the processing solution.

These formaldehyde compounds may be used in combination of two or more thereof in the bath.

The pH of the stabilizing solution is preferably from 3 to 9, more preferably from 4 to 7.

The water washing step or the stabilization step is preferably in a countercurrent system and the stage number is preferably from 2 to 4. The replenishing amount is from 1 to 50 times, preferably from 1 to 30 times, more preferably from 1 to 10 times, the amount carried over from the previous bath per the unit area.

With respect to the water washing and stabilization steps used in the present invention, the contents described in JP-A-3-33847, from page 11, right lower column, line 9 to page 12, right upper column, line 19 are preferably practiced.

As the water for use in the water washing step or the stabilization step, tap water may be used but water subjected to deionization treatment with an ion exchange resin to reduce the Ca and Mg ion concentrations each to 5 mg/l or less or water sterilized by halogen or ultraviolet bactericidal lamp is preferably used.

The overflow solution of the water washing or stabilization step is preferably flown into a bath having fixing ability as a prebath so as to reduce the amount of waste water.

In the processing of the present invention, an appropriate amount of water, compensation solution or replenisher is preferably supplied so as to correct the concentration due to evaporation. There is no particular limitation on the specific method for replenishing water, however, a method described in JP-A-1-254959 and JP-A-1-254960 where a monitor water tank is provided separately from the bleaching tank, the amount of water evaporation in the monitor water tank is measured, the amount of water evaporation in the bleaching tank is calculated from the amount of water evaporation measured, and water is replenished to the bleaching tank in proportion to the amount of evaporation calculated, or a method for compensating evaporation using a liquid level sensor or an overflow sensor described in JP-A-3-248155, JP-A-3-249644, JP-A-3-249645, JP-A-3-249646 and JP-A-4-140422 is preferably used. Further, water used for compensating the evaporation of each processing solution may be tap water but use of deionized water or sterilized water which is preferably used in the above-described water washing step is recommended.

The present invention is described below in greater detail with reference to Examples, however, the present invention should not be construed as being limited thereto.

EXAMPLE 1

1) Support

The support used in this example was prepared according to the following method.

100 Parts by weight of a commercially available polyethylene-2,6-naphthalate polymer and 2 parts by weight of Tinuvin P.326 (produced by Ciba Geigy AG) as an ultraviolet absorbent were dried by a usual method, melted at 300° C., extracted from a T-die, longitudinally stretched at 140° C. to 3.0 times, then transversely stretched at 130° C. to 3.0 times and further heat set at 250° C. for 6 seconds to obtain a PEN film having a thickness of 90 $\mu$m.

A part of the film was wound around a stainless steel core having a diameter of 20 cm and experienced heat history at 110° C. for 48 hours.

2) Coating of Undercoat Layer

Both surfaces of the support obtained above was subjected to corona discharge treatment, UV discharge treatment, glow discharge and flame treatment, an undercoating solution having the following composition was coated on each surface and an undercoat layer was provided cn the higher temperature side at the time of stretching. The corona discharge treatment was conducted using a solid state corona treating machine Model 6KVA manufactured by Pillar Co., Ltd. to treat a 30 cm-width support at a rate of 20 m/min. From the values of current and voltage read at this time, the support was treated at 0.375 KV·A·min/m$^2$. The discharge frequency at the treatment was 9.6 KHz and the gap clearance between the electrode and the dielectric roller was 1.6 mm. The UV discharge treatment was conducted by heating the support at 75° C. The glow discharge treatment was conducted by irradiating the support using a columnar electrode at 3,000 W for 30 seconds.

| | |
|---|---|
| Gelatin | 3 g |
| Distilled water | 25 ml |
| Sodium α-sulfodi-2-ethylhexyl succinate | 0.05 g |
| Formaldehyde | 0.02 g |
| Salicylic acid | 0.1 g |
| Diacetyl cellulose | 0.5 g |
| p-Chlorophenol | 0.5 g |
| Resorcin | 0.5 g |
| Cresol | 0.5 g |
| $(CH_2{=}CHSO_2CH_2CH_2NHCO)_2CH_2$ | 0.2 g |
| Aziridine 3 times molar adduct of trimethylolpropane | 0.2 g |
| Three times molar adduct of trimethylolpropane-toluenediisocyanate | 0.2 g |
| Methanol | 15 ml |
| Acetone | 85 ml |
| Formaldehyde | 0.01 g |
| Acetic acid | 0.01 g |
| Concentrated hydrochloric aid | 0.01 g |

3) Coating of Back Layer

On one surface of the undercoated support, an antistatic layer, a magnetic recording layer and a sliding layer were coated as a back layer.

3-1) Coating of antistatic layer 3-1-1) Preparation of electrically conductive fine particle dispersion (dispersion of tin oxide-abtimony oxide composite)

230 Parts by weight of stannic chloride hydrate and 23 parts by weight of antimony trichloride were dissolved in 3,000 parts by weight of ethanol to obtain a uniform solution. To the resulting solution, an aqueous solution of 1N sodium hydroxide was added dropwise until the pH of the solution reached 3 to obtain a colloidal coprecipitate of stannic oxide and antimony oxide. The resulting coprecipitate was allowed to stand at 50° C. for 24 hours to obtain a red brown colloidal precipitate.

The red brown colloidal precipitate was separated by centrifugation. In order to remove excessive ions, water was added to the precipitate and well washed by centrifugation. This operation was repeated three times to remove excessive ions.

After the removal of excessive ions, 200 parts of the colloidal precipitate was redispered into 1,500 parts by weight of water and atomized in a calcination furnace heated at 650° C. to obtain bluish fine particle powder of a tin oxide-antimony oxide composite having an average particle size of 0.005 $\mu$m. The fine particle powder obtained had a resistivity of 5 Ω·cm.

A mixed solution of 40 parts by weight of fine particle-powder obtained above and 60 parts by weight of water was adjusted to have a pH of 7.0 and after rude dispersion by means of a stirrer, dispersed in a horizontal sand mill (Dynomill, trade name, manufactured by WILLYA. BACHOFEN AG) until the residence time became 30 minutes. The secondary aggregate at this time had an average particle size of about 0.04 $\mu$m.

3-1-2) Coating of electrically conductive layer

An electrically conductive layer according to the following formulation was coated to have a dry thickness of 0.2 $\mu$m and dried at 115° C. for 60 seconds.

| | |
|---|---|
| Electrically conductive fine particle dispersion prepared in 3-1-1) | 20 parts by weight |
| Gelatin | 2 parts by weight |
| Water | 27 parts by weight |
| Methanol | 60 parts by weight |
| p-Chlorophenol | 0.5 part by weight |
| Resorcin | 2 parts by weight |
| Polyoxyethylene nonylphenyl ether | 0.01 part by weight |

The resulting electrically conductive film had a resistance of $1.0^{8.0}$ (100 V) and revealed to have an excellent antistatic capability.

3-2) Coating of magnetic recording layer

To 1,100 g of a magnetic substance, namely, Co-doped γ-$Fe_2O_3$ (acicular with a longer axis of 0.14 $\mu$m and a single axis of 0.03 $\mu$m; specific surface area: 41 m$^2$/g; saturated magnetization: 89 emu/g; with the surface being subjected to surface treatment by aluminum oxide and silicon oxide each in an amount of 2 wt % based on $Fe_2O_3$; coercive force: 930 Oe; $Fe^{+2}/Fe^{+3}$ ratio: 6:94), 220 g of water and 150 g of a silane coupling agent of poly(polymerization degree: 16)oxyethylene propyl trimethoxysilane were added and the mixture was well kneaded in an open kneader for 3 hours. The resulting rudely dispersed viscous solution was dried overnight at 70° C. and after removing water therefrom, heated at 110° C. for 1 hour to obtain surface-treated magnetic particles.

Then, the magnetic particles in the following formulation were kneaded again in an open kneader.

| | |
|---|---|
| Surface-treated magnetic particles prepared above | 1,000 g |
| Diacetyl cellulose | 17 g |
| Methyl ethyl ketone | 100 g |
| Cyclohexanone | 100 g |

Further, the resulting kneaded product in the following formulation was finely dispersed in a sand mill (¼ G) at 200 rpm for 4 hours.

| | |
|---|---|
| Kneaded product prepared above | 100 g |
| Diacetyl cellulose | 60 g |
| Methyl ethyl ketone | 300 g |
| Cyclohexanone | 300 g |

To the resulting fine dispersion, diacetyl cellulose and 3 molar times adduct of trimethylolpropane-toluenediisocyanate as a hardening agent were added in an amount of 20 wt % based on the binder. The resulting solution was diluted with an equivalent weight of methyl ethyl ketone and cyclohexanone to have a viscosity of about 80 cp. Then, the diluted solution was coated on the above-described electrically conductive layer by a bar coater to give a film thickness of 1.2 $\mu$m and to have a magnetic substance coverage of 0.6 g/m$^{2}$ $^{1}$. Further, silica particles (0.3 $\mu$m) as a matting agent and aluminum oxide (0.5 $\mu$m) as an abrasive were added thereto each to give a coverage of 10 mg/m$^2$. The resulting mixture was dried at 115° C. for 6 minutes (rollers and the transportation device in a drying zone all were heated to 115° C.).

Upon use of a blue filter in Status X of X-light, the co lor density of the magnetic recording layer $D^B$ was increased by about 0.1. The magnetic recording layer had a saturated magnetization moment of 4.2 emu/m$^2$, a coercive force of 923 Oe and an angular ratio of 65%.

3-3) Preparation of sliding layer

A solution according to the following formulation was coated to give a solid content coating amount of each compound as described below and dried at 110° C. for 5 minutes to obtain a sliding layer.

| | |
|---|---|
| Diacetyl cellulose | 25 mg/m$^2$ |
| $C_6H_{13}CH(OH)C_{10}H_{20}COOC_{40}H_{81}$ (compound a) | 6 mg/m$^2$ |
| $C_{50}H_{101}O(CH_2CH_2O)_{16}H$ (compound b) | 9 mg/m$^2$ |

A mixture of compound a/compound b (6:9) was heated in a mixed solvent of xylene and propylene glycol monomethyl ether (1:1 by volume) at 105° C. and dissolved and the resulting solution was poured in a ten-fold amount of propylene glycol monomethyl ether (25° C.) to provide a fine dispersion solution. The resulting solution was then diluted with a five-fold amount of acetone and re-dispersed in a high pressure homogenizer (200 atm) to provide a dispersion (average particle size: 0.01 $\mu$m) and the resulting dispersion was used for coating.

The thus-obtained sliding layer had capabilities such that the coefficient of dynamic friction was 0.06 (stainless steel ball: 5 mmϕ; load: 100 g; speed: 6 cm/minute) and a static friction coefficient was 0.07 (by clip method) and thus, had superior characteristics. Also, with respect to the sliding characteristics against the emulsion surface which will be described below, the coefficient of dynamic friction was 0.12.

4) Coating of Light-Sensitive Layer

The layers each having the following composition was coated to overlay one on another on the side of a support opposite to the back layer provided above to prepare a color negative film. This film was designated as Sample 101. (Composition of light-sensitive layer)

The main materials used in each layer are classified as follows.

ExC: cyan coupler

ExM: magenta coupler

ExY: yellow coupler

ExS: sensitizing dye

UV: ultraviolet absorbent

HBS: high-boiling point organic solvent

H: gelatin hardening agent

Numerals corresponding to respective ingredients show coating amounts expressed by the unit g/m$^2$ and in case of silver halide, they show coating amounts in terms of silver. With respect to sensitizing dyes, the coating amount is shown by the unit mol per mol of silver halide in the same layer. (Sample 101)

| | | |
|---|---|---|
| First Layer (antihalation layer) | | |
| Black Colloidal Silver | as silver | 0.12 |
| Gelatin | | 1.60 |
| ExM-1 | | 0.11 |
| ExF-1 | | $3.4 \times 10^{-3}$ |
| ExF-2 (solid disperse dye) | | 0.03 |
| ExF-3 (solid disperse dye) | | 0.04 |
| HBS-1 | | 0.16 |
| Second Layer (interlayer) | | |
| Silver Iodobromide Emulsion L | as silver | 0.040 |
| ExC-2 | | 0.055 |
| UV-1 | | 0.011 |
| UV-2 | | 0.030 |
| UV-3 | | 0.053 |
| HBS-1 | | 0.05 |
| HBS-2 | | 0.02 |
| Polyethyl acrylate latex | | 0.13 |
| Gelatin | | 1.35 |
| Third Layer (low-sensitivity red-sensitive emulsion layer) | | |
| Silver Iodobromide Emulsion A | as silver | 0.40 |
| ExS-1 | | $5.0 \times 10^{-4}$ |
| ExS-2 | | $1.8 \times 10^{-5}$ |
| ExS-3 | | $5.0 \times 10^{-4}$ |
| ExC-1 | | 0.12 |
| ExC-3 | | 0.040 |
| ExC-4 | | 0.07 |
| ExC-5 | | 0.0050 |
| ExC-7 | | 0.001 |
| ExC-8 | | 0.010 |
| Cpd-2 | | 0.005 |
| HBS-1 | | 0.090 |
| Gelatin | | 0.87 |
| Fourth Layer (medium-sensitivity red-sensitive emulsion layer) | | |
| Silver Iodobromide Emulsion B | as silver | 0.75 |
| ExS-1 | | $3.0 \times 10^{-4}$ |
| ExS-2 | | $1.2 \times 10^{-5}$ |
| ExS-3 | | $4.0 \times 10^{-4}$ |
| ExC-1 | | 0.12 |
| ExC-2 | | 0.055 |
| ExC-4 | | 0.085 |
| ExC-5 | | 0.007 |
| ExC-8 | | 0.009 |
| Cpd-2 | | 0.036 |
| HBS-1 | | 0.11 |
| Gelatin | | 0.70 |
| Fifth Layer (high-sensitivity red-sensitive emulsion layer) | | |
| Silver Iodobromide Emulsion C | as silver | 1.50 |
| ExS-1 | | $2.0 \times 10^{-4}$ |
| ExS-2 | | $1.0 \times 10^{-5}$ |
| ExS-3 | | $3.0 \times 10^{-4}$ |
| ExC-1 | | 0.09 |
| ExC-3 | | 0.040 |
| ExC-8 | | 0.014 |
| Cpd-2 | | 0.050 |
| HBS-1 | | 0.22 |

-continued

| | | |
|---|---|---|
| HBS-2 | | 0.10 |
| Gelatin | | 1.60 |
| Sixth Layer (interlayer) | | |
| Cpd-1 | | 0.07 |
| ExF-4 (solid disperse dye) | | 0.03 |
| HBS-1 | | 0.04 |
| Polyethyl acrylate latex | | 0.19 |
| Gelatin | | 1.30 |
| Seventh Layer (low-sensitivity green-sensitive emulsion layer) | | |
| Silver Iodobromide Emulsion D | as silver | 0.15 |
| Silver Iodobromide Emulsion E | as silver | 0.10 |
| Silver Iodobromide Emulsion F | as silver | 0.14 |
| ExS-4 | | $4.0 \times 10^{-5}$ |
| ExS-5 | | $1.8 \times 10^{-4}$ |
| ExS-6 | | $6.5 \times 10^{-4}$ |
| ExM-1 | | 0.005 |
| ExM-2 | | 0.30 |
| ExM-3 | | 0.09 |
| ExY-1 | | 0.015 |
| HBS-1 | | 0.26 |
| HBS-3 | | 0.006 |
| Gelatin | | 0.80 |
| Eighth Layer (medium-sensitivity green-sensitive emulsion layer) | | |
| Silver Iodobromide Emulsion G | as silver | 0.85 |
| ExS-4 | | $3.0 \times 10^{-5}$ |
| ExS-5 | | $2.2 \times 10^{-4}$ |
| ExS-6 | | $8.4 \times 10^{-4}$ |
| ExM-2 | | 0.12 |
| ExM-3 | | 0.030 |
| ExY-1 | | 0.008 |
| ExY-5 | | 0.030 |
| HBS-1 | | 0.14 |
| HBS-3 | | $8.0 \times 10^{-3}$ |
| Gelatin | | 0.90 |
| Ninth Layer (high-sensitivity green-sensitive emulsion layer) | | |
| Silver Iodobromide Emulsion H | as silver | 1.29 |
| ExS-4 | | $3.7 \times 10^{-5}$ |
| ExS-5 | | $8.1 \times 10^{-5}$ |
| ExS-6 | | $3.2 \times 10^{-4}$ |
| ExC-1 | | 0.011 |
| ExM-1 | | 0.016 |
| ExM-4 | | 0.031 |
| ExM-5 | | 0.040 |
| Cpd-3 | | 0.050 |
| HBS-1 | | 0.20 |
| HBS-2 | | 0.08 |
| Polyethyl acrylate latex | | 0.15 |
| Gelatin | | 1.57 |
| Tenth Layer (yellow filter layer) | | |
| Yellow colloidal silver | as silver | 0.014 |

-continued

| | | |
|---|---|---|
| Cpd-1 | | 0.15 |
| ExF-5 (solid disperse dye) | | 0.06 |
| ExF-6 (solid disperse dye) | | 0.06 |
| ExF-7 (oil-soluble dye) | | 0.01 |
| HBS-1 | | 0.055 |
| Gelatin | | 0.70 |
| Eleventh Layer (low-sensitivity blue-sensitive emulsion layer) | | |
| Silver Iodobromide Emulsion I | as silver | 0.08 |
| Silver Iodobromide Emulsion J | as silver | 0.12 |
| ExS-7 | | $8.0 \times 10^{-4}$ |
| ExY-1 | | 0.02 |
| ExY-2 | | 0.25 |
| ExY-3 | | 0.45 |
| ExY-4 | | 0.006 |
| ExY-6 | | 0.075 |
| ExC-7 | | 0.040 |
| HBS-1 | | 0.25 |
| Gelatin | | 1.30 |
| Twelfth Layer (high-sensitivity blue-sensitive emulsion layer) | | |
| Silver Iodobromide Emulsion K | as silver | 1.00 |
| ExS-7 | | $4.0 \times 10^{-4}$ |
| ExY-2 | | 0.10 |
| ExY-3 | | 0.10 |
| ExY-4 | | 0.008 |
| Cpd-2 | | 0.10 |
| HBS-1 | | 0.070 |
| Gelatin | | 0.80 |
| Thirteenth Layer (first protective layer) | | |
| UV-2 | | 0.08 |
| UV-3 | | 0.11 |
| UV-4 | | 0.26 |
| HBS-1 | | 0.09 |
| Gelatin | | 1.70 |
| Fourteenth Layer (second protective layer) | | |
| Silver Iodobromide Emulsion L | as silver | 0.10 |
| H-1 | | 0.40 |
| B-1 (diameter: 1.7 μm) | | $5.0 \times 10^{-2}$ |
| B-2 (diameter: 1.7 μm) | | 0.10 |
| B-3 | | 0.10 |
| S-1 | | 0.20 |
| Gelatin | | 1.75 |

In addition, to each layer, W-1 to W-3, B-4 to B-6, F-1 to F-17, an iron salt, a lead salt, a gold salt, a platinum salt, an iridium salt, a palladium salt and a rhodium salt were appropriately added to improve preservability, processability, pressure durability, antimold and bactericidal property, antistatic property and coatability.

TABLE 1

| | Average AgI Content (%) | Average Grain Size (μm) | Coefficient of Variation in Grain Size (%) | Diameter/ Thickness Ratio [average aspect ratio] | Grain Structure/Form |
|---|---|---|---|---|---|
| Silver Iodobromide Emulsion A | 6.0 | 0.51 | 15 | 4.9 | uniform structure, tabular |
| Silver Iodobromide Emulsion B | 8.9 | 0.66 | 25 | 5.8 | triple structure, tabular |
| Silver Iodobromide Emulsion C | 8.9 | 0.84 | 26 | 3.7 | triple structure, tabular |
| Silver Iodobromide Emulsion D | 1.7 | 0.46 | 15 | 5.5 | triple structure, tabular |
| Silver Iodobromide Emulsion E | 3.5 | 0.57 | 20 | 4.0 | triple structure, tabular |
| Silver Iodobromide Emulsion F | 8.8 | 0.61 | 23 | 4.4 | triple structure, tabular |
| Silver Iodobromide Emulsion G | 8.8 | 0.61 | 23 | 4.4 | triple structure, tabular |
| Silver Iodobromide Emulsion H | 8.9 | 0.84 | 26 | 3.7 | triple structure, tabular |
| Silver Iodobromide Emulsion I | 1.7 | 0.46 | 15 | 4.2 | triple structure, tabular |
| Silver Iodobromide Emulsion J | 8.8 | 0.64 | 23 | 5.2 | triple structure, tabular |
| Silver Iodobromide Emulsion K | 14.0 | 1.28 | 26 | 3.5 | double structure, tabular |
| Silver Iodobromide Emulsion L | 1.0 | 0.07 | 15 | 1 | uniform structure, cubic |

In Table 1:

(1) Emulsions I to K were subjected to reduction sensitization at the grain preparation using thiourea dioxide and thiosulfonic acid according to the example of JP-A-2-191938;

(2) Emulsions A to H were subjected to gold sensitization, sulfur sensitization and selenium sensitization in the presence of the spectral sensitizing dyes described in each light-sensitive layer and sodium thiocyanate according to the example of JP-A-3-237450;

(3) in the preparation of tabular grains, low molecular weight gelatin was used according to the example of JP-A-1-158426;

(4) in tabular grains, dislocation lines were observed through a high-pressure electron microscope as described in JP-A-3-237450; and (5) Emulsion K is a double structure grain having an internal high iodide core described in JP-A-60-143331.

Preparation of Dispersion of Organic Solid Disperse Dye

ExF-2 shown below was dispersed in the following manner. Namely, 21.7 ml of water, 3 ml of a 5% aqueous solution of sodium p-octylphenoxyethoxyethoxyethanesulfonate and 0.5 g of a 5% aqueous solution of p-octylphenoxypolyoxyethylene ether (polymerization degree: 10) were poured in a 700 ml-volume pot mill, then thereto 5.0 g of Dye ExF-2 and 500 ml of zirconium oxide beads (diameter: 1 mm) were added and the mixture was dispersed for 2 hours. The dispersion was conducted using a BO-type vibrating ball mill manufactured by Chuo Koki K.K. After the dispersion, the content was taken out and thereto 8 g of a 12.5% aqueous gelatin solution was added and beads were removed by filtration to obtain a gelatin dispersion of the dye. The fine dye particles had an average particle diameter of 0.44 μm.

In the same manner, solid dispersions of ExF-3, ExF-4 and ExF-6 were obtained. The fine dye particles had an average particle diameter of 0.24 μm, 0.45 μm and 0.52 μm, respectively. ExF-5 was dispersed by the microprecipitation dispersion method described in Example 1 of European Patent Application (EP) 0549489A and the average particle diameter thereof was 0.06 μm.

ExC-1

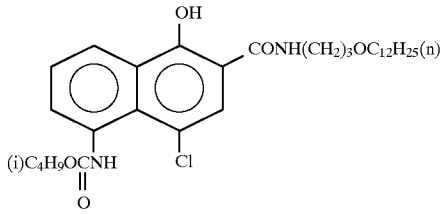

ExC-2

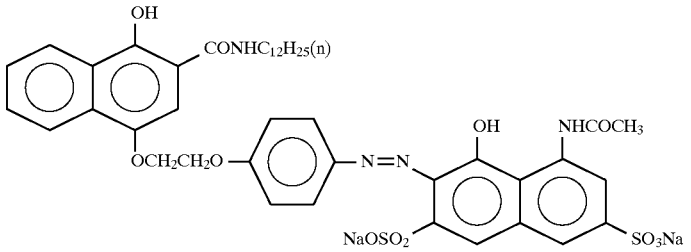

ExC-3

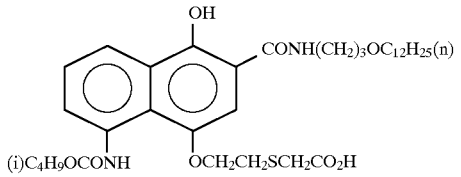

ExC-4

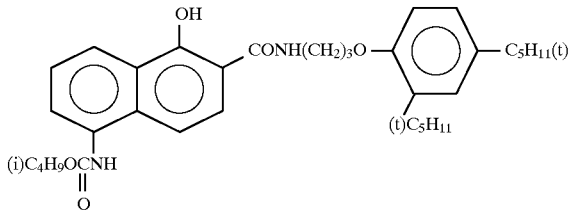

-continued
ExC-5
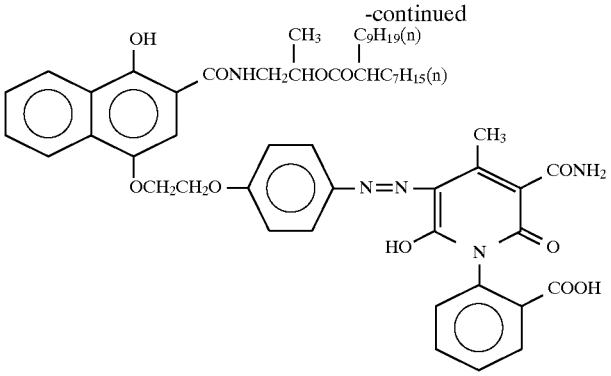
ExC-7
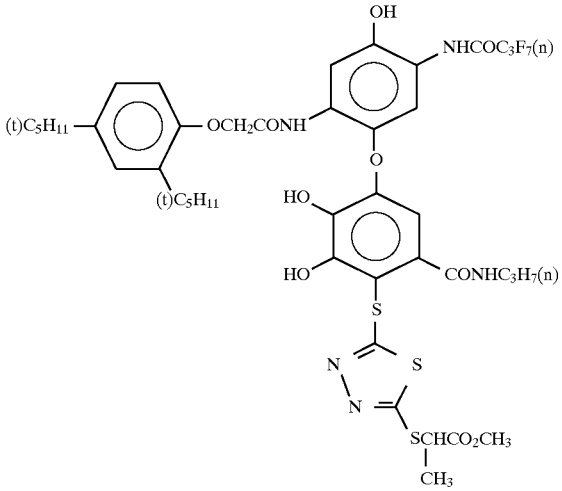
ExC-8
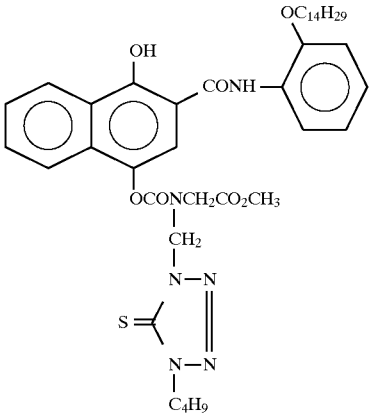
ExM-1
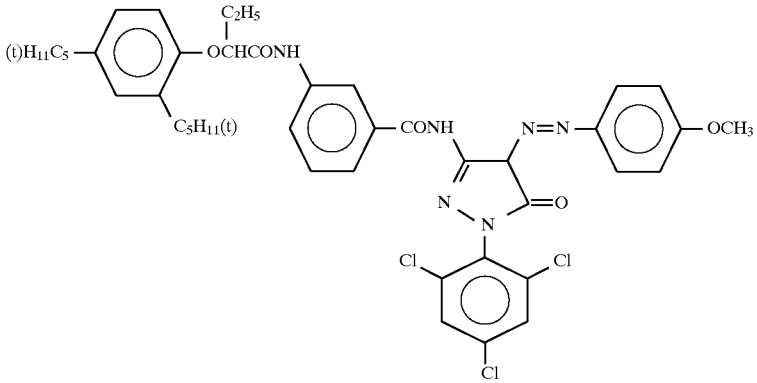

-continued
ExM-2
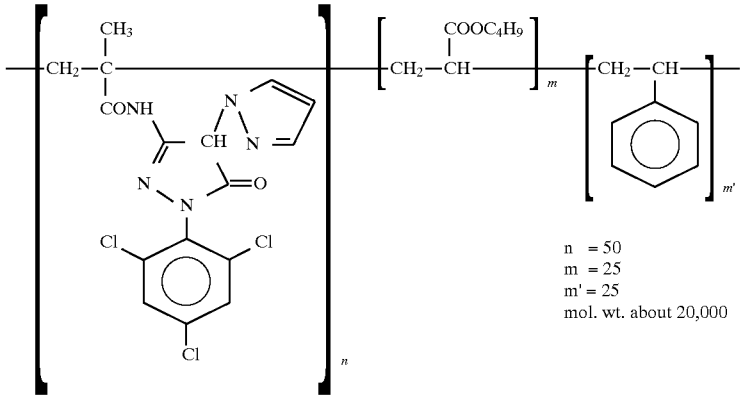
n = 50
m = 25
m' = 25
mol. wt. about 20,000
ExM-3
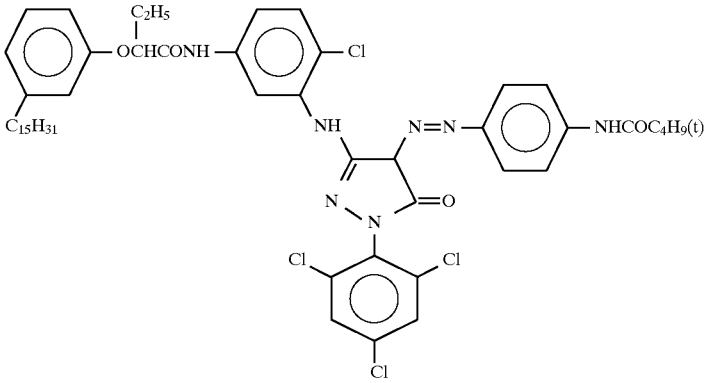
ExM-4
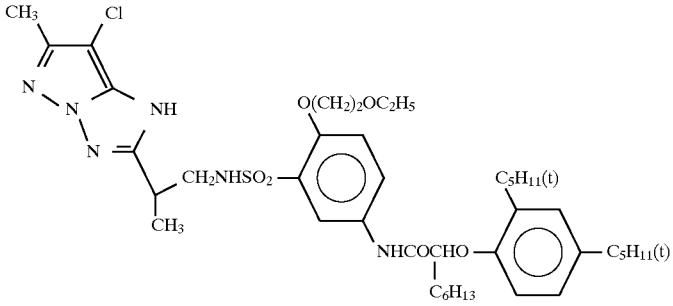
ExM-5
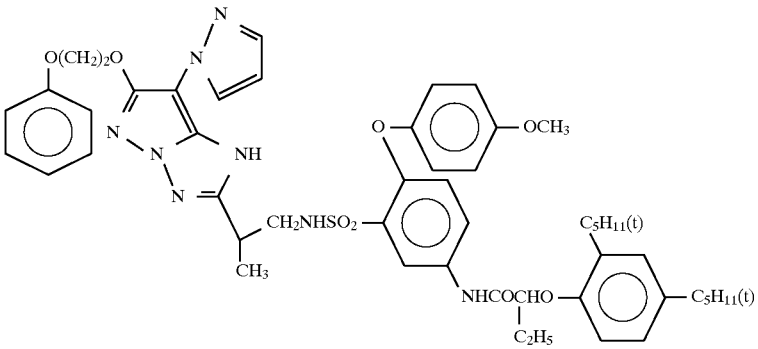

-continued
ExY-1
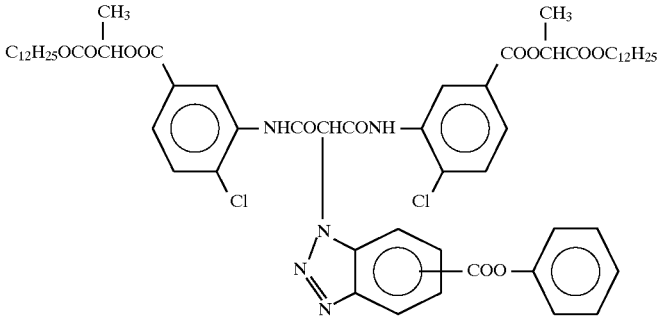
ExY-2
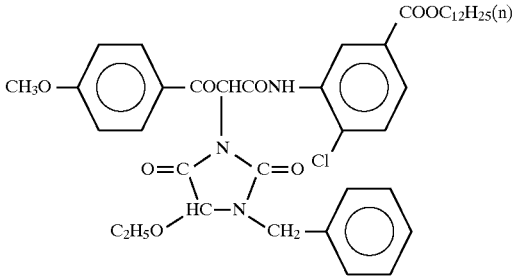
ExY-3
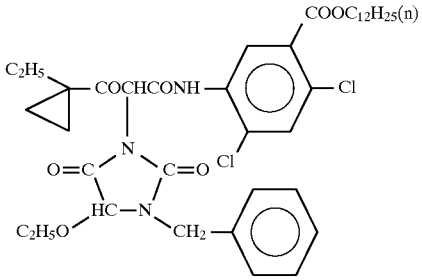
ExY-4
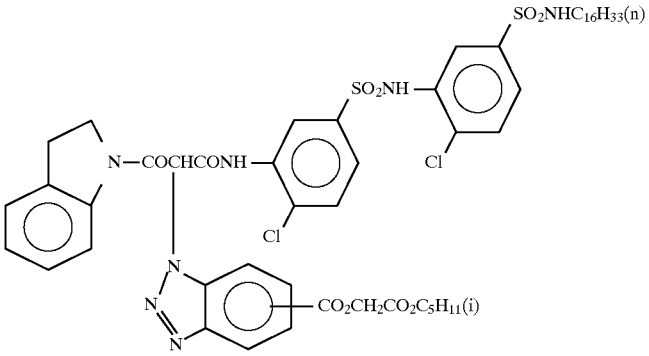
ExY-5
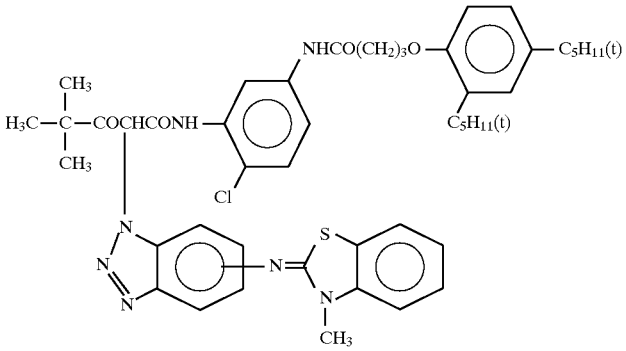

-continued
ExY-6
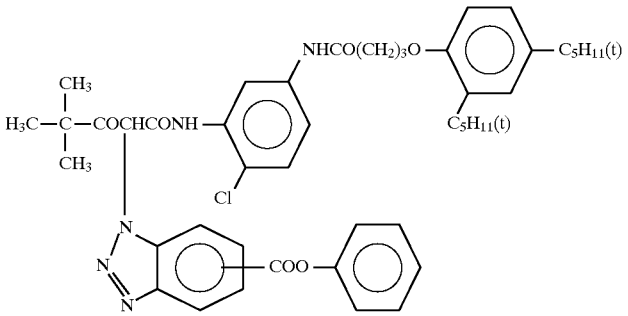
ExF-1
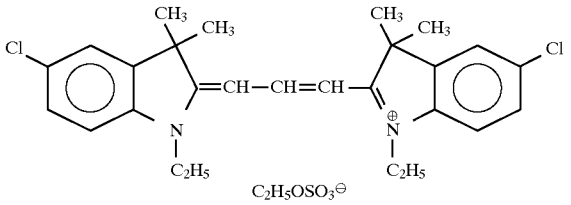
Cpd-1
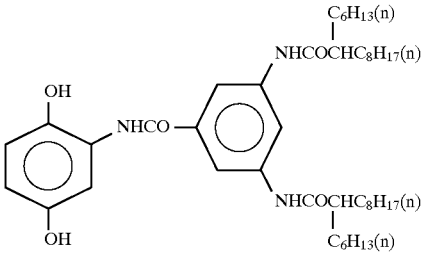
Cpd-2
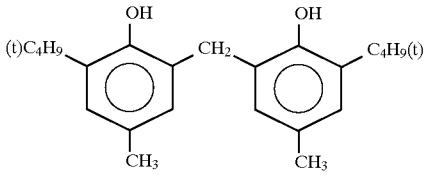
Cpd-3
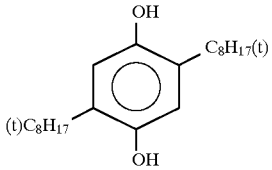
UV-1
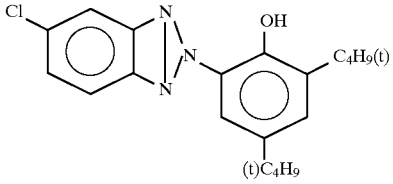
UV-2
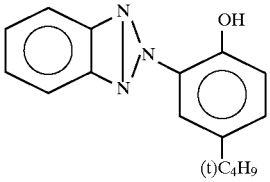

-continued
UV-3
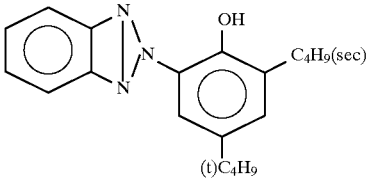
UV-4
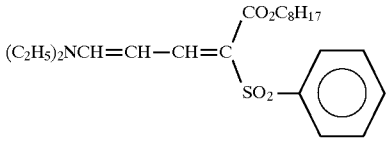
Tricresyl phosphate HBS-1
Di-n-butyl phthalate HBS-2
HBS-3
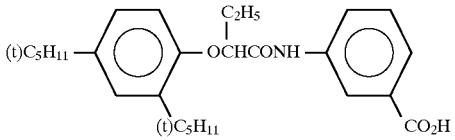
Tri(2-ethylhexyl) phosphate HBS-4
ExS-1
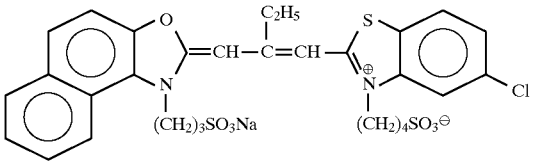
ExS-2
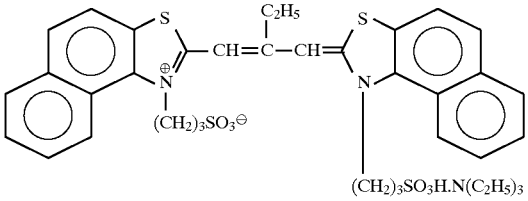
ExS-3
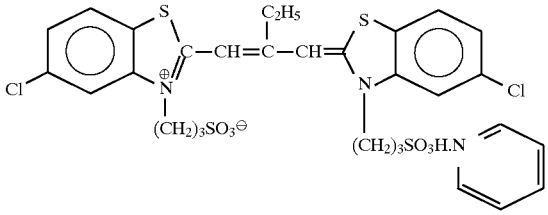
ExS-4
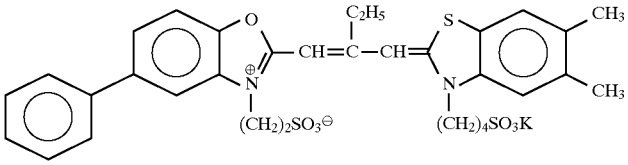
ExS-5
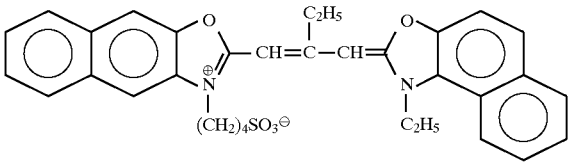

-continued
ExS-6
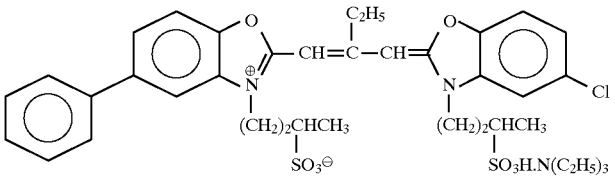
ExS-7
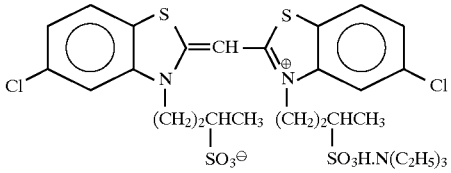
S-1
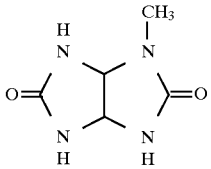
H-1
$CH_2{=}CH{-}SO_2{-}CH_2{-}CONH{-}CH_2$
$CH_2{=}CH{-}SO_2{-}CH_2{-}CONH{-}CH_2$
B-1
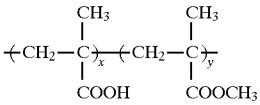
x/y = 10/90
H-1
$CH_2{=}CH{-}SO_2{-}CH_2{-}CONH{-}CH_2$
$CH_2{=}CH{-}SO_2{-}CH_2{-}CONH{-}CH_2$
B-1
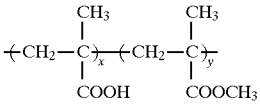
x/y = 10/90
B-2
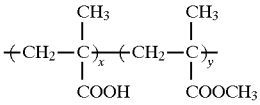
x/y = 40/60
B-3
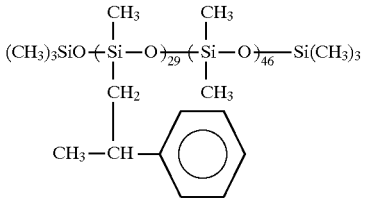
B-4
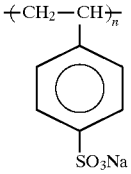
W-1
$C_8F_{17}SO_2NHCH_2CH_2CH_2OCH_2CH_2\overset{\oplus}{N}(CH_3)_3$
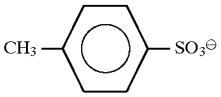

-continued
W-2
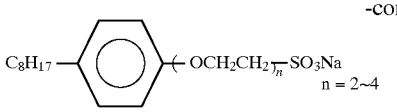
W-3
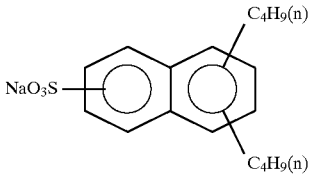
F-1
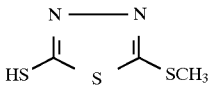
F-2
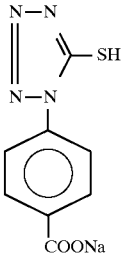
F-3
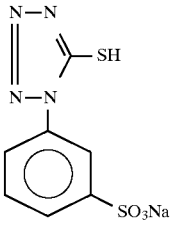
F-4
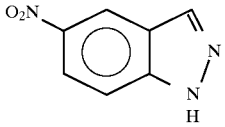
F-5
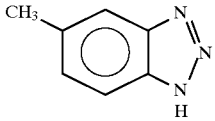
F-6
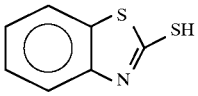
F-7
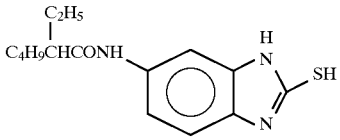
F-8
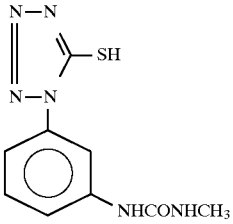

-continued
F-9
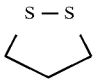
F-10
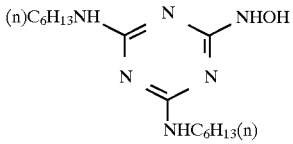
F-11
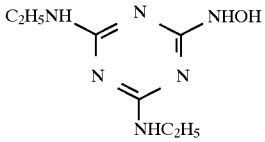
F-12
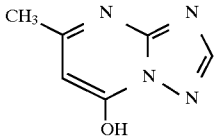
F-13
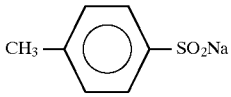
F-14
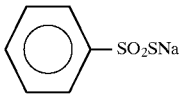
F-15
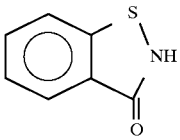
F-16
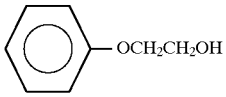
F-17
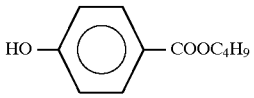
B-5
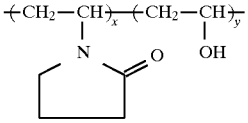
x/y = 70/30
B-6
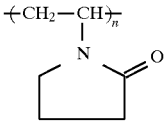
(mol. wt. about 10,000)
ExC-6
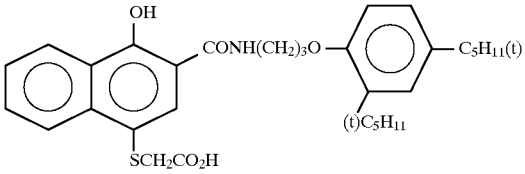

-continued

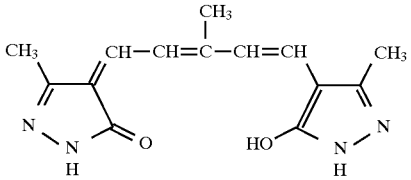

ExF-3

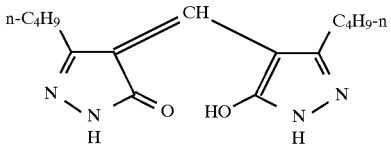

ExF-6

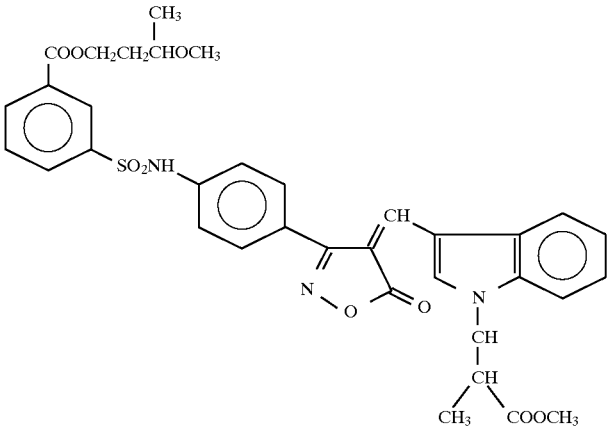

ExF-7

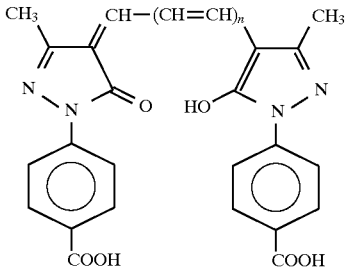

ExF-2 (n = 2)
ExF-4 (n = 1)
ExF-5 (n = 0)

Samples 102 to 108 were prepared thoroughly in the same manner as Sample 101 except for changing the average silver iodide (AgI) content of Silver Iodobromide Emulsion B in the fourth layer of Sample 101 as shown in Table 2.

The thus-obtained samples were wedgewise exposed to white light and then subjected to the following Development Processing A-1 and Development Processing B-1.

(Development Processing A-1)

| Step | Processing Time | Temperature (°C.) |
|---|---|---|
| Color development | 3 min 15 sec | 38 |
| Bleaching | 1 min 00 sec | 38 |
| Bleaching-fixing | 3 min 15 sec | 38 |
| Water washing (1) | 1 min 00 sec | 38 |
| Water washing (2) | 1 min 00 sec | 38 |
| Stabilization | 40 sec | 38 |
| Drying | 2 min 00 sec | 60 |

The composition of each processing solution is shown below.

(Color Developer)

| | Tank solution (g) |
|---|---|
| Diethylenetriaminepentaacetic acid | 1.0 |
| 1-Hydroxyethylidene-1,1-diphosphonic acid | 2.0 |
| Sodium sulfite | 4.0 |
| Potassium carbonate | 30.0 |
| Potassium bromide | 1.4 |
| Potassium iodide | 1.5 mg |
| Hydroxylamine sulfate | 2.4 |
| 4-[N-Ethyl-N-(β-hydroxyethyl)amino]-2-methylaniline sulfate | 4.5 (15.4 mmol) |
| Water to make | 1.0 l |
| pH (adjusted by potassium hydroxide and sulfuric acid) | 10.05 |

(Bleaching Solution)

The tank solution and the replenisher were common.

| | (unit: g) |
|---|---|
| Ammonium ethylenediaminetetraacetato ferrate dihydrate | 120.0 |
| Disodium ethylenediaminetetraacetate | 10.0 |
| Ammonium bromide | 100.0 |
| Ammonium nitrate | 10.0 |
| Bleaching accelerator $(CH_3)_2N—CH_2—CH_2—S—S—CH_2—CH_2—N(CH_3)_2.2HCl$ | 0.005 mol |
| Aqueous ammonia (27%) | 15.0 ml |
| Water to make | 1.0 l |
| pH (adjusted by aqueous ammonia and nitric acid) | 6.3 |

(Bleach-fixing Solution)

| | Tank Solution (g) |
|---|---|
| Ammonium ethylenediaminetetraacetato ferrate dihydrate | 50.0 |
| Disodium ethylenediaminetetraacetate | 5.0 |
| Ammonium sulfite | 12.0 |
| Aqueous solution of ammonium thiosulfate (700 g/l) | 240.0 ml |
| Aqueous ammonia (27%) | 6.0 ml |
| Water to make | 1.0 l |
| pH (adjusted by aqueous ammonia and acetic acid) | 7.2 |

(Stabilizing Solution)

The tank solution and the replenisher were common.

| | (unit: g) |
|---|---|
| Sodium p-toluenesulfinate | 0.03 |
| Polyoxyethylene-p-monononylphenyl ether (average polymerization degree: 10) | 0.2 |
| Ethylenediaminetetraacetate disodium salt | 0.05 |
| 1,2,4-Triazole | 1.3 |
| 1,4-Bis(1,2,4-triazol-1-ylmethyl)-piperazine | 0.75 |
| 1,2-Benzoisothiazolin-3-one | 0.10 |
| Water to make | 1.0 l |
| pH | 8.5 |

Processing Step and Composition of Processing Solution in Development Processing B-1:

| Processing Step | Temperature (°C.) | Time (sec) |
|---|---|---|
| Color development | 45 | 60 |
| Bleach-fixing | 40 | 60 |
| Water washing (1) | 40 | 15 |
| Water washing (2) | 40 | 15 |
| Water washing (3) | 40 | 15 |
| Stabilization | 40 | 15 |
| Drying | 80 | 60 |

(Water washing was in a 3-tank countercurrent system from (3) to (1).)

Composition of Solution:
(Color Developer)

| | Tank Solution (g) |
|---|---|
| Diethylenetriaminepentaacetic acid | 2.0 |
| 1-Hydroxyethylidene-1,1-diphosphonic acid | 3.3 |
| Sodium sulfite | 3.9 |
| Potassium carbonate | 37.5 |
| Potassium bromide | 4.0 |
| Potassium iodide | 1.3 mg |
| Hydroxylamine sulfate | 1.5 |
| Disodium N,N-bis(sulfonatoethyl)-hydroxylamine | 10.0 |
| 2-Methyl-4-[N-ethyl-N-(β-hydroxy-ethyl)amino]aniline sulfate | 18.0 (61.6 mmol) |
| Water to make | 1.0 l |
| pH (adjusted by potassium hydroxide and sulfuric acid) | 10.05 |

(Bleach-fixing Solution)

| | (unit: g) |
|---|---|
| Ethylenediamine-(2-carboxyphenyl)-N,N',N'-triacetic acid | 0.17 |
| Ferric nitrate nonahydrate | 0.15 |
| Ammonium thiosulfate | 1.25 |
| Ammonium sulfite | 0.10 |
| Metacarboxybenzenesulfinic acid | 0.05 |
| Water to make | 1.0 l |
| pH (adjusted by acetic acid and ammonia) | 5.8 |

(Washing Water/Stabilizing Solution)

The same composition described in Development Processing A

After the processing, each sample was measured on the cyan, magenta and yellow absorption densities and characteristic curves were obtained. From the resulting characteristic curves, the cyan, magenta and yellow gradients after Development Processing A-1, namely, $\gamma_A(C)$, $\gamma_A(M)$ and $\gamma_A(Y)$, and the cyan, magenta and yellow gradients after Development Processing B-1, namely, $\gamma_B(C)$, $\gamma_B(M)$ and $\gamma_B(Y)$ were determined and $\gamma_B(C)/\gamma_A(C)$, $\gamma_B(M)/\gamma_A(M)$ and $\gamma_B(Y)/\gamma_A(Y)$ were calculated.

Further, Development Processing B-2 was conducted thoroughly in the same manner as Development Processing B-1 except for adding 1.0 mmol/l of Compound (III-3) of the present invention to the color developer in Development Processing B-1 and the ratio to respective gradients after Development Processing A-1 was calculated. The results obtained are shown in Table 2.

TABLE 2

| Run No. | Sample No. | Average AgI Content (%) | Development Processing B | $\gamma_B(C)/\gamma_A(C)$ | $\gamma_B(M)/\gamma_A(M)$ | $\gamma_B(Y)/\gamma_A(Y)$ | Remarks |
|---|---|---|---|---|---|---|---|
| A01 | 101 | 8.9 | B-1 | 0.68 | 1.05 | 0.96 | Comparison |
| A02 | 102 | 6.0 | " | 0.69 | 1.04 | 0.95 | " |
| A03 | 103 | 5.0 | " | 0.68 | 1.04 | 0.96 | " |
| A04 | 104 | 3.0 | " | 0.68 | 1.05 | 0.97 | " |
| A05 | 105 | 2.0 | " | 0.69 | 1.05 | 0.96 | " |
| A06 | 106 | 1.0 | " | 0.70 | 1.05 | 0.96 | " |
| A07 | 107 | 0.5 | " | 0.69 | 1.04 | 0.97 | " |
| A08 | 108 | 0.1 | " | 0.70 | 1.04 | 0.96 | " |
| A09 | 101 | 8.9 | B-2 | 0.83 | 1.07 | 0.97 | Invention |

TABLE 2-continued

| Run No. | Sample No. | Average AgI Content (%) | Development Processing B | $\gamma_B(C)/\gamma_A(C)$ | $\gamma_B(M)/\gamma_A(M)$ | $\gamma_B(Y)/\gamma_A(Y)$ | Remarks |
|---|---|---|---|---|---|---|---|
| A10 | 102 | 6.0 | " | 0.87 | 1.07 | 0.98 | " |
| A11 | 103 | 5.0 | " | 0.91 | 1.05 | 0.98 | " |
| A12 | 104 | 3.0 | " | 0.96 | 1.06 | 0.98 | " |
| A13 | 105 | 2.0 | " | 0.98 | 1.06 | 0.97 | " |
| A14 | 106 | 1.0 | " | 1.03 | 1.05 | 0.98 | " |
| A15 | 107 | 0.5 | " | 1.07 | 1.05 | 0.97 | " |
| A16 | 108 | 0.1 | " | 1.15 | 1.05 | 0.98 | " |

From the results in Table 2, it is seen that by adding the silver halide solvent of the present invention, the ($\gamma_B(C)/\gamma_A(C)$) value was elevated to between 0.8 and 1.2, whereby the retardation of development in the lower layers was improved and images having good color reproducibility were obtained.

On the other hand, the silver halide solvent of the present invention had almost no effect on the ($\gamma_B(M)/\gamma_A(M)$) value and ($\gamma_B(Y)/\gamma_A(Y)$) value.

Further, when the average AgI content was from 0.5 to 5.0 mol %, the ($\gamma_B(C)/\gamma_A(C)$) value increased to between 0.9 and 1.1 and this was more advantageous.

EXAMPLE 2

Development Processings B-3 to B-22 were conducted using Sample 104 thoroughly in the same manner as Development Processing B-2 in Example 1 except for replacing Compound (III-3) of the present invention in Development Processing B-2 by an equimolar amount (1.0 mmol/l) of silver halide solvents shown in Table 3 and the ($\gamma_B(C)/\gamma_A(C)$) value was determined in each processing.

The results obtained are shown in Tables 3 and 4.

TABLE 3

| Run No. | Sample No. | Development Processing B | Silver Halide Solvent | $\gamma_B(C)/\gamma_A(C)$ | Remarks |
|---|---|---|---|---|---|
| B09 | 104 | B-1 | not added | 0.68 | Comparison |
| B10 | " | B-2 | III-3 | 0.96 | Invention |
| B11 | " | B-3 | sodium methanesulfonate | 0.92 | " |
| B12 | " | B-4 | sodium thiosulfate | 0.93 | " |
| B13 | " | B-5 | I-1 | 0.90 | " |
| B14 | " | B-6 | I-2 | 0.89 | " |
| B15 | " | B-7 | I-7 | 0.87 | " |
| B16 | " | B-8 | I-11 | 0.88 | " |
| B17 | " | B-9 | I-13 | 0.89 | " |
| B18 | " | B-10 | I-17 | 0.92 | " |
| B19 | " | B-11 | II-1 | 0.89 | " |
| B20 | " | B-12 | II-13 | 0.92 | " |
| B21 | " | B-13 | II-14 | 0.91 | " |

TABLE 4

| Run No. | Sample No. | Development Processing B | Silver Halide Solvent | $\gamma_B(C)/\gamma_A(C)$ | Remarks |
|---|---|---|---|---|---|
| B22 | 104 | B-14 | II-16 | 0.91 | Invention |
| B23 | " | B-15 | II-17 | 0.92 | " |
| B24 | " | B-16 | II-20 | 0.91 | " |
| B25 | " | B-17 | III-8 | 0.96 | " |
| B26 | " | B-18 | III-11 | 0.94 | " |
| B27 | " | B-19 | III-12 | 0.95 | " |
| B28 | " | B-20 | III-15 | 0.94 | " |

TABLE 4-continued

| Run No. | Sample No. | Development Processing B | Silver Halide Solvent | $\gamma_B(C)/\gamma_A(C)$ | Remarks |
|---|---|---|---|---|---|
| B29 | " | B-21 | III-59 | 0.94 | " |
| B30 | " | B-22 | III-60 | 0.93 | " |

EXAMPLE 3

Run Nos. C01 to C08 were conducted thoroughly in the same manner as Run No. A12 in Example 1 except for changing the addition amount of Compound (III-3) of the present invention in Development Processing B-2 as shown in Table 5.

The results obtained are shown in Table 5.

TABLE 5

| Run No. | Sample No. | Addition Amount of (III-3) (mmol/l) | $\gamma_B(C)/\gamma_A(C)$ | $\gamma_B(M)/\gamma_A(M)$ | $\gamma_B(Y)/\gamma_A(Y)$ | Remarks |
|---|---|---|---|---|---|---|
| C01 | 104 | not added | 0.68 | 1.05 | 0.97 | Comparison |
| C02 | " | 0.1 | 0.81 | 1.05 | 0.97 | Invention |
| C03 | " | 0.3 | 0.90 | 1.05 | 0.98 | " |
| C04 | " | 0.8 | 0.95 | 1.06 | 0.98 | " |
| C05 | " | 3.0 | 1.02 | 1.08 | 1.02 | " |
| C06 | " | 5.0 | 1.08 | 1.11 | 1.05 | " |
| C07 | " | 10.0 | 1.16 | 1.15 | 1.10 | " |
| C08 | " | 20.0 | 1.19 | 1.18 | 1.15 | " |

From the results in Table 5, it is seen that when the addition amount of Compound (III-3) of the present invention was from 0.3 to 5.0 mmol/l, the ($\gamma_B(C)/\gamma_A(C)$) value increased to between 0.90 and 1.10 and this was advantageous.

Further, when the addition amount exceeded 20 mmol/l, the fog density on the unexposed area was conspicuously increased.

EXAMPLE 4

Experiments were conducted thoroughly in the same manner as Run No. A12 in Example 1 except for changing the color development time and the temperature of the color developer in Development Processing B-2 of Run No. A12 as shown in Table 6. The results obtained are shown in Table 6.

TABLE 6

| Run No. | Sample No. | Color Development Time (sec) | Temperature (°C.) | $\gamma_B(C)/\gamma_A(C)$ | $\gamma_B(M)/\gamma_A(M)$ | $\gamma_B(Y)/\gamma_A(Y)$ | Remarks |
|---|---|---|---|---|---|---|---|
| D01 | 104 | 20 | 52.0 | 0.74 | 1.13 | 1.01 | Comparison |
| D02 | " | 25 | 51.0 | 0.87 | 1.09 | 0.98 | Invention |
| D03 | " | 35 | 48.0 | 0.90 | 1.08 | 0.99 | " |
| D04 | " | 45 | 45.5 | 0.94 | 1.06 | 0.98 | " |
| D05 | " | 65 | 44.5 | 0.96 | 1.06 | 1.00 | " |
| D06 | " | 75 | 42.0 | 1.05 | 1.04 | 1.01 | " |
| D07 | " | 90 | 40.0 | 1.17 | 1.09 | 1.01 | " |
| D08 | " | 120 | 38.0 | 1.25 | 1.18 | 1.05 | Comparison |

As is clearly seen from the results in Table 6, with the development time short as from 25 to 90 seconds, images having a gradient ratio of from 0.8 to 1.2 were obtained, in other words, images having good color reproducibility were obtained by rapid processing.

EXAMPLE 5

Samples 501 to 507 were prepared thoroughly in the same manner as Sample 105 in Example 1 except for changing only the diameter/thickness ratio (average aspect ratio) as shown in Table 7. Each sample was processed by Development Processings A-1, B-1 and B-2 in Example 1 and the gradient ratio of cyan density ($\gamma_B(C)/\gamma_A(C)$) was obtained in respective processings. The results obtained are shown in Table 7.

TABLE 7

| Run No. | Sample No. | Average Aspect Ratio | Development Processing B | $\gamma_B(C)/\gamma_A(C)$ | Remarks |
|---|---|---|---|---|---|
| E01 | 105 | 5.8 | B-1 | 0.68 | Comparison |
| E02 | 501 | 1.5 | " | 0.69 | " |
| E03 | 502 | 2.0 | " | 0.70 | " |
| E04 | 503 | 3.0 | " | 0.69 | " |
| E05 | 504 | 5.0 | " | 0.68 | " |
| E06 | 505 | 10.0 | " | 0.70 | " |
| E07 | 506 | 15.0 | " | 0.69 | " |
| E08 | 507 | 20.0 | " | 0.71 | " |
| E09 | 501 | 1.5 | B-2 | 0.82 | Invention |
| E10 | 502 | 2.0 | " | 0.91 | " |
| E11 | 503 | 3.0 | " | 0.93 | " |

TABLE 7-continued

| Run No. | Sample No. | Average Aspect Ratio | Development Processing B | $\gamma_B(C)/\gamma_A(C)$ | Remarks |
|---|---|---|---|---|---|
| E12 | 504 | 5.0 | " | 0.96 | " |
| E13 | 505 | 10.0 | " | 1.02 | " |
| E14 | 506 | 15.0 | " | 0.94 | " |
| E15 | 507 | 20.0 | " | 0.89 | " |

From the results in Table 7, it is seen that the effects of the present invention were achieved to a greatest extent at an average aspect ratio of from 5 to 10.

TABLE 6

Samples 601 to 610 were prepared thoroughly in the same manner as Sample 101 in Example 1 except for changing the average silver iodide (AgI) content of Silver Iodobromiide Emulsions A, B and C in the third, fourth and fifth layers of Sample 101 as shown in Table 8. Each sample was processed by Development Processings A-1, B-1 and B-2 in Example 1 and the gradient ratio of cyan density ($\gamma_B(C)/\gamma_A(C)$) was determined in respective processings. The results obtained are shown in Tables 8 and 9.

TABLE 8

| | | Average AgI Content of Red-sensitive Emulsion Layer (%) | | | | | |
|---|---|---|---|---|---|---|---|
| Run No. | Sample No. | 3rd Layer (low-sensitivity layer) | 4th Layer (medium-sensitivity layer) | 5th Layer (high-sensitivity layer) | Development Processing B | $\gamma_B(C)$ $\gamma_A(C)$ | Remarks |
| F01 | 101 | 6.0 | 8.9 | 8.9 | B-1 | 0.68 | Comparison |
| F02 | 601 | 3.0 | " | " | " | 0.70 | " |
| F03 | 602 | 1.0 | " | " | " | 0.71 | " |
| F04 | 603 | 6.0 | 3.0 | " | " | 0.69 | " |
| F05 | 604 | " | 1.0 | " | " | 0.71 | " |
| F06 | 605 | " | 8.9 | 3.0 | " | 0.72 | " |
| F07 | 606 | " | " | 1.0 | " | 0.69 | " |
| F08 | 607 | 3.0 | 3.0 | 8.9 | " | 0.68 | " |
| F09 | 608 | 3.0 | 8.9 | 3.0 | " | 0.70 | " |
| F10 | 609 | 1.0 | 3.0 | 8.9 | " | 0.69 | " |
| F11 | 610 | 1.0 | 1.0 | 3.0 | " | 0.71 | " |

TABLE 9

| | | Average AgI Content of Red-sensitive Emulsion Layer (%) | | | | | |
|---|---|---|---|---|---|---|---|
| Run No. | Sample No. | 3rd Layer (low-sensitivity layer) | 4th Layer (medium-sensitivity layer) | 5th Layer (high-sensitivity layer) | Development Processing B | $\gamma_B(C)$ $\gamma_A(C)$ | Remarks |
| F12 | 101 | 6.0 | 8.9 | 8.9 | B-2 | 0.83 | Invention |
| F13 | 601 | 3.0 | " | " | " | 0.90 | " |
| F14 | 602 | 1.0 | " | " | " | 0.91 | " |
| F15 | 603 | 6.0 | 3.0 | " | " | 0.96 | " |
| F16 | 604 | " | 1. 0 | " | " | 1.03 | " |
| F17 | 605 | " | 8.9 | 3.0 | " | 0.90 | " |
| F18 | 606 | " | " | 1.0 | " | 0.92 | " |
| F19 | 607 | 3.0 | 3.0 | 8.9 | " | 0.96 | " |
| F20 | 608 | 3.0 | 8.9 | 3.0 | " | 0.92 | " |
| F21 | 609 | 1.0 | 3.0 | 8.9 | " | 0.98 | " |
| F22 | 610 | 1.0 | 1.0 | 3.0 | " | 1.06 | " |

From the results in Tables 8 and 9, it is seen that the silver iodobromide of the present invention may be used in any red-sensitive emulsion layer but the use in a medium-sensitivity red-sensitive emulsion layer is particularly preferred.

EXAMPLE 7

Samples 101 and 104 in Example 1 each was cut into a size of 24 mm (width)×160 cm (length) and two perforations in size of 2 $mm^2$ were provided on each sample at an interval of 5.8 mm on the point of 0.7 mm in the width direction from one edge in the length direction. A pair of two perforations was provided at an interval of 32 mm and each sample was housed in a plastic-made film cartridge described in FIG. 1 to FIG. 7 of U.S. Pat. No. 5,296,887.

From the magnetic recording layer-coated side of each sample, an FM signal was recorded on the area between perforations provided above at a feed rate of 100 mm/s using a head capable of input and output having a head gap of 5 $\mu$m and a turn number of 2,000.

After the FM signal recording, samples were wedgewise exposed to white light from the light-sensitive layer side and then processed by the following Development Processings A-2 and B-30. Each development processing was conducted by a running processing in a cine-type automatic developing machine (until the cumulative replenishing amount of color developer reached 3 times the tank volume).

After the processing, each sample was determined on the cyan, magenta and yellow gradients after Development Processing A-2, namely, $\gamma_A$(C), $\gamma_A$(M) and $\gamma_A$(Y), and the cyan, magenta and yellow gradients after Development Processing B-30, namely, $\gamma_B$(C), $\gamma_B$(M) and $\gamma_B$(Y), were determined and $\gamma_B(C)/\gamma_A(C)$, $\gamma_B(M)/\gamma_A(M)$ and $\gamma_B(Y)/\gamma_A(Y)$ were calculated.

Thereafter, using samples subjected to Development Processing B-30, the signal was read out at the same rate as that upon recording of the signal with the above-described head and the ratio (error ratio) of bit number causing an error to the input bit number was determined. The error ratio of 0.1% or more is NG, 0.05% fair, and 0.01% or less preferred. When the error ratio is low as such, there arise any problem in practice.

Further, Development Processings B-31 and B-32 were conducted thoroughly in the same manner as Processing B-30 except for adding 1.0 mmol/l of a silver halide solvent as shown in Table 10 to both of the tank solution and the replenisher of the color developer in Development Processing B-30 and $\gamma_B(C)/\gamma_A(C)$, $\gamma_B(M)/\gamma_A(M)$, $\gamma_B(Y)/\gamma_A(Y)$ and the error ratio were determined. The results obtained are shown in Table 10.

TABLE 10

| Run No. | Sample No. | Development Processing B | Silver Halide Solvent | $\gamma_B(C)/\gamma_A(C)$ | $\gamma_B(M)/\gamma_A(M)$ | $\gamma_B(Y)/\gamma_A(Y)$ | Error ratio (%) | Remarks |
|---|---|---|---|---|---|---|---|---|
| G01 | 101 | B-30 | not added | 0.69 | 1.03 | 0.98 | 0.081 | Comparison |
| G02 | " | B-31 | sodium thiosulfate | 0.82 | 1.05 | 0.99 | 0.009 | Invention |
| G03 | " | B-32 | III-3 | 0.84 | 1.04 | 0.98 | 0.010 | " |
| G04 | 104 | B-30 | not added | 0.69 | 1.04 | 0.99 | 0.079 | Comparison |
| G05 | " | B-31 | sodium thiosulfate | 0.96 | 1.04 | 0.99 | 0.007 | Invention |
| G06 | " | B-32 | III-3 | 1.01 | 1.04 | 1.00 | 0.008 | " |

It is seen from the results in Table 10, according to the present invention, images having good color reproducibility were obtained even in a running processing. Also, it is seen that the reading error of magnetic recording was extremely reduced according to the present invention.

(Processing Step and Solution Composition in Development Processing A-2)

(Processing Step)

| Step | Processing Time | Processing Temperature (°C.) | Replenishing Amount* (ml) | Tank Volume (l) |
|---|---|---|---|---|
| Color development | 3 min 5 sec | 38.0 | 23 | 17 |
| Bleaching | 50 sec | 38.0 | 5 | 5 |
| Bleach-fixing | 50 sec | 38.0 | — | 5 |
| Fixing | 50 sec | 38.0 | 16 | 5 |
| Water washing | 30 sec | 38.0 | 34 | 3.5 |
| Stabilization (1) | 20 sec | 38.0 | — | 3 |
| Stabilization (2) | 20 sec | 38.0 | 20 | 3 |
| Drying | 1 min 30 sec | 60 | | |

*Replenishing amount was per 1.1 m of the light-sensitive material in width of 35 mm (corresponding to 1 roll of 24 Ex.)

The stabilizing solution was flown from (2) to (1) in a countercurrent system and the overflow solution of washing water was all introduced into the fixing bath. The replenishment of bleach-fixing bath was conducted such that a notch was provided at the upper portion of the bleaching tank. and also at the upper portion of the fixing tank in an automatic developing machine to thereby flow all overflow solution generated as a result of supplying replenishers into the bleaching tank and the fixing tank, into the bleach-fixing bath. The carried over amounts of developer into the bleaching step, of bleaching solution into the bleach-fixing step, of bleach-fixing solution into the fixing step, and of fixing solution into the water washing step were 2.5 ml, 2.0 ml, 2.0 ml, and 2.0 ml, respectively, per 1.1 m of the light-sensitive material in width of 35 mm. The cross-over time was 6 seconds in each interval and this is included in the processing time of the previous step.

The composition of each processing solution is shown below.

(Color Developer)

| | Tank Solution (g) | Replenisher (g) |
|---|---|---|
| Diethylenetriaminepentaacetic acid | 2.0 | 2.0 |
| 1-Hydroxyethylidene-1,1-diphosphonic acid | 2.0 | 2.0 |

-continued

| | Tank Solution (g) | Replenisher (g) |
|---|---|---|
| Sodium sulfite | 3.9 | 5.1 |
| Potassium carbonate | 37.5 | 39.0 |
| Potassium bromide | 1.4 | 0.4 |
| Potassium iodide | 1.3 mg | — |
| Hydroxylamine sulfate | 2.4 | 3.3 |
| Disodium N,N-bis(sulfonato-ethyl)hydroxylamine | 1.5 | 2.0 |
| 2-Methyl-4-[N-ethyl-N-(β-hydroxyethyl)amino]aniline sulfate | 4.8 (16.4 mmol) | 6.5 (22.2 mmol) |
| Water to make | 1.0 l | 1.0 l |
| pH (adjusted by potassium hydroxide and sulfuric acid) | 10.05 | 10.15 |

(Bleaching Solution)

| | Tank Solution (g) | Replenisher (g) |
|---|---|---|
| Ammonium 1,3-diamino-propanetetraacetato ferrate monohydrate | 130 | 195 |
| Ammonium bromide | 70 | 150 |
| Ammonium nitrate | 14 | 21 |
| Hydroxyacetic acid | 50 | 75 |
| Acetic acid | 40 | 60 |
| Water to make | 1.0 l | 1.0 l |
| pH (adjusted by aqueous ammonia) | 4.4 | 4.4 |

(Bleach-fixing Tank Solution)

A mixed solution of the above-described bleaching tank solution and the following fixing tank solution at a volume ratio of 15:85. (pH: 7.0)

(Fixing Solution)

| | Tank Solution (g) | Replenisher (g) |
|---|---|---|
| Ammonium sulfite | 19 | 57 |
| Aqueous solution of ammonium thiosulfate (700 g/l) | 280 ml | 840 ml |
| Imidazole | 15 | 45 |
| Ethylenediaminetetraacetic acid | 15 | 45 |
| Water to make | 1.0 l | 1.0 l |
| pH (adjusted by aqueous ammonia and acetic acid) | 7.4 | 7.45 |

(Washing Water)

The same composition as in Example 1 was used.

(Stabilizing Solution)

The same composition as in Example 1 was used.

(Processing Step and Solution Composition in Development Processing B-30)

(Processing Step)

| Step | Processing Time (sec) | Processing Temperature (°C.) | Replenishing Amount* (ml) | Tank Volume (l) |
|---|---|---|---|---|
| Color development | 60 | 45.0 | 260 | 5 |
| Bleaching | 20 | 45.0 | 130 | 3 |
| Fixing | 40 | 45.0 | 100 | 5 |
| Water washing (1) | 15 | 45.0 | — | 1 |
| Water washing (2) | 15 | 45.0 | — | 1 |

-continued

| Step | Processing Time (sec) | Processing Temperature (°C.) | Replenishing Amount* (ml) | Tank Volume (l) |
|---|---|---|---|---|
| Water washing (3) | 15 | 45.0 | 400 | 1 |
| Drying | 45 | 80 | | |

*Replenishing amount was per 1 $m^2$ of the light-sensitive material.

(Water washing was in a 4-tank countercurrent multi-stage cascade system from (3) to fixing.)

The composition of each processing solution is shown below.

(Color Developer)

| | Tank Solution (g) | Replenisher (g) |
|---|---|---|
| Diethylenetriaminepentaacetic acid | 2.0 | 4.0 |
| 1-Hydroxyethylidene-1,1-diphosphonic acid | 3.3 | 3.3 |
| Sodium sulfite | 3.9 | 6.5 |
| Potassium carbonate | 37.5 | 39.0 |
| Potassium bromide | 2.0 | — |
| Potassium iodide | 1.3 mg | — |
| Disodium N,N-bis(sulfonato-ethyl)hydroxylamine | 12.0 | 17.0 |
| 2-Methyl-4-[N-ethyl-N-(β hydroxyethyl)amino]aniline sulfate | 11.5 (39.3 mmol) | 15.0 (51.3 mmol) |
| Water to make | 1.0 l | 1.0 l |
| pH (adjusted by potassium hydroxide and sulfuric acid) | 10.05 | 10.25 |

(Bleaching Solution)

| | Tank Solution (mol) | Replenisher (mol) |
|---|---|---|
| Ammonium 1,3-diamino-propanetetraacetato ferrate monohydrate | 0.33 | 0.50 |
| Ferric nitrate nonahydrate | 0.30 | 4.5 |
| Ammonium bromide | 0.80 | 1.2 |
| Ammonium nitrate | 0.20 | 0.30 |
| Acetic acid | 0.67 | 1.0 |
| Water to make | 1.0 l | 1.0 l |
| pH (adjusted by aqueous ammonia) | 4.5 | 4.0 |

(Fixing Solution) The tank solution and the replenisher were common.

| | |
|---|---|
| Ammonium sulfite | 28 |
| Aqueous solution of ammonium thiosulfate (700 g/l) | 280 ml |
| Imidazole | 15 |
| Ethylenediaminetetraacetic acid | 15 |
| Water to make | 1.0 l |
| pH (adjusted by aqueous ammonia and acetic acid) | 5.8 |

(Washing Water)

Water having the same composition as the washing water in Example 1 was used.

(Stabilizing Solution)

solution having the same composition as the stabilizing solution in Example 1 was used.

EXAMPLE 8

The same evaluation as in Example 1 was conducted except for replacing the color developing agent 2-methyl-4-[N-ethyl-N-(β-hydroxyethyl)amino]aniline sulfate in Example 1 by an equimolar amount of D-3, D-7 or D-10 and the effects of the present invention were verified similarly to Example 1.

EXAMPLE 9

Development Processings B-40 to B-52 were conducted using Sample 105 thoroughly in the same manner as Development Processing B-2 in Example 1 except for replacing Compound (III-3) of the present invention by an equimolar amount (1.0 mmol/l) of a silver halide solvent shown in Table 11 and $\gamma_B(C)/\gamma_A(C)$ in each processing was determined in the same manner as in Example 1.

The results obtained are shown in Table 11.

TABLE 11

| Run No. | Sample No. | Development Processing B | Silver Halide Solvent | $\gamma_B(C)/\gamma_A(C)$ | Remarks |
|---|---|---|---|---|---|
| H01 | 105 | B-1 | not added | 0.69 | Comparison |
| H02 | " | B-2 | III-3 | 0.98 | Invention |
| H03 | " | B-40 | IV-1 | 0.97 | " |
| H04 | " | B-41 | IV-2 | 0.96 | " |
| H05 | " | B-42 | IV-3 | 0.96 | " |
| H06 | " | B-43 | IV-4 | 0.96 | " |
| H07 | " | B-44 | IV-9 | 0.91 | " |
| H08 | " | B-45 | IV-10 | 0.90 | " |
| H09 | " | B-46 | IV-12 | 0.87 | " |
| H10 | " | B-47 | V-1 | 0.92 | " |
| H11 | " | B-48 | V-2 | 0.95 | " |
| H12 | " | B-49 | V-3 | 0.90 | " |
| H13 | " | B-50 | V-4 | 0.91 | " |
| H14 | " | B-51 | V-21 | 0.88 | " |
| H15 | " | B-52 | V-28 | 0.88 | " |

EXAMPLE 10

Development Processings A'-2 and B'-32 were conducted using Sample 105 thoroughly in the same manner as in Example 7 except for conducting batch processing by omitting the replenishment in Development Processings A-2 and B-32 in Example 7. Further, experiments were conducted by changing the concentration of developing agent, the temperature of developer and the color development time in Development Processings A'-2 and B'-32 and the concentration of Compound (III-3) in Development Processing B'-32, as shown in Table 12. The results obtained are shown in Table 12.

TABLE 12

| | | Development Processing A'-2 | | | Development Processing B'-32 | | | | | |
|---|---|---|---|---|---|---|---|---|---|---|
| Run No. | Sample No. | Concentration of Developing Agent (mmol/l) | Temperature (°C.) | Time (sec) | Concentration of Developing Agent (mmol/l) | Temperature (°C.) | Time (sec) | III-3 (mmol/l) | $\gamma_{B'}(C)/\gamma_{A'}(C)$ | Remarks |
| I01 | 105 | 16.4 | 38.0 | 185 | 39.3 | 45.0 | 60 | 1.0 | 1.00 | ◎ |
| I02 | " | 14.3 | 36.5 | 175 | " | " | " | " | 1.12 | ○ |
| I03 | " | 15.0 | 37.0 | 180 | " | " | " | " | 1.09 | ◎ |
| I04 | " | 17.0 | 38.0 | 185 | " | " | " | " | 0.99 | ◎ |
| I05 | " | 18.0 | 38.5 | 190 | " | " | " | " | 0.96 | ◎ |
| I06 | " | 20.0 | 39.0 | 195 | " | " | " | " | 0.92 | ◎ |
| I07 | " | 20.5 | 39.5 | 200 | " | " | " | " | 0.84 | ○ |
| I08 | " | 16.4 | 38.0 | 185 | 34.8 | 42.7 | 48 | " | 0.82 | ○ |
| I09 | " | " | " | " | 35.2 | 43.0 | 51 | " | 0.91 | ◎ |
| I10 | " | " | " | " | 36.5 | 44.1 | 55 | " | 0.95 | ◎ |
| I11 | " | " | " | " | 38.2 | 45.2 | 60 | " | 0.99 | ◎ |
| I12 | " | " | " | " | 40.0 | 46.0 | 65 | " | 1.06 | ◎ |
| I13 | " | " | " | " | " | 47.0 | 70 | " | 1.09 | ◎ |
| I14 | " | " | " | " | " | " | 75 | " | 1.12 | ○ |
| I15 | " | " | " | " | 39.0 | 45.0 | 60 | 0.5 | 0.89 | ○ |
| I16 | " | " | " | " | " | " | " | 0.8 | 0.98 | ◎ |
| I17 | " | " | " | " | " | " | " | 3.0 | 1.04 | ◎ |
| I18 | " | " | " | " | " | " | " | 4.0 | 1.11 | ○ |

○: within preferred range;
◎: within most preferred range

EXAMPLE 11

Experiments were conducted thoroughly in the same manner as in Example 1 except for, in Development Processing B-2, changing the addition amount of Compound (III-3) of the present invention to 0.5 mmol/l and further adding Compound (III-8), (III-12), (IV-1) or (V-3) each in an amount of 0.5 mmol/l and as a result, effects of the present invention were achieved similarly.

While the invention has been described in detail and with reference to specific embodiments thereof, it will be apparent to one skilled in the art that various changes and modifications can be made therein without departing from the spirit and scope thereof.

What is claimed is:

1. A method for forming a color image comprising subjecting a silver halide color photographic material, said silver halide color photographic material comprising a support having thereon at least one red-sensitive silver halide emulsion layer, at least one green-sensitive silver halide emulsion layer and at least one blue-sensitive silver halide emulsion layer, to Development Processing B;

wherein the Development Processing B comprises color developing the silver halide photographic material for 25 to 90 seconds and at a temperature of 40° to 60° C. with a color developer containing a color developing agent in an amount of 25 to 80 mmol/l and containing at least one silver halide solvent selected front the group consisting of a thiosulfate, a methanethiosulfonate and compounds represented by the following formulae (III) to (V):

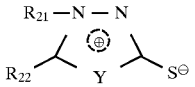

(III)

wherein $R_{21}$ and $R_{22}$ each represents an alkyl group, a cycloalkyl group, an alkenyl group, an alkynyl group, an aralkyl group, an aryl group or a heterocyclic group; provided that $R_{22}$ may represent a hydrogen atom; Y represents —O—, —S—, or —N($R_{23}$)—; $R_{23}$ represents an alkyl group, a cycloalkynyl group, an alkenyl group, an alkynyl group, an aryl group, a heterocyclic group, an amino group, an acylamino group, a sulfonamide group, a ureido group or a sulfamoylamino group; and $R_{21}$ and $R_{22}$, or $R_{22}$ and $R_{23}$ may be combined with each other to form a ring;

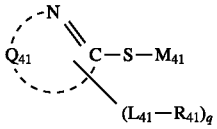

(IV)

wherein $Q_{41}$ represents a nonmetallic atom group necessary for forming a 5- or 6-membered heterocyclic ring, provided that the heterocyclic ring may be condensed with a carboaromatic ring or a heteroaromatic ring; $L_{41}$ represents a single bond, a divalent aliphatic group, a divalent aromatic hydrocarbon group, a divalent heterocyclic group or a linking group comprising a combination of these; $R_{41}$ represents a carboxylic acid or a salt thereof, a sulfonic acid or a salt thereof, a phosphonic acid or a salt thereof, an amino group or an ammonium salt; q represents an integer of from 1 to 3; and $M_{41}$ represents a hydrogen atom or a cation;

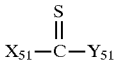

(V)

wherein $X_{51}$ and $Y_{51}$ each represents an aliphatic group, an aromatic hydrocarbon group, a heterocyclic group, —N($R_{51}$)$R_{52}$, —N($R_{53}$)N($R_{54}$)$R_{55}$, —O$R_{56}$ or —S$R_{57}$; $X_{51}$ and $Y_{52}$ may form a ring exclusive of an enolic form, provided that at least one of $X_{51}$ and $Y_{51}$ is substituted by at least one of a carboxylic acid or salt thereof, a sulfonic acid or a salt thereof, a phosphonic acid or a salt thereof, an amino group, an ammonium group and a hydroxyl group; $R_{51}$, $R_{52}$, $R_{53}$, $R_{54}$ and $R_{55}$ each represents a hydrogen atom, an aliphatic group, an aromatic hydrocarbon group or a heterocyclic group; and $R_{56}$ and $R_{57}$ each represents a hydrogen atom, a cation, an aliphatic group, an aromatic hydrocarbon group or a heterocyclic group; wherein said red-sensitive silver halide emulsion laver contains a silver halide emulsion having an average silver iodide content of from 0.1 to 10 mol %, and the color developer contains a bromide ion in an amount of from 15 to 60 mmol/l.

2. The method for forming a color image as claimed in claim 1, wherein said silver halide emulsion has an average silver iodide content of from 0.5 to 5.0 mol %.

3. The method for forming a color image as claimed in claim 1, wherein said silver halide emulsion has an average aspect ratio of from 5 to 10.

4. The method for forming a color image as claimed in claim 1, wherein said red-sensitive silver halide emulsion comprises a high-sensitivity silver halide emulsion layer, a medium-sensitivity silver halide emulsion layer and a low-sensitivity silver halide emulsion layer, wherein said medium-sensitivity red-sensitive silver halide emulsion layer contains said silver halide emulsion.

5. The method for forming a color image as claimed in claim 1, wherein a transparent magnetic recording layer is provided on said support on the side opposite to the silver halide emulsion layers.

6. The method for forming a color image as claimed in claim 1, wherein said Development Processing B is the following Development Processing B':

wherein the Development Processing B' comprises color developing the silver halide photographic material for 50 to 70 seconds and at a temperature of 43° to 47° C. with a color developer containing 2-methyl-4-[N-ethyl-N-(β-hydroxyethyl)-amino]aniline as a color developing agent in an amount of 35 to 40 mmol/l and containing the following silver halide solvent (III-3) in an amount of 0.8 to 3 mmol/l:

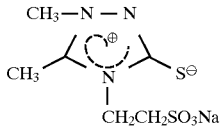

(III-3)

which may be represented by the following limiting structural formula:

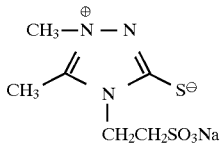

* * * * *